US009409223B2

(12) United States Patent
Morehead et al.

(10) Patent No.: US 9,409,223 B2
(45) Date of Patent: Aug. 9, 2016

(54) PUNCH ASSEMBLIES AND UNIVERSAL PUNCH THEREFOR

(71) Applicant: Wilson Tool International Inc., White Bear Lake, MN (US)

(72) Inventors: John H Morehead, White Bear Lake, MN (US); Brian J Lee, Elk River, MN (US); Kevin A Johnston, Deer Park, WI (US); Richard L Timp, Vadnais Heights, MN (US)

(73) Assignee: Wilson Tool International Inc., White Bear Lake, MN (US)

( * ) Notice: Subject to any disclaimer, the term of this patent is extended or adjusted under 35 U.S.C. 154(b) by 20 days.

(21) Appl. No.: 14/357,083

(22) PCT Filed: Nov. 5, 2012

(86) PCT No.: PCT/US2012/063505

§ 371 (c)(1),
(2) Date: May 8, 2014

(87) PCT Pub. No.: WO2013/070536

PCT Pub. Date: May 16, 2013

(65) Prior Publication Data

US 2014/0331842 A1 Nov. 13, 2014

Related U.S. Application Data

(63) Continuation-in-part of application No. 13/294,754, filed on Nov. 11, 2011, now Pat. No. 8,707,841.

(51) Int. Cl.
*B21D 37/04* (2006.01)
*B21D 28/34* (2006.01)

(52) U.S. Cl.
CPC ..... *B21D 37/04* (2013.01); *B21D 28/34* (2013.01); *B21D 28/343* (2013.01); *Y10T 29/49826* (2015.01); *Y10T 83/9428* (2015.04); *Y10T 83/9476* (2015.04)

(58) Field of Classification Search
CPC ..... B21D 37/04; B21D 28/343; B21D 28/34; Y10T 83/9428; Y10T 83/9476; Y10T 29/49826
USPC ..... 83/686, 698.11
See application file for complete search history.

(56) References Cited

U.S. PATENT DOCUMENTS

| | | | |
|---|---|---|---|
| 199,715 | A | 1/1878 | Jenkins |
| 1,179,476 | A | 4/1916 | Thomas |

(Continued)

FOREIGN PATENT DOCUMENTS

| | | | |
|---|---|---|---|
| CN | 1176855 | A | 3/1998 |
| CN | 1360537 | A | 7/2002 |
| CN | 1972767 | A | 5/2007 |
| CN | 201127968 | Y | 10/2008 |
| CN | 101791653 | A | 8/2010 |
| DE | 1777363 | A1 | 12/1972 |
| FR | 2641486 | A1 | 7/1990 |
| JP | 54059594 | U | 4/1979 |
| JP | 5555877 | Y2 | 12/1980 |

(Continued)

OTHER PUBLICATIONS

PCT International Search Report and Written Opinion dated Jan. 4, 2013 from PCT/US2012/063505, from which the instant application is based, 11 pgs.

(Continued)

*Primary Examiner* — Sean Michalski
(74) *Attorney, Agent, or Firm* — Fredrikson & Byron, P.A.

(57) ABSTRACT

A punch tip (16) design configured to be universal in its application with wide varieties of punch assemblies, and various punch body (14) designs from which universal application of the punch tip (16) is exemplified. Ancillary components (34, 16, 50) used with the various punch body (14) designs enhance ease by which the operator can se¬lectively manipulate the same for alternately securing or releasing the punch tip (16).

15 Claims, 43 Drawing Sheets

(56) References Cited

U.S. PATENT DOCUMENTS 1,383,414 A 7/1921 Mansell
1,386,259 A * 8/1921 Jourdan ..... F16B 39/32 411/298
1,784,911 A * 12/1930 Schlitters, Jr. ..... B21D 28/34 279/30
1,910,275 A * 5/1933 Alden ..... B21D 28/34 279/29
2,107,581 A 2/1938 Parsons et al.
2,245,676 A 6/1941 Johnson
2,522,440 A 9/1950 Freter
2,614,781 A 10/1952 Engel
2,893,291 A * 7/1959 Hollis ..... B23B 31/06 279/118
2,927,432 A 3/1960 Parry
2,975,967 A 3/1961 Felmet
3,289,519 A * 12/1966 Piccone ..... B21D 28/34 403/322.2
3,447,455 A * 6/1969 Shneider ..... B41J 9/127 101/93.48
3,495,493 A * 2/1970 Bauer ..... B21D 28/34 279/44
3,530,750 A * 9/1970 Daniels ..... B21D 28/34 83/141
3,548,700 A * 12/1970 Herzog ..... B21D 28/34 83/698.91
3,600,999 A * 8/1971 Daniels ..... B21D 28/34 279/90
3,641,860 A 2/1972 Whistler et al.
3,735,993 A * 5/1973 Seibert ..... B23B 31/1071 279/75
3,763,730 A 10/1973 Ahlegian
4,092,888 A * 6/1978 Wilson ..... B21D 28/34 83/140
4,146,239 A * 3/1979 Martin ..... B23B 31/1074 279/77
4,174,648 A * 11/1979 Wallis ..... B21D 28/34 279/28
4,273,015 A 6/1981 Johnson
4,377,292 A * 3/1983 Staron ..... B23B 31/1074 279/46.1
4,446,767 A * 5/1984 Wilson ..... B21D 45/006 83/136
4,503,741 A 3/1985 Hunter et al.
4,526,077 A 7/1985 DeGuvera
4,718,161 A * 1/1988 Pfister ..... B21D 37/04 483/28
4,762,043 A 8/1988 Sneed
4,850,755 A * 7/1989 Spencer ..... B23B 49/04 279/145
4,989,484 A * 2/1991 Johnson ..... B21D 45/006 83/136
5,020,407 A * 6/1991 Brinlee ..... B21D 28/12 83/530
5,044,244 A 9/1991 Olson
5,131,303 A * 7/1992 Wilson ..... B21D 28/34 83/140
5,271,303 A * 12/1993 Chatham ..... B21D 45/006 29/466
5,301,580 A * 4/1994 Rosene ..... B21D 45/006 83/136
5,329,835 A * 7/1994 Timp ..... B21D 28/34 83/686
5,647,256 A * 7/1997 Schneider ..... B21D 28/34 83/140
5,746,104 A 5/1998 Russell et al.
5,752,424 A * 5/1998 Rosene ..... B21D 28/34 83/686
5,832,798 A 11/1998 Schneider et al.
5,839,341 A 11/1998 Johnson et al.
5,884,546 A 3/1999 Johnson
5,887,502 A 3/1999 Yamaguchi et al.
5,934,165 A * 8/1999 Chatham ..... B21D 28/12 83/143
6,047,621 A 4/2000 Dries et al.
6,082,516 A 7/2000 Willer
6,142,052 A 11/2000 Endo
6,196,103 B1 3/2001 Schneider et al.
6,276,247 B1 * 8/2001 Helda ..... B21D 28/34 83/684
6,334,381 B1 1/2002 Chatham
6,463,839 B2 * 10/2002 Ohtsuka ..... B21D 19/08 83/686
6,725,756 B2 4/2004 Brenneke
6,782,787 B2 * 8/2004 Morehead ..... B21D 28/34 83/679
6,895,797 B2 5/2005 Lowry et al.
6,895,849 B2 5/2005 Rosene et al.
7,051,635 B2 * 5/2006 Morehead ..... B21D 28/34 279/76
7,069,765 B2 7/2006 Grove et al.
7,156,009 B2 1/2007 Iwamoto et al.
7,159,426 B1 1/2007 Ghiran
7,168,356 B2 1/2007 Rosene et al.
7,802,506 B2 * 9/2010 Endo ..... B21D 45/006 83/140
7,900,543 B2 * 3/2011 Ikeda ..... B21D 28/12 83/532
7,926,399 B2 * 4/2011 Huang ..... B21D 28/005 29/33 J
7,975,587 B2 7/2011 Schneider
8,327,745 B2 12/2012 Lee et al.
8,707,841 B2 4/2014 Morehead et al.
8,714,065 B2 * 5/2014 Takahashi ..... B21D 28/34 83/123
2003/0075034 A1 4/2003 Brenneke
2004/0200333 A1 * 10/2004 Seeley ..... B21D 28/34 83/698.91
2006/0048623 A1 * 3/2006 Schneider ..... B21D 28/34 83/698.91
2006/0060046 A1 * 3/2006 Sugizaki ..... B21D 28/26 83/138
2007/0068352 A1 * 3/2007 Morgan ..... B21D 28/34 83/140
2009/0173204 A1 * 7/2009 Malvestiti ..... B21D 28/12 83/640
2010/0107832 A1 * 5/2010 Johnston ..... B21D 28/34 83/13
2011/0072948 A1 * 3/2011 Belyan ..... B21D 5/0209 83/698.31
2013/0118331 A1 * 5/2013 Morehead ..... B21D 28/34 83/686
2013/0139667 A1 6/2013 Lee et al.
2013/0340588 A1 * 12/2013 Qi ..... B21D 28/34 83/698.31

FOREIGN PATENT DOCUMENTS

JP 57-189625 12/1982
JP 56-113039 2/1983
JP 05-192717 8/1993
JP 09-174162 A 7/1997
JP 3037168 B2 4/2000
JP 2001137970 A 5/2001
JP 2002-11531 A 1/2002
JP 2004-500242 A 1/2004
JP 2007-136463 6/2007
WO 2004060620 A2 7/2004
WO 2010053895 A1 5/2010

OTHER PUBLICATIONS

International Search Report and Written Opinion for International Patent Application No. PCT/US2009/063058, mailed Feb. 17, 2010, 10 pages.
International Preliminary Report on Patentability for International Patent Application No. PCT/US2012/063505, mailed Jan. 4, 2013, 7 pages.

* cited by examiner

PUNCH ASSEMBLIES AND UNIVERSAL PUNCH THEREFOR

RELATED APPLICATIONS

This application is a 35 U.S.C. 371 national stage filing from International Application No. PCT/US2012/063505 filed Nov. 5, 2012 and claims priority to U.S. application Ser. No. 13/294,754 filed Nov. 11, 2011, the teachings of which are incorporated herein by reference.

TECHNICAL FIELD

The present invention pertains to punch assemblies and more particularly to a punch designed to be accommodated by various types of such assemblies.

BACKGROUND

Punch presses are typically configured to hold a plurality of tools for forming a variety of shapes and sizes of indentations and/or holes in sheet workpieces, e.g., formed of sheet metal. Tools of this sort commonly include at least one punch assembly and corresponding die. In a multiple station turret punch press, a rotatable turret is often used for holding a plurality of punch assemblies above a workpiece support surface, while a corresponding plurality of die-receiving frames are located below the workpiece support surface. In some cases, once a first tool set has been used, it is exchanged for a second tool set, and then a third, and so on. In some cases, the machine tool includes an elongated rail for storing the tool set in cartridges. The cartridges, for example, can be slidably engaged with the rail such that they can be slid back and forth to and from the mounting position. Once a first workpiece has been fully processed using the desired sequence of tool sets, a second workpiece may be processed, in some cases beginning again with the first tool set.

A conventional punch assembly includes a punch guide and a punch body or holder, as well as a punch tip, which may be either fixedly or releasably attached to the punch body. The punch body and tip are slidably engaged within the punch guide for reciprocal, axial movement along a central longitudinal axis of the punch guide. Such a punch assembly and a corresponding die are mounted in a press and located in a working position of the press, e.g., beneath the ram (or integrally connected to the ram). As such, when downward force is provided on the ram, the punch tip is driven out from the punch guide in response and through an opening in a stripper plate, in order to form an indentation or a hole through a sheet workpiece. The stripper plate, which is attached to an end of the punch guide, prevents the workpiece from following the punch tip, upon its retraction back into the punch guide.

Those skilled in the art appreciate that punch assemblies require regular maintenance and modification, for example, to sharpen or replace worn punch tips, and to replace punch tips of one shape (or footprint) with those of an alternate shape for differing pressing operations. In the case of punch tips configured to be releasably attached to punch bodies, such tips are generally assembly-specific, i.e., not interchangeable with other punch assembly types. As a result, regular maintenance and modification on differing punch assemblies can involve a great deal of time and expense with regard to keeping sufficient stock of replacement punch tips for each of the assemblies.

SUMMARY

Embodiments of the invention are concerned with a punch tip design configured to be universal in its application with wide varieties of punch assemblies, and further with regard to various punch body designs from which universal application of the punch tip is exemplified. In some cases, ancillary components used with the various punch body designs enhance ease by which the operator can selectively manipulate the same for alternately securing or releasing the punch tip.

In one group of embodiments, a punch tool is provided and comprises a punch body, a punch tip, and a plurality of ancillary components. The punch body has a sidewall that defines a central cavity, the central cavity extending along a longitudinal extent of the punch body. The punch tip is configured to be alternately secured or released with respect to the punch body, the punch tip including a hub on one end thereof. The plurality of ancillary components comprises a cam, a carrier body, and a plurality of wedge members. The carrier body is seated within the punch body central cavity. The cam couples the punch body and the carrier body. The cam is selectively adjustable with respect to the punch body and the carrier body, and adjustment of the cam resulting in corresponding movement of the carrier body. The cam in a first adjusted position corresponds with the carrier body being in a raised position within the punch body central cavity and each of the wedge members being in a locked position within the punch body central cavity. Said locked position of the wedge members corresponds to a locking configuration of the punch body with respect to the punch tip hub. The cam in a second adjusted position corresponds with the carrier body being in a lowered position within the punch body central cavity and each of the wedge members being in an unlocked position within the punch body central cavity. Said unlocked position of the wedge members corresponds to an unlocking configuration of the punch body with respect to the punch tip hub.

Optionally, the cam may be selectively adjustable via rotation and may include one or more protruding portions, wherein orientation of the one or more protruding portions via rotation of the cam may result in the corresponding movement of the carrier body.

The cam may optionally comprise a rod-like body that may extend from an aperture defined in the punch body sidewall and through a bore defined in the carrier body. The rod-like body may optionally have a longitudinal extent that may be generally perpendicular to the longitudinal extent of the punch body. In addition, the rod-like body may optionally include a head portion operatively coupled to the punch body via ball-channel linkage. Additionally, a channel may optionally be defined along an outer surface of the head portion and may be configured to partially accommodate a ball retained by the punch body, and wherein rotation of the rod-like body with respect to the punch body and the carrier body may correspond to rotation of the channel about the ball. The channel may optionally include one or more pockets, wherein the ball when positioned in one of the pockets may constitute a locking position for the rod-like body with respect to the punch body and the carrier body. In addition, the rod-like body may optionally include a stem portion having a segment with a first protruding portion on one side thereof, wherein the rod-like body in the first adjusted position may involve the first protruding portion being oriented in a direction toward a front end of the carrier body and may contact a corresponding sidewall of the carrier body bore, wherein said contact between the first protruding portion and the carrier bore sidewall may correspond to the raised position of the carrier body within the punch body cavity. Additionally, the rod-like body in the second adjusted position may optionally involve the first protruding portion being oriented in a direction toward a rear end of the carrier body and may contact a corresponding sidewall of the carrier body bore, wherein said contact between the first protruding portion and the carrier body sidewall may correspond to the lowered position of the carrier body within the punch body cavity.

Alternatively, the cam may optionally comprise a ring having two curved partial portions, wherein the two curved portions may be configured to be coupled together about a circumference of the punch body, and wherein the ring may be adjustably coupled to the carrier body via ball-seat linkage. The ring may optionally be configured to be selectively rotated about an axis extending central to the longitudinal extent of the punch body. In addition, first and second balls may optionally be further comprised, wherein the carrier body may include a stem defining first and second depressions that may be sized to correspondingly seat the first and second balls, the first and second depressions may be defined on opposing sides of the carrier body stem, wherein the first depression may be defined further from a back end of the stem then the second depression, wherein rotation of the ring to the first adjusted position may result in seating of the first ball with the first depression and corresponding movement of the carrier body into the raised position within the punch body, and wherein rotation of the ring to the second adjusted position may result in seating of the second ball with the second depression and corresponding movement of the carrier body into the lowered position within the punch body. The ring may optionally have first and second thicknesses oriented about an inner surface of the ring, wherein the first ring thickness may be greater than the second ring thickness, wherein rotation of the ring to the first adjusted position may result in sliding of the first ring thickness in contact with the first ball and may result in sliding of the second ring thickness in contact with the second ball, and rotation of the ring to the second adjusted position may result in sliding of the second ring thickness in contact with the first ball and may result in sliding of the first ring thickness in contact with the second ball.

Optionally, each of the plurality of wedge members may include a surface having a shape configured to mate with a corresponding surface of the punch tip hub, wherein the surfaces of the wedge members and the punch tip hub may represent the only contacting surfaces of the wedge members and the punch tip hub in securing the punch tip to the punch body. In addition, each of the contacting surfaces of the wedge members and the punch tip hub may optionally have differing slope angles. The slope angles of the contacting surfaces of the wedge members and the punch tip hub may optionally differ from each other in a range of between about 5° to about 10°. In addition, the punch tip hub surface may optionally have a slope angle in a range of between about 37° to about 50° and the surface of the wedge members may optionally have a slope angle in a range of between about 43° to about 56°. The surface of the wedge members may optionally be planar. Alternatively, the surface of the wedge members may optionally be curved. Additionally, the outer side surface of the wedge members may optionally be entirely curved.

Optionally, the carrier body may be defined with a plurality of slots each defined to accommodate one of the plurality of wedge members, and wherein movement of the carrier body within the punch body central cavity may result in corresponding movement of the wedge members relative to corresponding grooves defined in an inner surface of the punch body sidewall. Additionally, a pusher-retainer may optionally be further comprised and seated in a central cavity of the carrier body, wherein the pusher-retainer may be urged to a raised position in the central cavity when the carrier body is in the lowered position, and wherein the pusher-retainer in the raised position may prevent the wedge members from sliding out of the carrier body slots and into the carrier body central cavity. In addition, the wedge members may optionally be configured to contact and slide along side surfaces of the punch body grooves, wherein combined contact with the groove side surfaces and walls defining the carrier body slots may result in locking of the wedge members when the carrier body is in the raised position. Additionally, the wedge members may optionally be configured to contact and slide along side surfaces of the punch body grooves, wherein the wedge members may correspondingly slide within the carrier body slots and may partially protrude into a central cavity of the carrier body when the carrier body is in the raised position. Each protruding portion of the wedge members may optionally include a surface configured to mate with a corresponding surface of the punch tip hub, wherein the surfaces of the wedge members and the punch tip hub may represent the only contacting surfaces of the wedge members and the punch tip hub in securing the punch tip to the punch body.

In another group of embodiments, a punch tip is provided and comprises a body having a first end configured to be alternately secured or released with respect to a punch body and a second end comprising a working end of the punch tip. The first end includes a hub that is offset from a remainder of the body by a neck region. The hub has an upper area, a side area, and a bottom area. The bottom area of the hub and the neck region define a recessed area of the body. A surface of the bottom area of the hub is configured to singly mate with a corresponding surface of wedge members in securing the body to the punch body. The bottom area surface of the hub is planar and has an inward slope relative to the hub side area, the bottom area surface of the hub represents lone surface of the hub extending between the hub side area and the neck region. The bottom area surface of the hub represents an entirety of surface area between the hub side area and the neck region for the corresponding surface wedge member to mate with in securing the body to the punch body.

Optionally, the bottom area surface of the hub may define at least one quarter of the recess.

Optionally, the inward slope of the bottom area surface of the hub may enable secure coupling with the corresponding surface of the wedge members even in event of said corresponding surface varying in slope angle between about 2° and about 20° with the bottom area surface. Alternatively, the corresponding surface of the wedge members may optionally vary in slope angle between about 5° and about 10° with the bottom surface of the hub.

Optionally, the inward slope angle of the bottom area surface of the hub as measured from an axis running along a longitudinal extent of the punch body may be in the range of between about 25° and about 55°. Alternatively, the inward slope angle of the bottom area surface of the hub may optionally be in the range of between about 37° and about 50°.

Optionally, the upper side of the hub may be defined with a threaded portion, wherein the threaded portion may comprise a secondary means of coupling the hub with a punch body without configuration of the corresponding wedge members.

In another group of embodiments, a punch tip is provided and comprises a body having a first end configured to be alternately secured or released with respect to a punch body and a second end comprising a working end of the punch tip. The first end includes a hub that is offset from a remainder of the body by a neck region. The hub has an upper area, a side area, and a bottom area. The bottom area of the hub and the neck region define a recessed area of the body. A surface of the bottom area of the hub is configured to singly mate with a corresponding surface of wedge members in securing the body to the punch body. The bottom area surface of the hub is planar and has an inward slope relative to the hub side area. Such inward slope enabling secure coupling with the corresponding surface of the wedge members even in event of said corresponding surface varying in slope angle between about 2° and about 20° with the bottom area surface. The inward slope angle of the bottom area surface of the hub as measured from an axis running along a longitudinal extent of the punch body is in the range of between about 25° and about 55°.

Optionally, the corresponding surface of the wedge members may vary is slope angle between about 5° and about 10° with the bottom surface of the hub. In addition, the inward slope angle of the bottom area surface of the hub may optionally be in the range of between about 37° and about 50°.

Optionally, the upper side of the hub may be defined with a threaded portion, wherein the threaded portion may comprise a secondary means of coupling the hub with a punch body without configuration of the corresponding wedge members.

In another group of embodiments, a method of securing a punch tip with a punch body is provided. The method comprises providing a punch body and a plurality of ancillary components used therewith. The punch body has a sidewall that defines a central cavity. The central cavity extends along a longitudinal extent of the punch body. The plurality of ancillary components comprises a cam, a carrier body, and a plurality of wedge members. The carrier body is seated within the punch body central cavity. The cam couples the punch body and the carrier body. The method comprises adjusting the cam to a second position which corresponds with the carrier body being lowered in position within the punch body central cavity and each of the wedge members being unlocked within the punch body central cavity. The unlocked position of the wedge members corresponding to an unlocking configuration of the punch body with respect to a punch tip. The method comprises adjoining a punch tip to the punch body. The punch tip includes a hub on one end thereof, with the hub being inserted within the central cavity of the punch body. The method comprises adjusting the cam to a first position which corresponds with the carrier body being raised in position within the punch body central cavity and each of the wedge members being locked within the punch body central cavity. Said locked position of the wedge members corresponds to a locking configuration of the punch body with respect to the punch tip hub.

Optionally, the cam may be selectively adjustable via rotation and may include one or more protruding portions, wherein orientation of the one or more protruding portions via rotation of the cam may result in the corresponding movement of the carrier body within the central cavity of the punch body. In addition, the cam may optionally comprise a rod-like body that may extend from an aperture defined in the punch body sidewall and through a bore defined in the carrier body, wherein the rod-like body may include a stem portion having a segment with a first protruding portion on one side thereof, wherein the rod-like body when rotated to the first position may orient the first protruding portion in a direction toward a front end of the carrier body and may contact a corresponding sidewall of the carrier body bore, wherein said contact between the first protruding portion and the carrier bore sidewall may correspond to the raised position of the carrier body within the punch body cavity, and wherein the rod-like body when rotated to the second position may orient the first protruding portion in a direction toward a rear end of the carrier body and may contact a corresponding sidewall of the carrier body bore, wherein said contact between the first protruding portion and the carrier body sidewall may correspond to the lowered position of the carrier body within the punch body cavity.

Optionally, the carrier body may be defined with a plurality of slots each defined to accommodate one of the plurality of wedge members, and wherein the raising and lowering of the carrier body within the punch body central cavity may result in the wedge members moving relative to corresponding grooves defined in an inner surface of the punch body sidewall. In addition, the wedge members may optionally be configured to contact and slide along side surfaces of the punch body grooves, wherein the wedge members may correspondingly slide within the carrier body slots and may partially protrude into a central cavity of the carrier body when the carrier body is in the raised position. Additionally, each protruding portion of the wedge members may optionally include a surface configured to mate with a corresponding surface of the punch tip hub, wherein the surfaces of the wedge members and the punch tip hub may represent the only contacting surfaces of the wedge members and the punch tip hub in securing the punch tip to the punch body.

Other features and benefits that characterize embodiments of the present invention will be apparent upon reading the following detailed description and review of the associated drawings.

BRIEF DESCRIPTION OF THE DRAWINGS

The following drawings are illustrative of particular embodiments of the present invention and therefore do not limit the scope of the invention. The drawings are not to scale (unless so stated) and are intended for use in conjunction with the explanations in the following detailed description. Embodiments of the present invention will hereinafter be described in conjunction with the appended drawings, wherein like numerals denote like elements.

FIG. 1CC is a perspective view of the punch body, the punch tip, and ancillary components as shown in FIG. 1C, with extension rod attached to the punch body, according to certain embodiments of the invention.

FIG. 1KK is a cross-sectional view of the punch body and certain of the ancillary components of FIG. 1K along the lines 1KK-1KK, according to certain embodiments of the invention.

FIG. 1LL is a cross-sectional view of the punch body and certain of the ancillary components of FIG. 1L along the lines 1LL-1LL, according to certain embodiments of the invention.

FIG. 1MM is a cross-sectional view of the punch body and certain of the ancillary components of FIG. 1M along the lines 1MM-1MM, according to certain embodiments of the invention.

DETAILED DESCRIPTION

The following detailed description is exemplary in nature and is not intended to limit the scope, applicability, or configuration of the invention in any way. Rather, the following description provides practical illustrations for implementing exemplary embodiments of the present invention. Examples of constructions, materials and dimensions are provided for selected elements, and all other elements employ that which is known to those of skill in the field of the invention. Those skilled in the art will recognize that many of the examples provided have suitable alternatives that can be utilized.

Figure 1A:
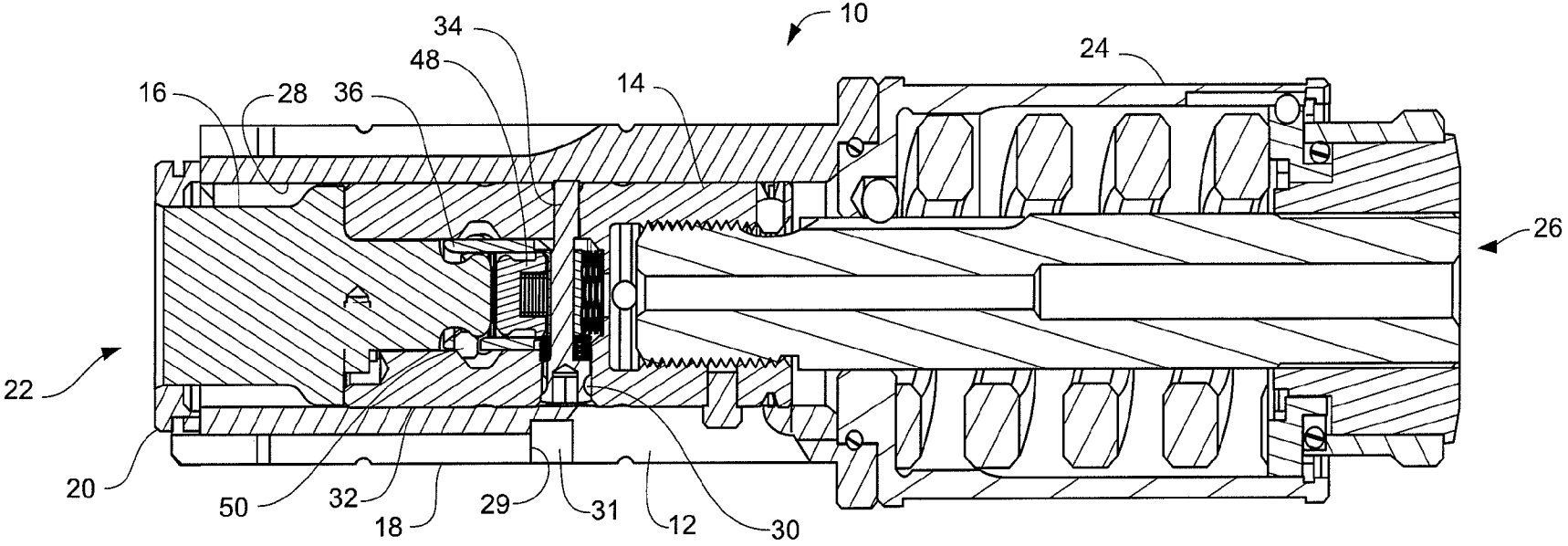
FIG. 1A is a side cross-sectional view of a punch assembly, according to certain embodiments of the invention.

FIG. 1A shows a side cross-sectional view of a punch assembly 10, according to certain embodiments of the invention. As is generally the case for punch assemblies, the illustrated punch assembly 10 includes a punch guide 12, a punch body 14, and a punch tip 16. As shown, the punch guide 12 includes a sidewall 18, with a stripper plate 20 coupled to a first end 22 of the sidewall 18 and a spring pack (or driver) assembly 24 coupled to a second, opposing end 26 of the sidewall 18. Various designs of stripper plates and spring pack assemblies are well known in the art. The skilled artisan will appreciate that the punch assembly embodiments described herein could be configured for use with these or other known stripper plate and spring pack assembly designs. More significant, following review of this application, the skilled artisan will appreciate that, similar to the general adaptability of stripper plates, the punch tip embodied herein is designed to have a wide scope of adaptability with differing punch assembly designs.

Referring back to the punch assembly 10 of FIG. 1A, in certain embodiments, the punch guide 12 is tube shaped. The invention should not be limited to such however, as the punch guide 12 can just as well take on other shapes, e.g., multisided shapes with discrete sides. As shown, the sidewall 18 of the punch guide 12 forms a central cavity 28 for inserting the punch body 14 therein. Like the punch guide 12, in certain embodiments, the punch body 14 is tube shaped in order to enable the body 14 to slide within the punch guide central cavity 28. As shown, a sidewall 32 of the punch body 14 defines an aperture 30 passing there through, which is sized to accept a cam 34 therein. In certain embodiments, the aperture 30 is defined to be generally perpendicular to the longitudinal extent of the punch body 14. As such, the cam 34, when accommodated by the aperture 30, has a longitudinal extent that is generally perpendicular to that of the punch body 14.

Figure 1B:
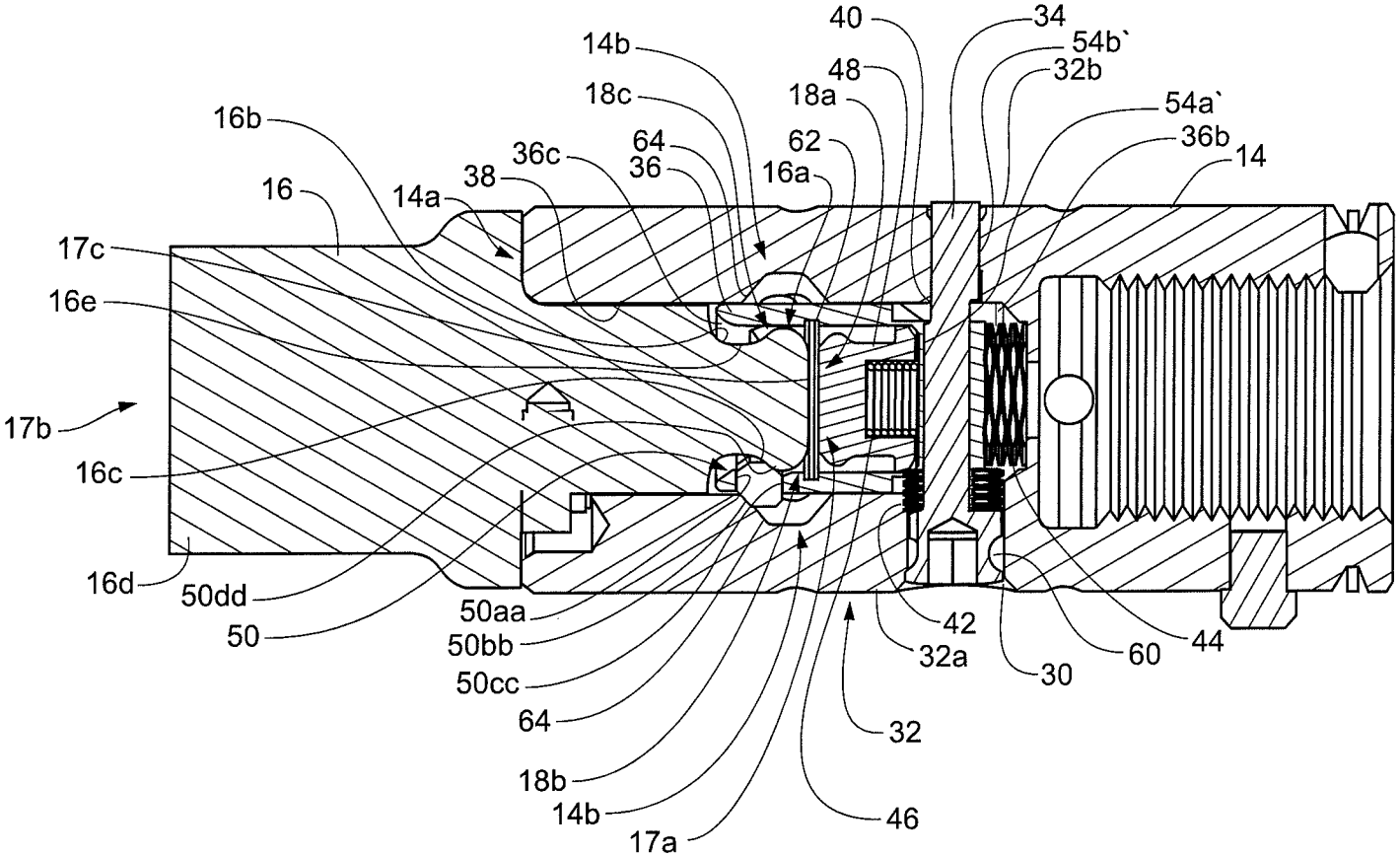
FIG. 1B is an enlarged side cross-sectional view of punch body, punch tip, and ancillary components of the punch assembly of FIG. 1A, according to certain embodiments of the invention.

FIG. 1B illustrates an enlarged view of the punch body 14 and punch tip 16 shown in FIG. 1A. Regarding assembly of the punch tip 16 with the punch body 14, one component used to trigger either securement or release of the tip 16 with respect to the body 14 is the cam 34. As shown, in certain embodiments, the aperture 30 of the punch body 14 passes from one side 32*a* of the punch body sidewall 32 to the opposing side 32*b* of the sidewall 32. In certain embodiments, the cam 34 is a rod-like body, and is sized to extend from the one sidewall side 32*a* to the opposing sidewall side 32*b*, resulting in uniform rigidity over the longitudinal extent of the cam 34 when accommodated by the aperture 30. Such rigidity is important when using the cam 34 in securing/releasing the punch tip 16 with respect to the punch body 14. For example, at differing times during the cam's adjustment, forces are applied to the cam 34 (generally perpendicular to the cam's longitudinal extent) in opposing directions.

While the punch body aperture 30 is shown as passing through both opposing sides 32*a* and 32*b* of the punch body sidewall 32, the aperture 30 can alternately be configured to pass through the one side 32*a* yet terminate short of passing through the other side 32*b*. As such, while not being shown, the aperture 30 can be defined to form a pocket within the side 32*b* of the punch body sidewall 32 in order to retain the leading end 34*b* of the cam 34 yet to prevent such end 34*b* from protruding through the side 32*b*. Regardless of whether the punch body aperture 30 passes through both of the opposing sides 32*a* and 32*b* of the punch body sidewall 32, access can be made with regard to the cam 34 at its insertion point in the sidewall 32. Such access permits the cam 34 to be selectively adjusted in the aperture 30. In certain embodiments, as further detailed below, such adjustment involves rotating the cam 34 in the aperture 30. As later detailed below, the cam 34 is uniquely shaped, which enables (e.g., via its rotation within the punch body aperture 30) a triggering of other ancillary components within the punch body 14 to alternately secure or release the punch tip 16, as is desired.

Figure 1C:
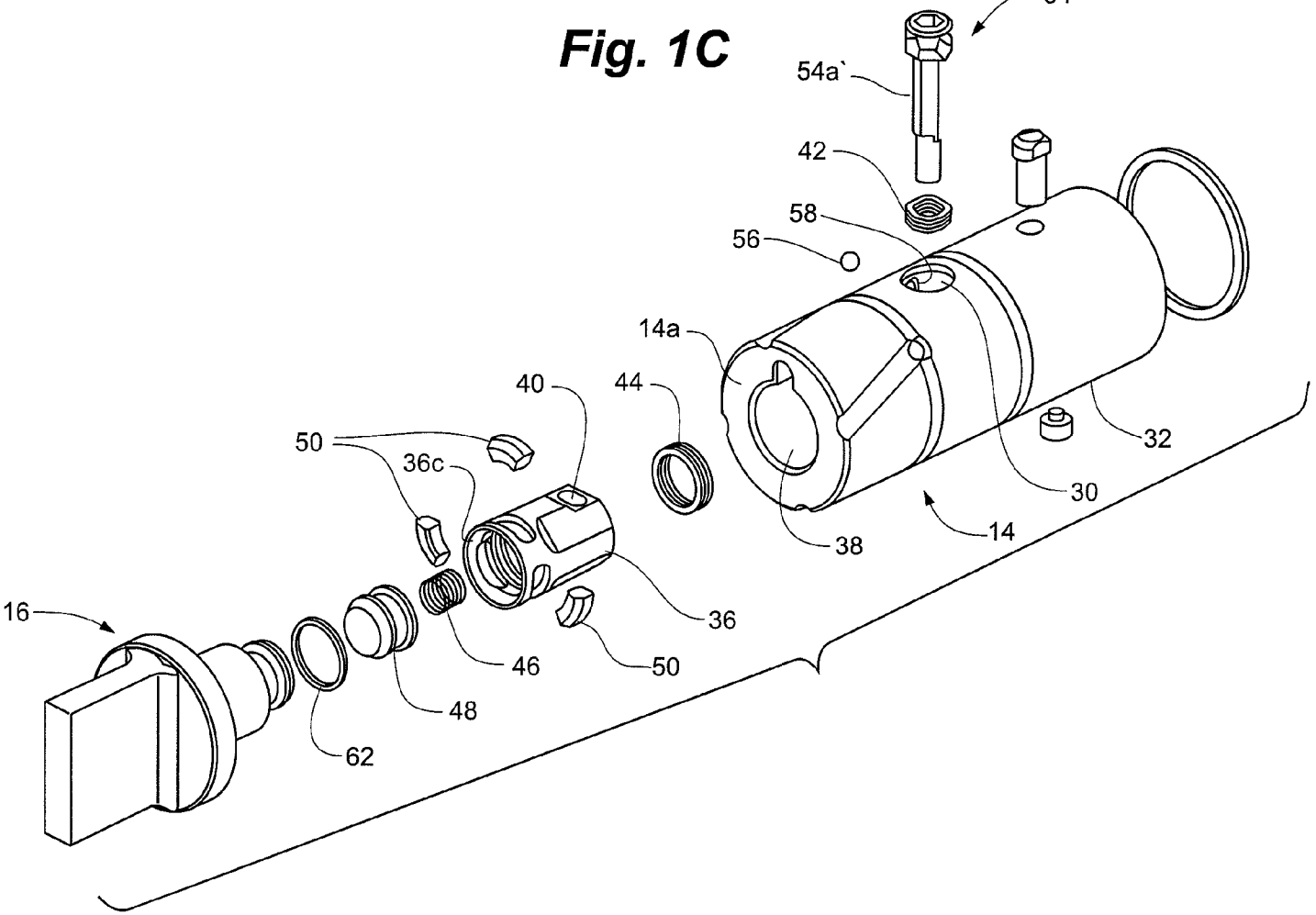
FIG. 1C is a perspective view of the punch body, the punch tip, and the ancillary components of FIG. 1B, shown in exploded assembly view, according to certain embodiments of the invention.
Figure 1C:
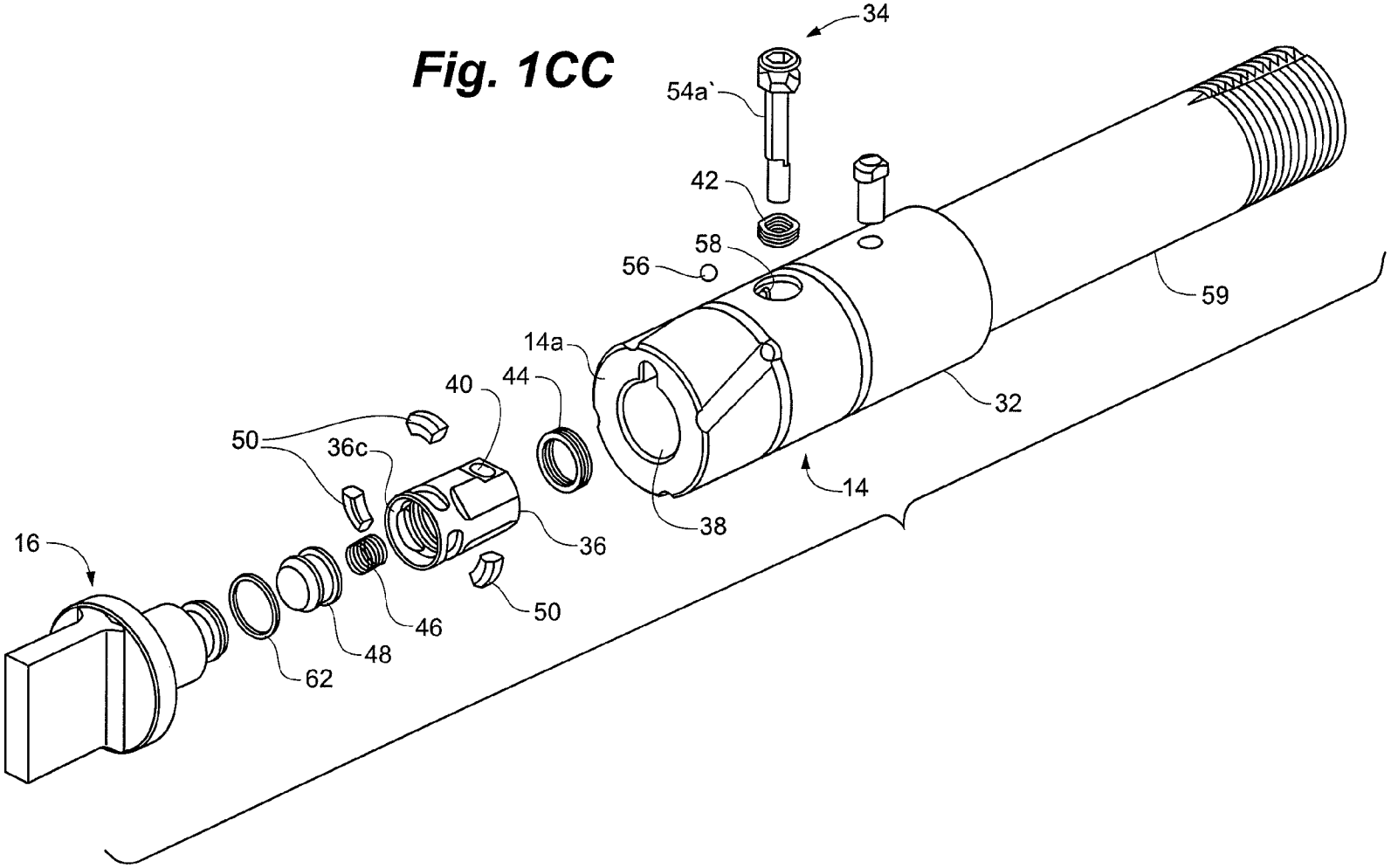
Figure 1D:
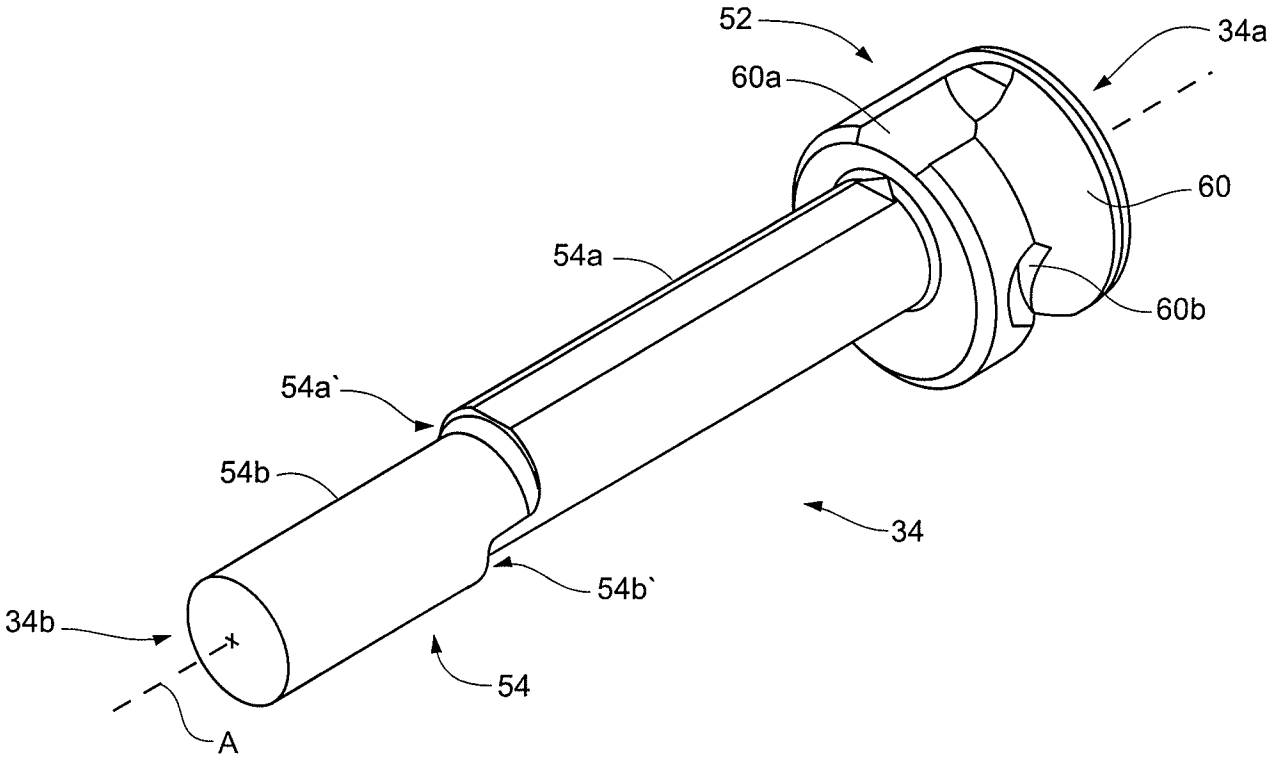
FIGS. 1D and 1E are differing perspective views of cam used with the punch body shown in FIGS. 1A-1C, according to certain embodiments of the invention.
Figure 1E:
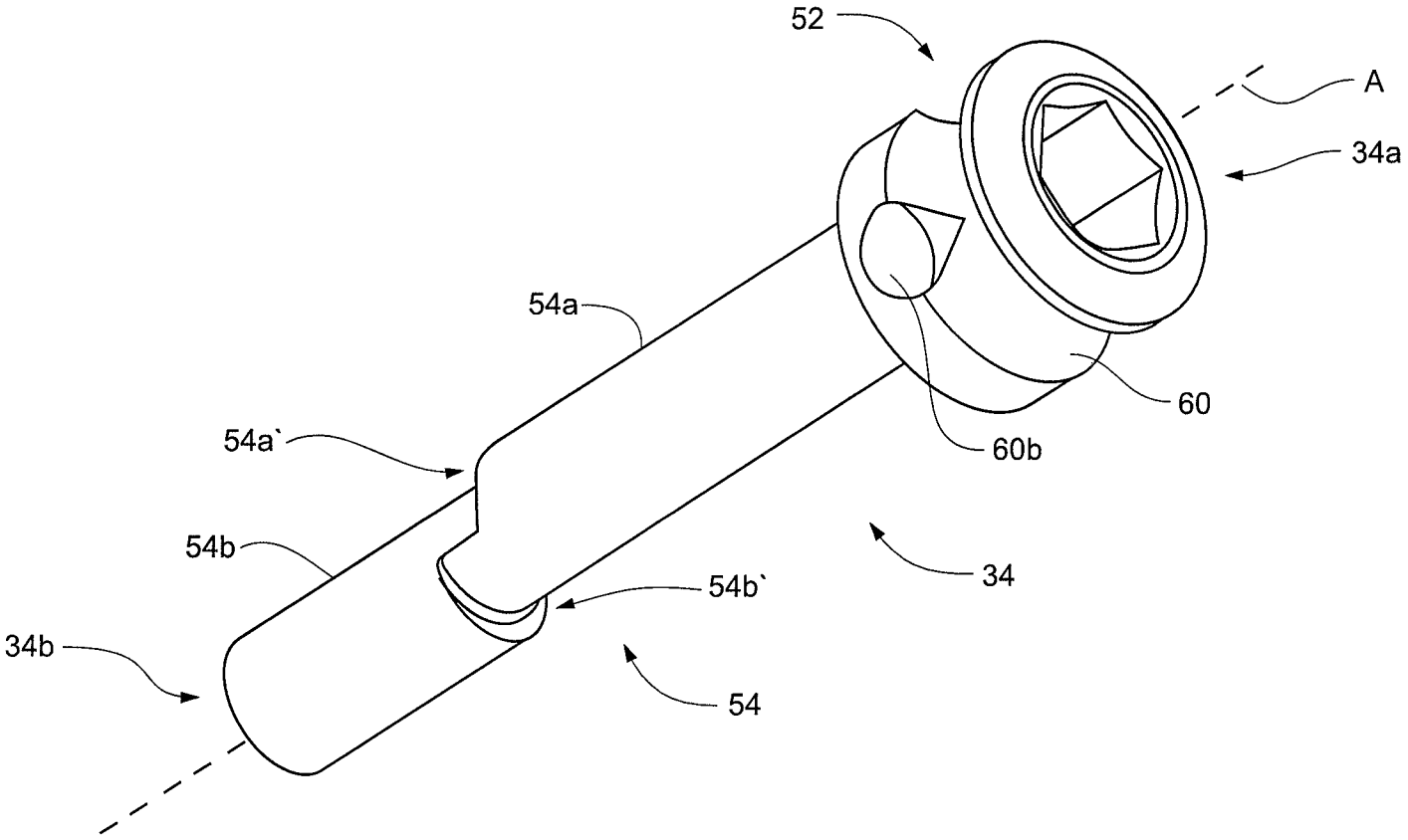
Figure 1F:
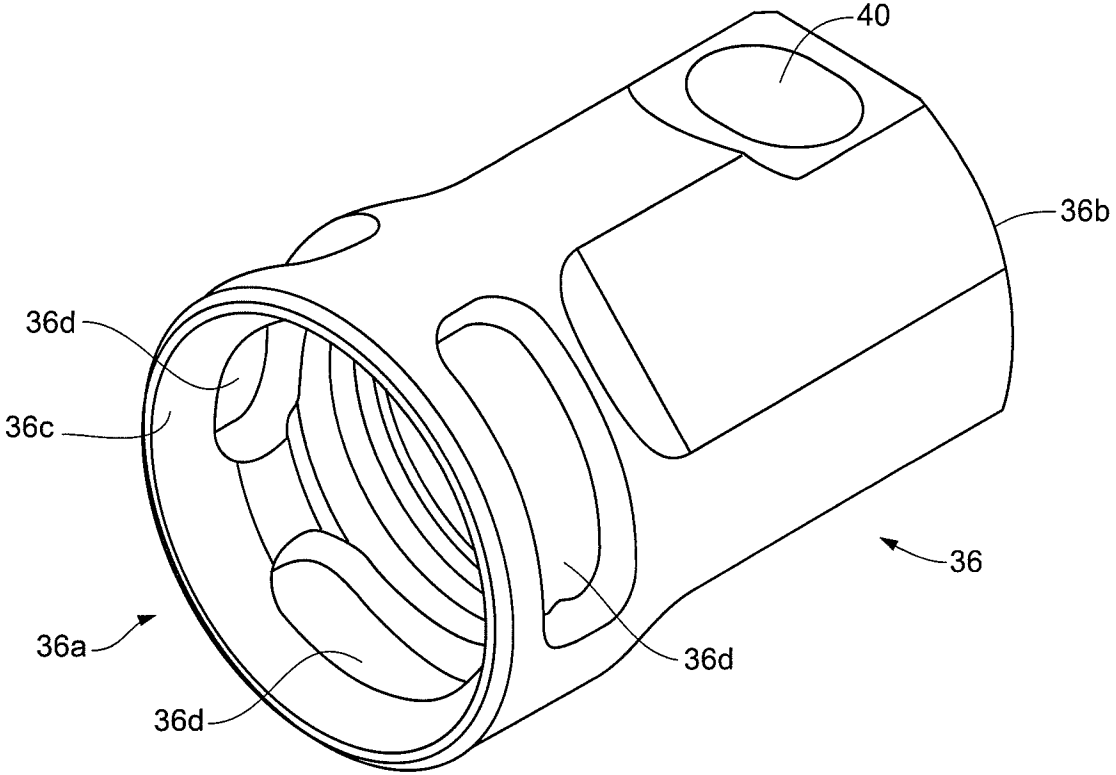
FIGS. 1F and 1G are differing perspective views of carrier body used with the punch body shown in FIGS. 1A-1C, according to certain embodiments of the invention.
Figure 1G:
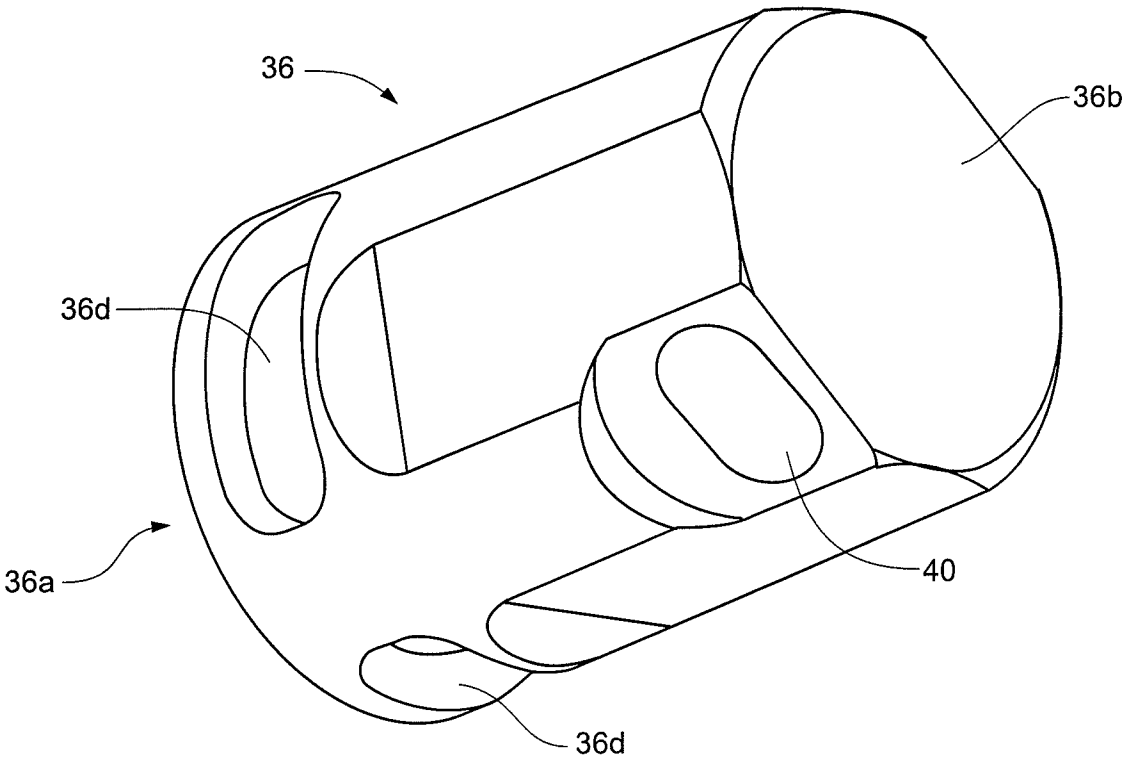

In addition to the cam 34, a further of the ancillary components is a carrier body 36, as embodied in FIGS. 1F and 1G. With reference to FIG. 1B, the carrier body 36 is inserted in a central cavity 38 of the punch body 14 and is defined with a bore 40 configured to align with the punch body aperture 30. As such, when inserted in the punch body aperture 30, the cam 34 is adapted to further pass through the carrier body bore 40. As later described, this coupling of the carrier body 36 with the cam 34 enables movement of the body 36 via rotation of the cam 34. As later detailed, other ancillary components enabling the punch tip 16 to be alternately secured or released from the punch body 14 can include a plurality of springs 42, 44, and 46, a pusher-retainer 48, and a plurality of wedge members 50.

FIG. 1C shows a perspective view of the punch body 14 and the punch tip 16, both in exploded assembly view, in accordance with certain embodiments of the invention. Also shown are the ancillary components alluded to above and exemplarily used in alternately securing or releasing the punch tip 16 with respect to the punch body 14. With reference to the punch body 14, the cam 34 is shown prior to being inserted in the punch body aperture 30, and, as described above, serves as a triggering mechanism for the punch tip 16 being alternately secured or released. FIG. 1CC is a perspective view of the punch body 14 and the punch tip 16 as shown in FIG. 1C, with extension rod 59 being further shown, according to certain embodiments of the invention. Use of the rod 59, as should be appreciated, represents one exemplary means by which the punch body 14 can be configured to couple with a spring pack for the punch assembly (e.g., extending through the spring pack and threaded to a rear end thereof).

FIGS. 1D and 1E show enlarged perspective views of the cam 34, according to certain embodiments of the invention. The cam 34 includes a head portion 52 and a stem portion 54. In certain embodiments, as shown in FIG. 1E, the head portion 52 is configured for rotation with an alien wrench (as shown), torx wrench, or the like. In certain embodiments, insertion and subsequent rotation of the cam 34 within the punch body aperture 30 is performed while the punch body 14 is apart from the punch guide 12. However, in other designs, the punch guide 12 is configured with an opening in the sidewall 18 therein to permit rotation of the cam 34 while the punch body 14 is assembled to the punch guide 12. For example, referring back to FIG. 1A, such punch guide opening could be configured similar to keywells in the punch guide sidewall 18 (such as keywell 29, shown as accommodating a plug 31 to prevent pressure leakage from the punch guide 12). Accordingly, as the punch body 14 is inserted in the central cavity 28 of the punch guide 12, the punch body aperture 30 can be aligned with such punch guide opening. By configuring the cam head portion 52 to be rotated via such allen or torx wrench, an end of such wrench is narrow enough to be easily slid through such punch guide opening as well as the punch body aperture 30 in order to rotate the cam 34.

Linkage between the cam 34 (once inserted in the punch body aperture 30) and the punch body 14 is provided via use of a member disposed there between, which serves as a linking member for holding the cam 34 to the body 14. In certain embodiments, as shown in FIG. 1C, the member can be a ball 56 that is carried in a depression 58 of the punch body 14. The depression 58 is defined to open up to the punch body aperture 30. Thus, once placed in the depression 58, the ball 56 is sized to partially extend into the aperture 30. The cam 34, in certain embodiments as shown in FIG. 1D, includes a channel 60 extending about an outer side of the cam's head portion 52, with the channel 60 sized to accommodate the portion of the ball 56 that extends into the punch body aperture 30. In certain embodiments, the channel 60 includes an inlet 60*a* that serves as an entry point for the ball 56 as the cam 34 is inserted in the punch body aperture 30. Once the ball 56 enters the channel 60 and the cam 34 is subsequently rotated, the channel 60 rotates about the ball 56, thereby retaining the cam 34 within the punch body aperture 30.

In certain embodiments, as further shown in FIGS. 1D and 1E, the channel 60 includes one or more pockets 60*b* extending away from the channel 60 and toward (e.g., in a direction generally parallel to) the stem portion 54 of the cam 34. In certain embodiments, the channel 60 includes at least two such pockets 60*b*. The pockets 60*b*, serving as holding points for the ball 56 as the channel 60 is rotated thereabout, are used as locking positions for the cam 34 as it is rotated in the punch body aperture 30. As further detailed herein, such locking positions serve as positions at which the punch tip 16 can be alternately secured with the punch body 14 or released from the punch body 14.

In connection with the pockets 60*b* described above, and referring back to FIGS. 1A-1C, a spring 42 is positioned in the punch body aperture 30 and suspended therein via contact with the carrier body 36. As such, when the cam 34 is inserted in the aperture 30, its stem portion 54 passes through the spring 42, while the head portion 52 contacts the spring 42. Thus, when the cam 34 is operatively coupled to the punch body 14 (via the ball 56 being suspended within the channel 60) and the cam 34 is rotated to a position such that the ball 56 is atop one of the pockets 60*b*, the force of the spring 42 on the cam head portion 52 results in a seating of the ball 56 into said pocket 60*b*, thereby locking the cam 34 at such position. To subsequently move the cam 34 from such position, an inward force is applied against the cam head portion 52 (e.g., via an allen wretch) to compress the spring 42. As a result of such inward force, the ball 56 is unseated from the pocket 60*b* and is directed back into the channel 60 to enable rotation of the cam 34 to a further position. The positioning of the cam 34, for securing and releasing the punch tip 16 with the punch body 14, is detailed later.

As further shown in FIGS. 1D and 1E, the stem portion 54 of the cam 34 has separate first and second segments 54*a* and 54*b*. As shown, the segments 54*a* and 54*b* are configured to be out of alignment. In certain embodiments, the first segment 54*a* has a portion 54*a*' that protrudes in a direction generally perpendicular to the longitudinal axis A of the cam 34, while the second segment 54*b* has a portion 54*b*' that protrudes in a generally opposite direction. The protruding portion 54*a*' of segment 54*a* is particularly significant in the functioning of the cam 34 as a triggering mechanism, particularly via the carrier body 36. As alluded to above, enlarged perspective views of the carrier body 36 are shown in FIGS. 1F and 1G, according to certain embodiments of the invention. Such carrier body 36 is configured to function with ancillary components, e.g., one or more of the springs 44 and 46, the pusher-retainer 48, and the wedge members 50.

With reference to FIGS. 1B and 1C, the spring 44 is inserted in the central cavity 38 of the punch body 14 followed by insertion of the carrier body 36 in the cavity 38. As a consequence, the spring 44 provides a force on the carrier body 36 in an outward direction with respect to the punch body 14 (i.e., toward a front end 14*a* of the body 14). However, as described above, subsequent insertion of the cam 34 through the punch body aperture 30 and carrier body bore 40 retains the carrier body 36 from being forced out of the punch body 14 by the spring 44. Thus, the carrier body 36 is resiliently biased toward the front end 14*a* of the punch body 14, yet movement of the body 36 is dictated via rotation of the cam 34. In particular, as the cam 34 is rotated in the punch body aperture 30 such that protruding portion 54*a*' (of segment 54*a*) is oriented toward a front end 36*a* of the carrier body 36, the body 36 is correspondingly urged toward the front end 14*a* of the punch body 14 and to a raised (i.e., shallower) position in the punch body central cavity 38. Such positioning of the carrier body 36 is perhaps best demonstrated in FIG. 1B. Conversely, as the cam 34 is rotated in the punch body aperture 30 such that the protruding portion 54*a*' is oriented toward a rear end 36*b* of the carrier body 36, the body 36 is moved away from the front end 14*a* of the punch body 14 and to a lowered (i.e., deeper) position in the punch body central cavity 38. Such positioning of the carrier body 36 is perhaps best demonstrated in FIG. 1L. As further detailed below, such alternating movement (or positioning) of the carrier body 36 is a further trigger for alternately securing or releasing the punch tip 16 with respect to the punch body 14.

Figure 1H:
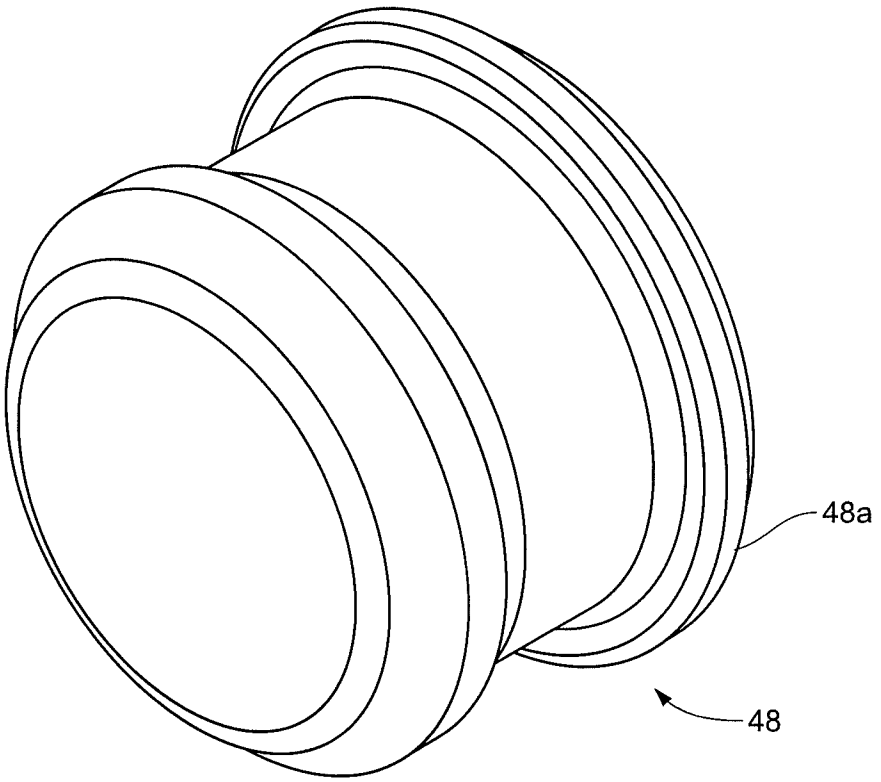
FIG. 1H is a perspective view of pusher-retainer used with the punch body shown in FIGS. 1A-1C, according to certain embodiments of the invention.

With continued reference to FIGS. 1B and 1C, the spring 46 is inserted into a central cavity 36*c* of the carrier body 36 followed by insertion into the cavity 36*c* of the pusher-retainer 48 (an enlarged perspective view of which is exemplarily shown in FIG. 1H). As a consequence, the spring 46 resiliently biases the pusher-retainer 48 in an outward direction with respect to the carrier body 36 (i.e., toward the front end 36*a* of the body 36). As further detailed below, the pusher-retainer 48 serves two purposes, to aid in ejecting the punch tip 16 from the punch body 14, and to create a condition that aids the punch tip 16 to be inserted to an engaging position with the punch body 14. In certain embodiments, an insert ring 62 is further inserted and secured (e.g., within a circular channel) within the central cavity 36*c* of the carrier body 36. Such ring 62, once secured within the carrier body cavity 36*c* prevents the pusher-retainer 48 from being forced too far from the rear end 36*b* of the carrier body 36 via action of the spring 46. In particular, an outer edge 48*a* of the pusher-retainer 48, when contacting the insert ring 62, prevents further outward movement of the pusher-retainer 48 within the central cavity 36*c* of the carrier body 36. However, the invention should not be limited to use of such insert ring 62. For example, in certain embodiments, a lip or other protruding portion may be coupled to or machined within the carrier body cavity 36*c*, thereby providing a substitute for the insert ring 62 while serving the same function. To that end, the surface area of such lip can be limited so that it only extends from two inner sides of the cavity 36*c*, while serving the same function. Aside from the insert ring 62 (or lip or protruding portion(s) of the carrier body central cavity 36*c*, movement of the pusher-retainer 48 is further dictated via movement of the carrier body 36 and corresponding movement of the wedge members 50, as further detailed below.

In summary, the cam 34 is configured for adjustment (e.g., rotation) once positioned within the aperture 30 of the punch body 14 and the bore 40 of the carrier body 36. In certain embodiments, the cam's allowable range of rotation is dictated by the longitudinal extent of channel 60 defined in cam's head portion 52, as the ball 56 seated therein prevents the cam's further rotation. The channel 60, in certain embodiments, is formed with one or more pockets 60*b* each serving as a rotatable locking position for the cam 34. In certain embodiments, the locking positions include a first position enabling the punch tip 16 to be secured to the punch body 14 (whereby the protruding portion 54*a*' is oriented toward the front end 36*a* of the carrier body 36) and a second position enabling the punch tip 16 to be released from (or inserted within) the punch body 14 (whereby the protruding portion 54*a*' is oriented toward the rear end 36*b* of the carrier body 36).

Figure 1I:
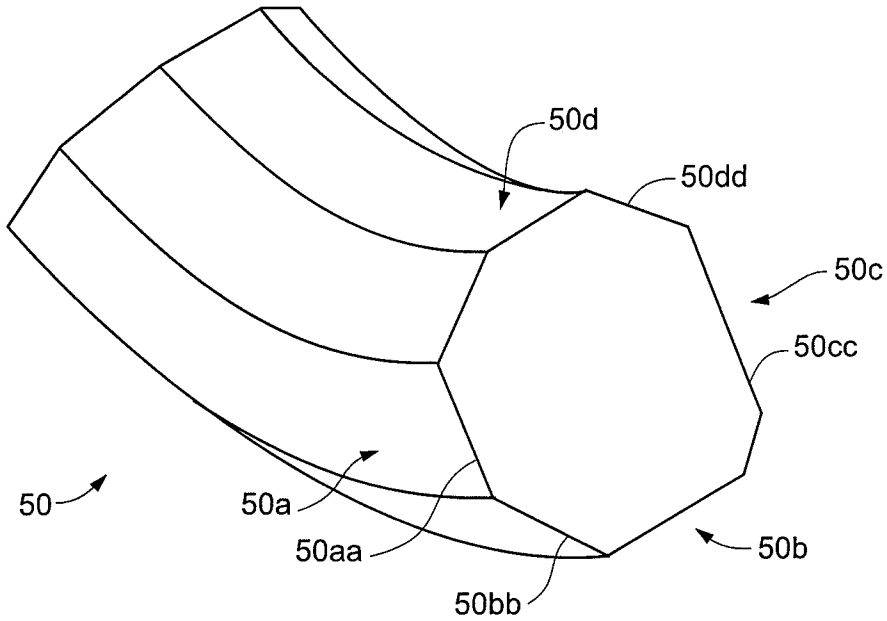
FIGS. 1I and 1J are perspective and side views of an exemplary wedge member used with the punch body shown in FIGS. 1A-1C, according to certain embodiments of the invention.
Figure 1J:
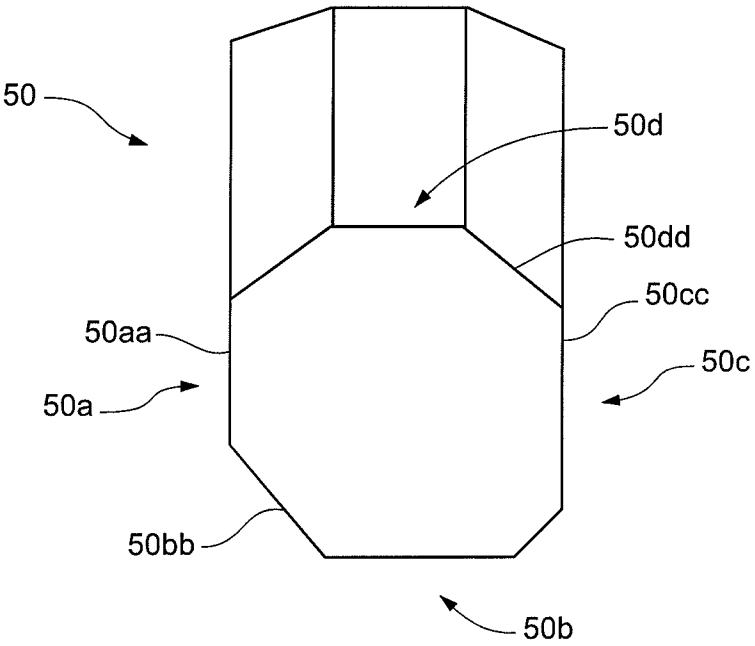

As alluded to above, while opposing movements of the carrier body 36 are alternately triggered by the cam's rotation, such movements can be thought of as further triggers for alternatively securing or releasing the punch tip 16 with respect to the punch body 14. In certain embodiments, this further triggering involves the wedge members 50. FIGS. 1I and 1J show enlarged views of one exemplary wedge member 50. In certain embodiments, and with reference to FIGS. 1B and 1C, a plurality of the wedge members 50 is utilized with the carrier body 36, with slots 36*d* in the body 36 to correspondingly accommodate the members 50. While three wedge members 50 are exemplified, the invention should not be limited to such. Instead, in certain embodiments, any quantity of two or more wedge members 50 can be used, with each correspondingly positioned within one of the slots 36*d* of the carrier body 36. In certain embodiments, as shown, the slots 36*d* are at the front end 36*a* of the carrier body 36, and defined generally equidistant about the circumference of the body's outer surface. FIGS. 1B, 1K, 1L, and 1M illustrate cross-sectional views of the punch body 14, showing differing rotated positions of the cam 36 and corresponding effects on the carrier body 36 and the wedge members 50, according to certain embodiments of the invention. As further detailed below, with movement of the carrier body 36 (via rotation of the cam 34), the wedge members 50 are moved in corresponding fashion with respect to the carrier body slots 36*d* and grooves 14*b* of the punch body 14 (lying external to the slots 36*d*).

Figure 1K:
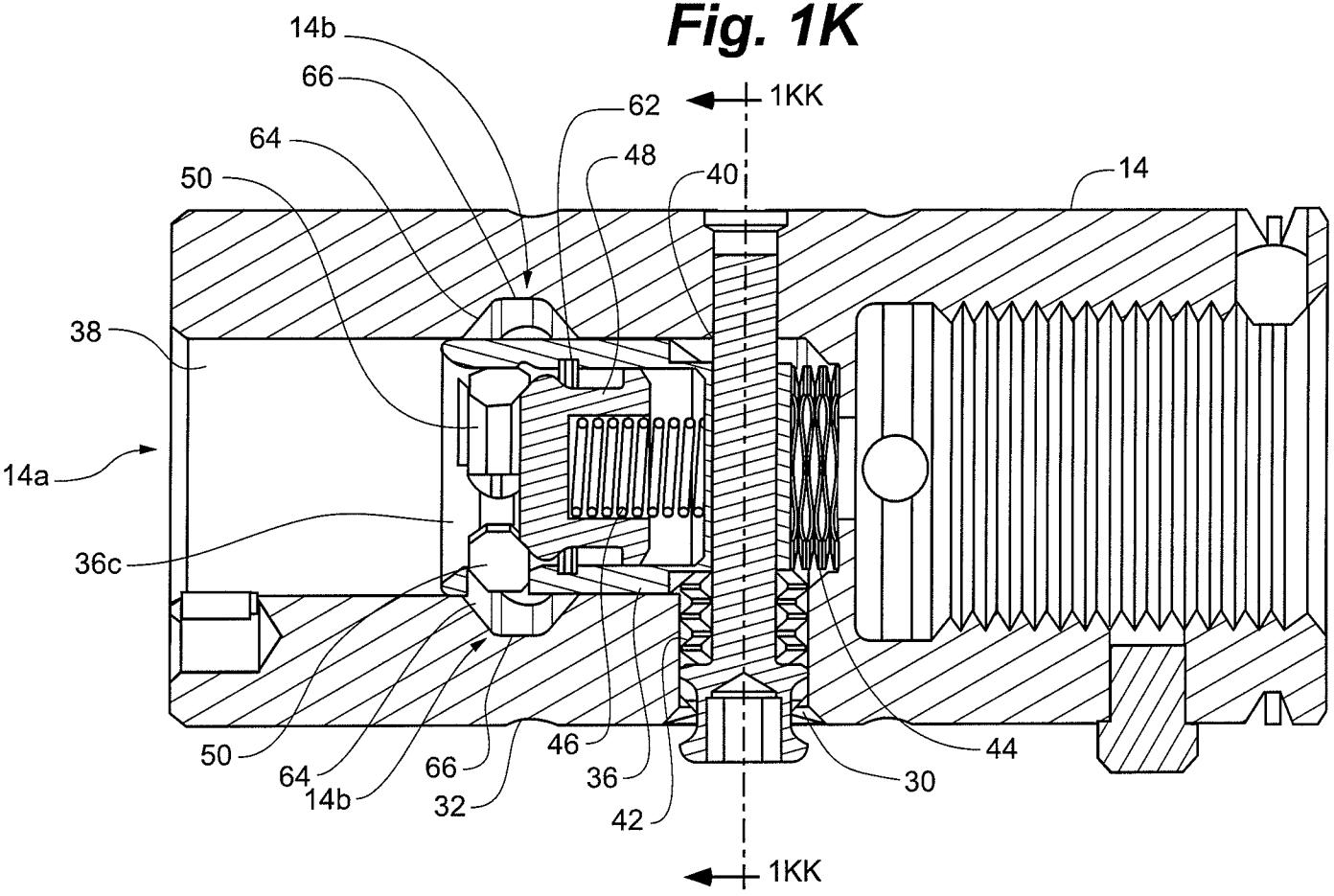
FIG. 1K is a side cross-sectional view of the punch body and the ancillary components as shown in FIG. 1B with the cam of FIGS. 1D and 1E being inserted in the punch body, according to certain embodiments of the invention.
Figure 1K:
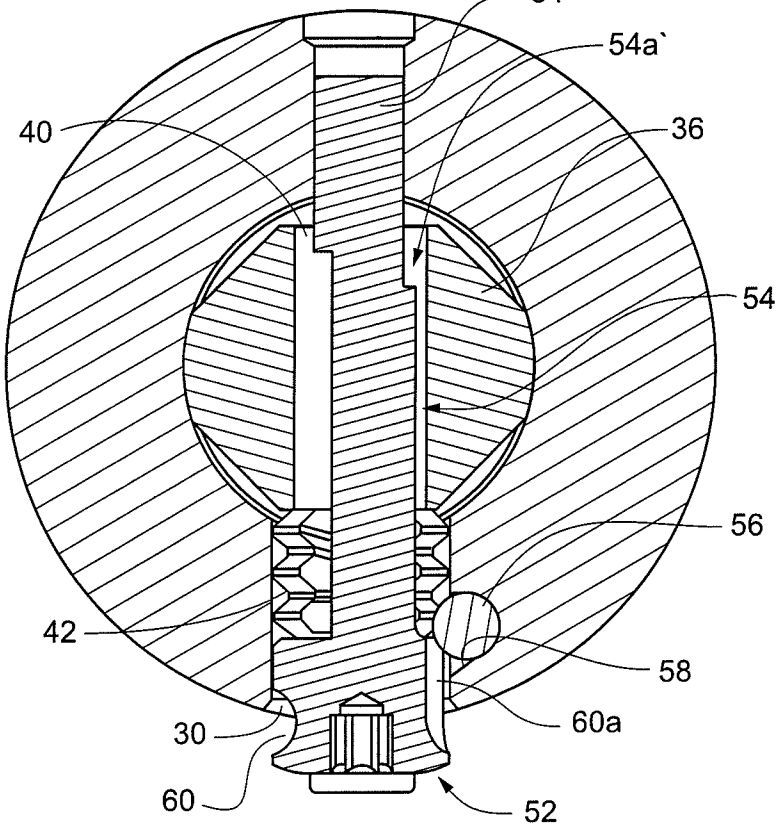

For example, starting with FIG. 1K, the punch body 14 is shown without the punch tip 16, with the cam 34 being partially inserted in the aperture 30 of the punch body 14 and bore 40 of the carrier body 36. As described above, in certain embodiments, the punch body 14 is configured to be operatively coupled with the cam 34 via a ball-channel linkage. As shown, no such linkage is yet applicable because the head portion 52 of the cam 34 is not yet fully inserted within the punch body aperture 30 (as illustrated in corresponding cross-section of FIG. 1KK). Also, neither of the cam's protruding portions 54*a*', 54*b*' are visible. To that end, in certain embodiments, the carrier body bore 40 is defined so as to only allow insertion of the cam 34 therein when the cam's protruding portions 54*a*', 54*b*' are generally oriented perpendicular with respect to the punch body front end 14*a*. Consequently, there is no force from the cam 34 (via the protruding portion 54*a*') being directed toward the carrier body 36, and little corresponding force from the carrier body 36 on the wedge members 50. As such, the wedge members 50, while accommodated by the carrier body slots 36*d*, are free to slide into the central cavity 36*c* of the carrier body 36 (as shown).

Figure 1L:
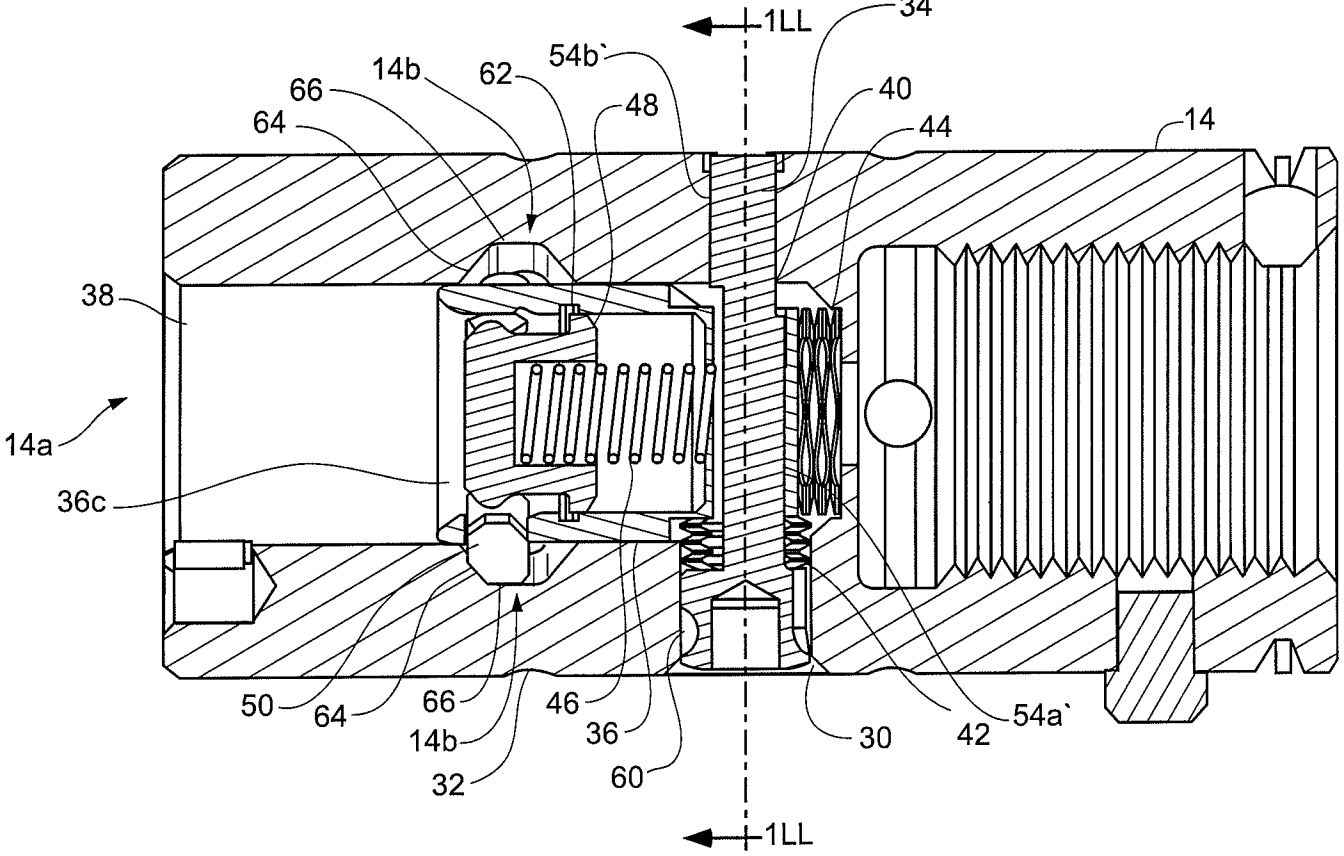
FIG. 1L is a side cross-sectional view of the punch body and the ancillary components as shown in FIG. 1B with the cam of FIGS. 1D and 1E inserted in, and rotated relative to, the punch body, according to certain embodiments of the invention.
Figure 1L:
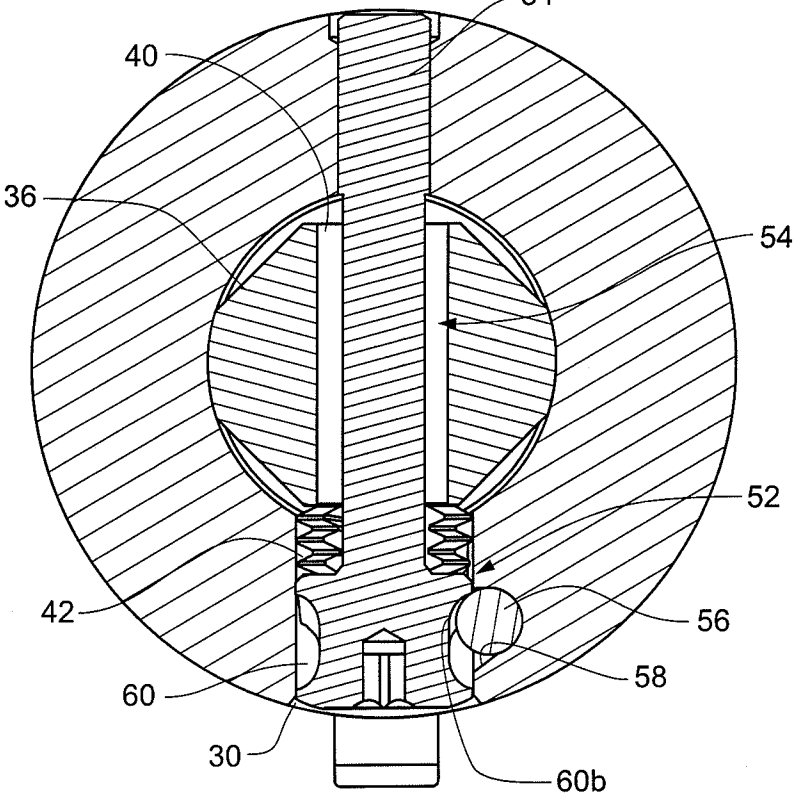

Regarding FIG. 1L, the punch body 14 is again shown without the punch tip 16; however, the cam 34 is shown as being fully inserted in the punch body aperture 30 and carrier body bore 40. As such, in embodiments employing the above-described ball-channel linkage of the punch body 14 and cam 34, the ball 56 (not visible as it is positioned rearward of the cam head portion 52, yet illustrated in corresponding cross-section of FIG. 1LL) is not only located in the channel 60, but also in one of the pockets 60*b* for locking the cam 34 in position. As shown, the spring 42 is biasing the head portion 52 of the cam 34 so as to keep the ball in such pocket 60*b* and the cam 34 at such rotated position. In particular, the illustrated position is for releasing (or inserting) the punch tip 16 with respect to the punch body 14. At such position, the protruding portion 54*a*' of segment 54*a* is oriented toward the rear end 36*b* of the carrier body 36, which in turn forces the body 36 inward of (i.e., deeper or lowered within) the punch body central cavity 38. Such inward urging of the carrier body 36 in turn allows the wedge members 50 to be pulled inward (of the punch body cavity 38) via their accommodation by the carrier body slots 36*d*. In particular, the wedge members 50 are pulled adjacent to the grooves 14*b* of the punch body 14. Such inward pull of the wedge members 50 along with outward force of the pusher-retainer 48 (via its spring 46) results in the pusher-retainer 48 contacting and forcing the members 50 to protrude from the carrier body slots 36*d* and into the grooves 14*b*.

Figure 1M:
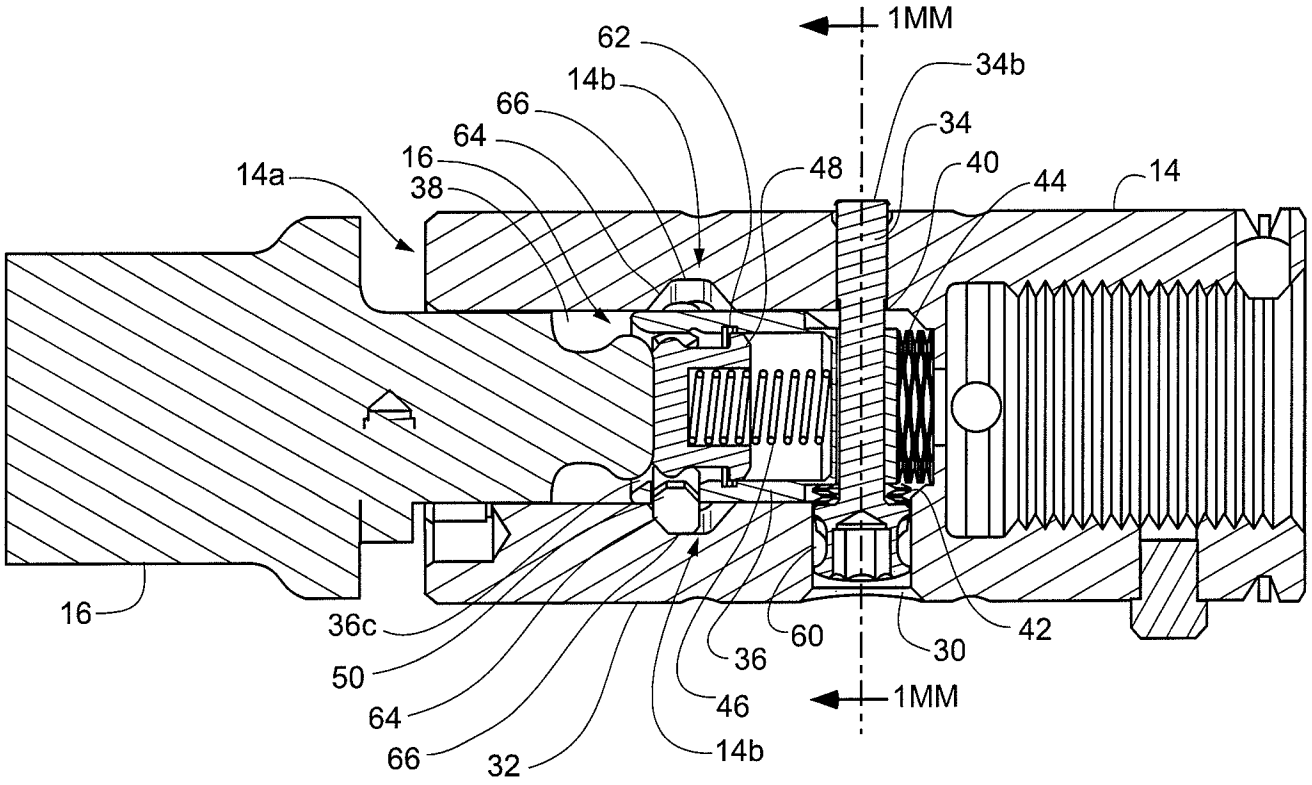
FIG. 1M is a side cross-sectional view of the punch body, the punch tip, and the ancillary components as shown in FIG. 1B with the cam of FIGS. 1D and 1E inserted in, and further rotated relative to, the punch body, according to certain embodiments of the invention.
Figure 1M:
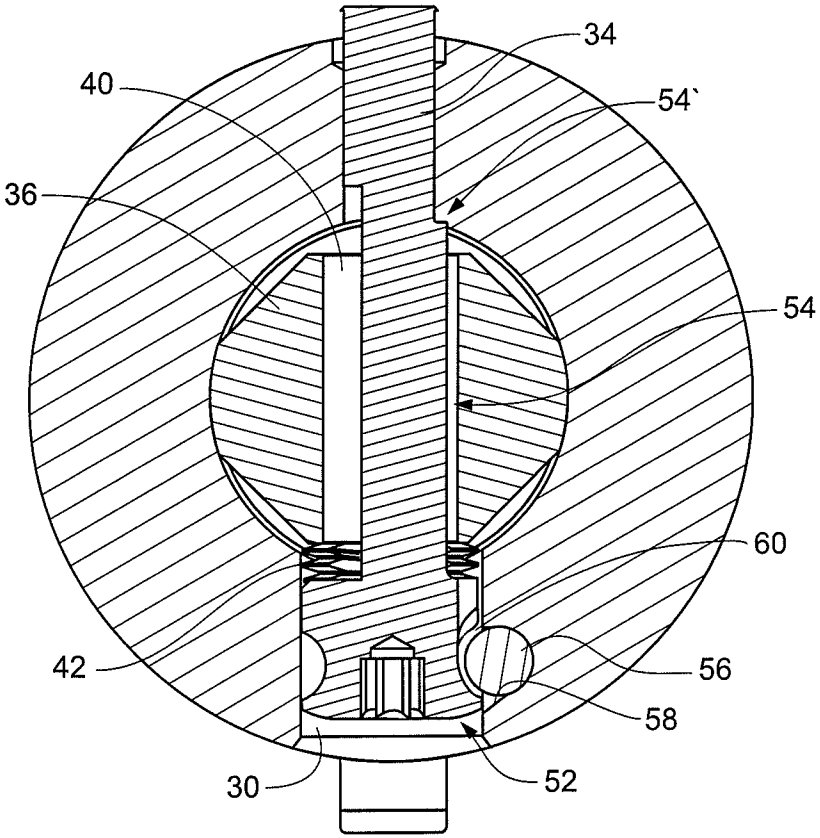

Looking to FIG. 1M, the punch tip 16 is shown as being partially inserted in the central cavity 38 of the punch body 14. Similar to what is shown in FIG. 1L, the cam 34 is fully inserted in the punch body aperture 30 and carrier body bore 40; however, its leading end 34*b* is shown extending outside the punch body aperture 30. Thus, in embodiments employing the above-described ball-channel linkage of the punch body 14 and cam 34, the ball 56 (again not visible as it is positioned rearward of the cam head portion 52, yet illustrated in corresponding cross-section of FIG. 1MM) is located in the channel 60 and not in one of the pockets 60*b* for locking the cam 34 in position. As shown, neither of the cam's protruding portions 54*a*', 54*b*' are visible. In particular, the portions 54*a*', 54*b*' again are generally oriented perpendicular with respect to the punch body front end 14*a*, yet oriented 180 degrees from their positions described above with respect to FIG. 1K. Consequently, in reference back to FIG. 1L, the inward force applied to the carrier body 36 is removed, resulting in the carrier body 36 being urged outward (i.e., toward the front end 14*a* of the punch body 14) via action of the spring 44. Such outward urging of the carrier body 36 in turn forces the wedge members 50 to be pulled outward via their accommodation by the carrier body slots 36*d*. In particular, the wedge members 50 contact the frontal side surfaces 64 of the grooves 14*b* of the punch body 14. Such outward pull of the wedge members 50 (via the carrier body 36) in combination with the slope of the frontal side surfaces 64 of the grooves 14*b* results in the wedge members 50 sliding along such surfaces 64, back through the carrier body slots 36*d* so as to protrude into the central cavity 36*c* of the carrier body 36. As shown, contact with the pusher-retainer 48 prevents the wedge members 50 form protruding too far into the central cavity 36*c*.

Finally, with reference to FIG. 1B, the punch body 14 is shown with the punch tip 16 secured thereto. Employing the above-described ball-channel linkage of the punch body 14 and cam 34, and similar to that described with FIGS. 1L and 1LL, the ball 56 is located in another of the pockets 60*b* for locking the cam 34 in position, with the spring 42 biasing the head portion 52 of the cam 34 so as to keep the ball 56 in such pocket 60*b* and the cam 34 is such rotated position. In particular, the illustrated position is for securing the punch tip 16 with respect to the punch body 14. At such position, the protruding portion 54*a*' of segment 54*a* is oriented toward the front end 36*a* of the carrier body 36, which in turn forces the body 36 outward of (i.e., shallower or raised within) the punch body central cavity 38. Continuing from that described above for FIG. 1M, such outward pulling of the carrier body 36 in turn forces the wedge members 50 to be pulled further out (of the punch body central cavity 38) via their accommodation by the carrier body slots 36*d*. Such further outward pull of the wedge members 50 (via the carrier body 36) in combination with the slope of the frontal side surfaces 64 of the grooves 14*b* results in the wedge members 50 continuing to slide along such surfaces 64 and into the central cavity 38 of the punch body 14. Such sliding action results in the wedge members 50 further protruding from the carrier body slots 36*d* and into the central cavity 36*c* of the carrier body 36.

As should be appreciated, in inserting the punch tip 16 in the punch body central cavity 38, and further into the carrier body central cavity 36*c*, a coupling hub 16*a* of the punch tip 16 contacts and forces the pusher-retainer 48 into the carrier body central cavity 36*c*. Consequently, the pusher-retainer 48 is no longer in a raised position within the carrier body central cavity 36*c* in order to block protruding movement of the wedge members 50. Accordingly, the wedge members 50 are urged to underlay the hub 16*a* of the punch tip 16 (for securing the tip 16 to the punch body 14) given the outward pull of the wedge members 50 (via the carrier body 36) in combination with the slope of the frontal side surfaces 64 of the grooves 14*b*. With further reference to FIG. 1B, as the hub 16*a* of the punch tip 16 is inserted into the central cavities 38, 36*c*, inward movement of the hub 16*a* is prevented when an upper surface 16*e* of the hub 16*a* contacts the insert ring 62. In turn, the cam 34 is rotated as described above, with the wedge members 50 locking the hub 16*a* from its rear.

FIGS. 1A-1M, as detailed above, pertain to embodiments principally concerned with the punch body 14 and the ancillary components used therewith for assembly/disassembly of the punch tip 16 thereto. However, just as significant is the punch tip 16 embodied for the assembly. Particularly, a specific combination of characteristics pertaining to the punch tip 16 have been adopted (as further detailed below) to enable the tip 16 to have broad application. For example, such characteristics enable the punch tip 16 to be potentially adaptable with a wide variety of punch body types (and corresponding punch assemblies) while limiting complexity of the tip's design (e.g., to limit corresponding manufacturing expense). Further, such combination of characteristics for the punch tip 16 contributes to the ease by which the tip 16 can be secured and released from such punch body types.

In detailing the design of the punch tip 16, reference is initially made to the punch assembly 10 of FIG. 1A, the punch body 14 thereof, and the wedge members 50 used in alternately securing or releasing the punch tip 16 there from. FIGS. 1I and 1J show perspective views of one of the wedge members 50, according to certain embodiments of the invention. As illustrated, the wedge member 50 has a curvature along its longitudinal extent so as to generally match the curvature of the punch tip hub 16*a*. In certain embodiments (as described above), in addition to the punch tip hub 16*a*, the wedge members 50 are configured for mating with the slots 36*d* of the carrier body 36 and one or more of the frontal-most surfaces 64 and 66 of the punch body grooves 14*b*.

In certain embodiments, as shown in FIGS. 1I and 1J (and with reference to FIG. 1B), the wedge members 50 have principal planar surfaces 50*aa*, 50*bb*, 50*cc*, and 50*dd* on each of its sides 50*a*, 50*b*, 50*c*, and 50*d*, respectively. Two of the planar surfaces 50*aa* and 50*cc* (located on opposing sides 50*a* and 50*c*, respectively) allow for snug accommodation of the wedge member 50 within the carrier body slot 36*d*. However, such snug accommodation allows the members 50 to slide within the slots 36*d*, e.g., as a result of contact with other bodies during movement of the carrier body 36. In certain embodiments, the flat surfaces 50*aa* and 50*cc* run substantially parallel to corresponding surfaces defining the carrier body slots 36*d*. As described above, in certain embodiments, the planar surface 50*bb* (of side 50*b*) is configured to mate with the frontal-most surface 64 of each of the punch body grooves 14*b*. In certain embodiments, the sloped surface 50*bb* of the wedge members 50 and the sloped frontal-most surface 64 of the grooves 14*b* have approximately the same angle of slope so as to enhance sliding of the wedge members 50 out of the grooves 14*b*, as described above with reference to FIGS. 1B and 1M.

Side 50*d* of the wedge members 50 is configured for making contact (and moving out of contact) with the punch tip 16 for securing (and releasing/inserting) the tip 16 with the punch body 14. As described above, the punch tip 16 has been designed to be applicable with a wide variety of punch bodies, while having limited complexity with respect to the tip's design. Consequently, greater application of the punch tip 16 with respect to various punch assembly designs is likely, while avoiding significant manufacturing costs for the punch tip 16. Through the design process, many factors were considered. While focus was given to the configuration of the side 50*d* of the wedge members 50, just as much focus was given to the corresponding surface(s) of the punch tip 16 that would be configured to mate with such wedge member side 50*d*. For example, one consideration involved how many surfaces of the punch tip 16 should advantageously come into contact (or move out of contact) with the wedge members 50 for securing (or releasing) the tip 16 with respect to the punch body 14. Other considerations involved (i) how these punch tip surface(s) should be advantageously shaped, (ii) to what surface(s) of the wedge members 50 should the punch tip surface(s) advantageously correspond, and further, (iii) how these punch tip surface(s) should advantageously align or mate with the corresponding surface(s) of the wedge members 50.

Figure 2A:
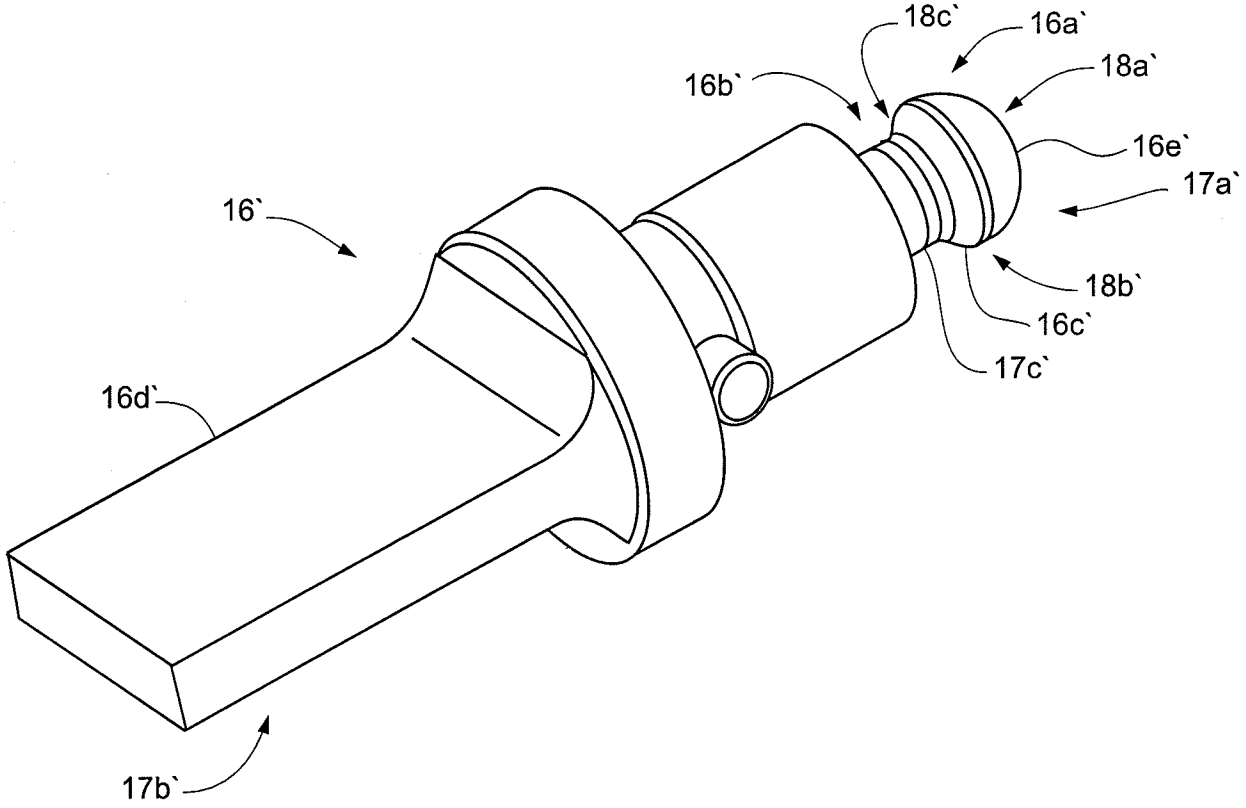
FIGS. 2A and 2B are perspective views of another punch tip, according to certain embodiments of the invention.
Figure 2B:
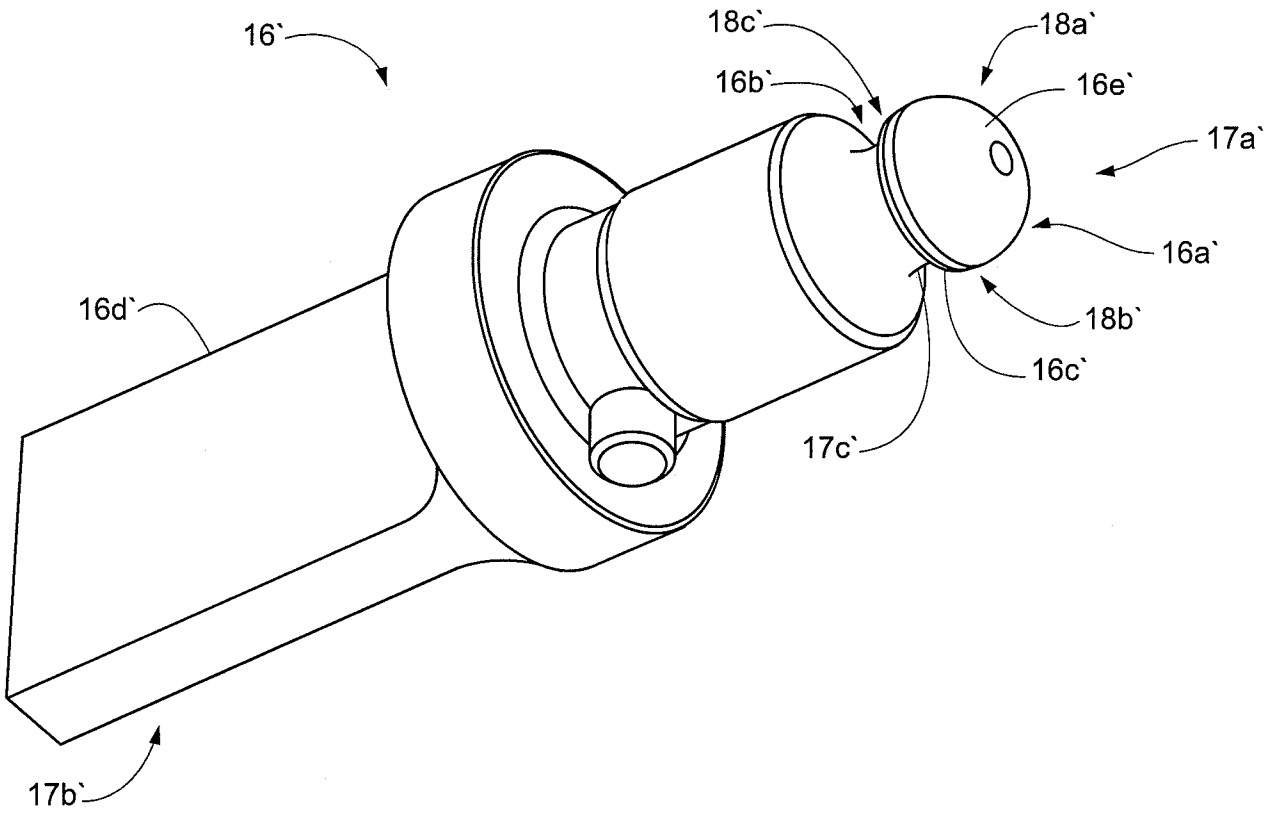
Figure 2C:
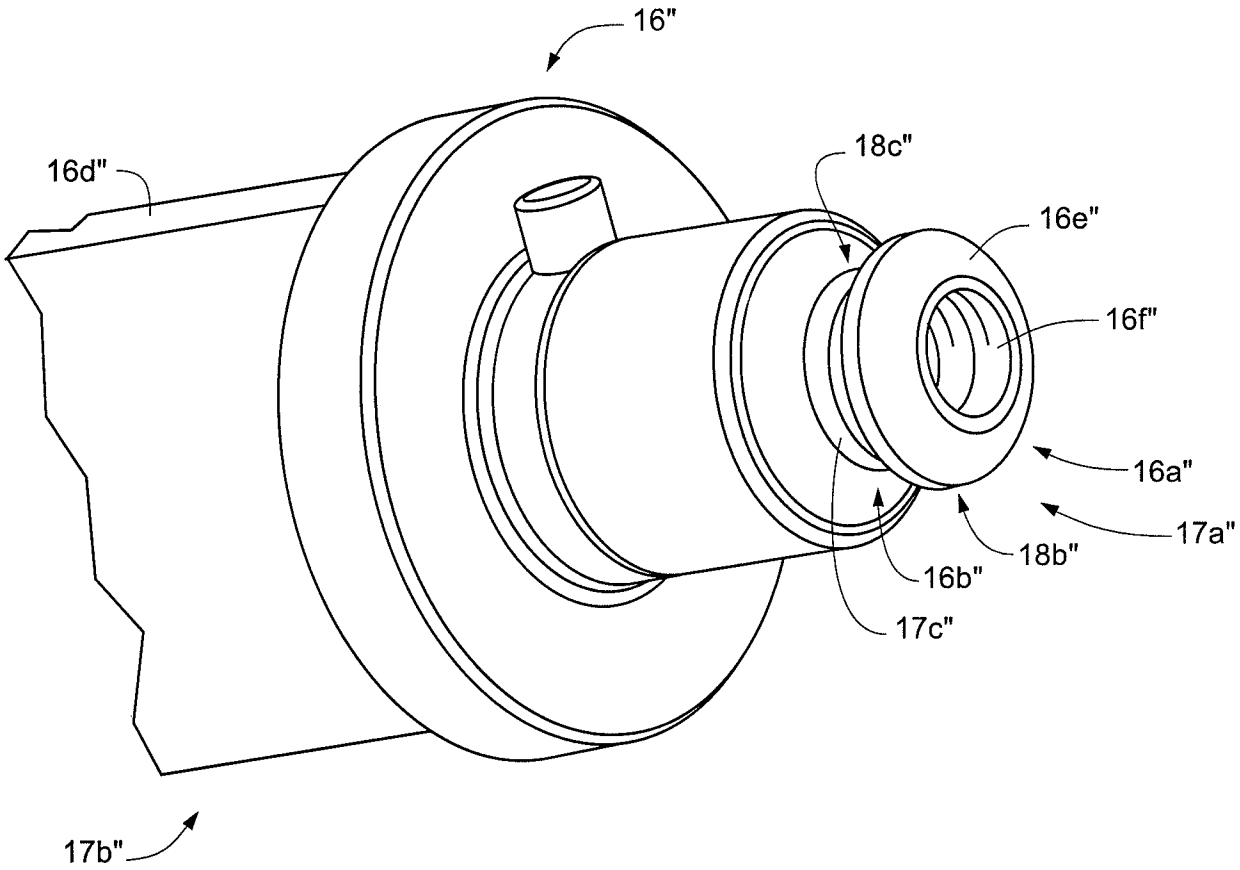
FIG. 2C is a perspective view of a further punch tip, according to certain embodiments of the invention.

With reference to FIGS. 2A-2C, other punch tips 16' and 16" are embodied herein, in accordance with certain embodiments of the invention. However, as should be appreciated, these punch tips 16' and 16" have similar characteristics as the punch tip 16 for configuring the punch tips to be applicable to a wide variety of punch bodies (and corresponding punch assemblies). In certain embodiments, as further detailed below, these characteristics relate to design features of the punch tip hub 16*a*. Particular reference is hereafter made to FIGS. 2A and 2B, each showing enlarged views of the punch tip 16' and its hub 16*a'* in certain embodiments. However, as alluded to above, each of the punch tips 16 and 16" (perhaps as best shown in FIGS. 1B and 2C, respectively) share similar characteristics with respect to hub design. Accordingly, the relevant hub features for the punch tips 16 and 16" are labeled with the same reference numerals, yet different iterations of the numerals.

Figure 3A:
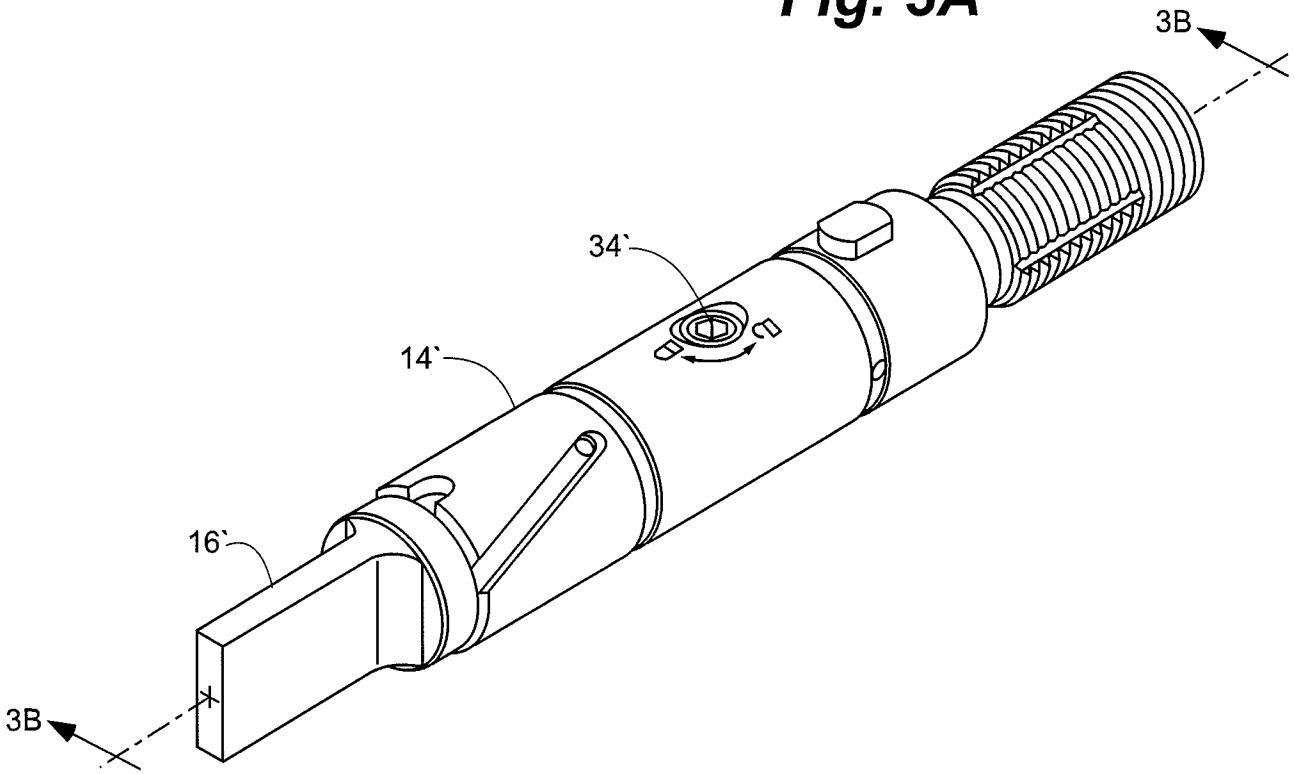
FIG. 3A is a perspective view of a punch body for an additional punch assembly, with the punch tip of FIGS. 2A and 2B secured to the punch body via ancillary components, according to certain embodiments of the invention.
Figure 3B:
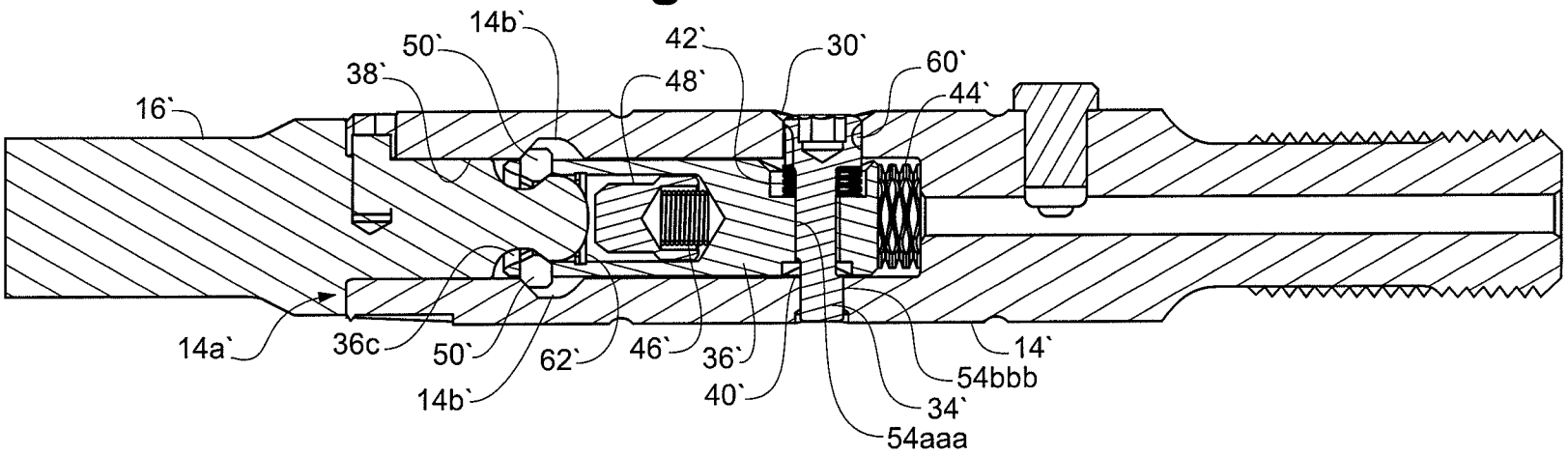
FIG. 3B is a cross-sectional view of the punch body, the punch tip, and the ancillary components of FIG. 3A along the lines 3B-3B, according to certain embodiments of the invention.
Figure 3C:
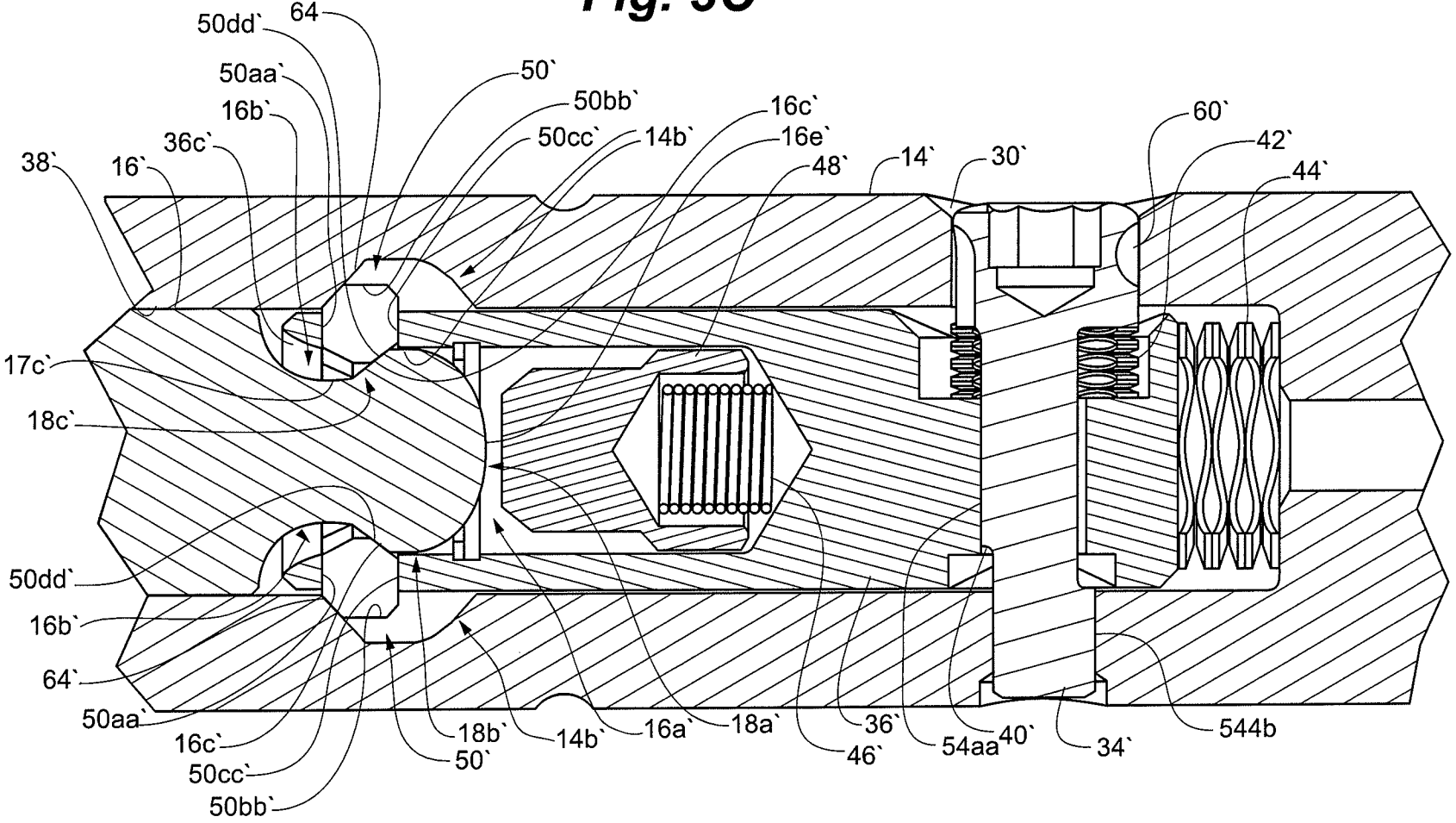
FIG. 3C is an enlarged partial view of the punch body, the punch tip, and the ancillary components as shown in FIG. 3B.

Looking to FIGS. 2A and 2B (and with reference to FIGS. 3B and 3C), the punch tip 16' is a body with a first end 17*a'* configured to be alternately secured or released with respect to a punch body (such as punch body 14') and a second end 17*b'* that includes a working end of the tip 16'. In certain embodiments, the punch tip 16' is a single integral body; however, it should be appreciated that other designs could involve the punch tip 16' being composed of separate conjoined pieces. With further reference to FIGS. 2A and 3C, the first end 17*a'* of the punch tip 16' includes a hub 16*a'* that is offset from a remainder of the tip 16' by a neck or neck region 17*c'*. As shown, the hub 16*a'* has an upper area 18*a'*, a side area 18*b'*, and a bottom area 18*c'*. As shown, the bottom area 18*c'* of the hub 16*a'* and the neck 17*c'* define a recess 16*b'* of the punch tip 16'. In certain embodiments, a surface 16*c'* of the hub bottom area 18*c'* is configured to singly mate with the wedge members (such as wedge members 50' shown in FIG. 3C). To that end, the punch tip 16' is configured such that the single surface 16*c'* of the hub bottom area 18*c'* contacts (or releases from contact with) the wedge members 50' when securing (or releasing) the tip 16' with respect to the punch body 14'.

With further reference to FIGS. 2A and 3C, it has been found that a stable coupling is provided for the punch tip 16' through contact with such single hub surface 16*c'* in light of the plurality of wedge members 50' that act upon the surface 16*c'*. The hub surface 16*c'*, as described above, involves one of the surfaces forming the recess 16*b'* of the punch tip 16'. The hub surface 16*c'*, in certain embodiments, defines at least one quarter (25%) of the recess 16*b'*. In certain embodiments, the surface 16*c'* represents the lone surface of the hub 16*a'* extending between the hub side area 18*b'* and the neck region 17*c'*. In such case, the surface 16*c'* represents an entirety of surface area between the hub side area 18*b'* and the neck region 17*c'* for corresponding side 50*dd* of wedge member 50' to mate with in securing the punch tip 16' to the punch body 14'. By designing the hub surface 16*c'* as such a significant area and/or as the lone contact surface of the bottom area of the hub 16*a'* enables the punch tip 16' to be flexible in terms of its adaptability to differing wedge member configurations employed by wide varieties of punch bodies (and corresponding punch assemblies).

In certain embodiments, the hub surface 16*c*' is planar and has an inward slope relative to the hub side area 18*b*'. By configuring the hub surface 16*c*' to slope diagonally inward from such hub side area 18*b*', the manner by which engaging members (such as the wedge members 50') can alternately slide inward (and bear against such surface 16*c*') and slide outward (and become free of the hub surface 16*c*') in releasing the punch tip 16' is enhanced. Consequently, overall ease by which the punch tip 16' can be alternately secured or released from the punch body 14' is enhanced. With continued reference to FIG. 3C, in certain embodiments, the single hub surface 16*c*' is configured to contact (or move out of contact with) a corresponding single surface of the wedge members 50'. As shown, the single surface of the wedge members 50' used in contacting the punch tip surface 16*c*' is surface 50*dd*' of side 50*d*'. By minimizing the number of surfaces of the tip 16' and wedge members 50' that are configured to contact, there is less risk of misalignment there between, as is often the case for groups of contacting surfaces. As further illustrated in FIG. 3C, the surface 50*dd*' has a slope somewhat similar to that of the hub surface 16*c*', and such similarity enables eased contact and manipulation there between (as described above with reference to FIGS. 1B and 1K-1M). It is natural to presume that an ideal design would be for such sliding surfaces (i.e., the hub and wedge member surfaces 16*c*' and 50*dd*') to have the same slope angle. However, after careful analysis, this was found to not be the case for the design embodied herein.

While it is true that too great a deviation in slope angle between the punch tip surface 16*c*' and the wedge member surfaces 50*dd*' is found to diminish the holding power there between, configuring the surfaces 16*c*' and 50*dd*' to have substantially the same or near the same slope angle (e.g., differing at most by one degree) significantly increased the difficulty involved with their manufacture. Not only this, but dictating that the contacting surfaces 16*c*' and 50*dd*' to be substantially the same or near the same runs contrary to the above-described goal of configuring the punch tip 16' to be universal in its application with regard to various punch assembly types. As alluded to above, not all punch bodies can incorporate the exact wedge member design (or wedge members at all) as provided with the punch body 14'. Configuring the hub surface 16*c*' to be planar and sloped enables the punch tip hub 16*a*' of punch tip 16' to exhibit good holding power without requiring the surface 16*c*' to exactly mate with corresponding retaining members of or within the punch body. Consequently, the punch tip 16' is more applicable to a wider variety of punch assemblies.

In determining working angles for each of the punch tip surface 16*c*' and the wedge member surfaces 50*dd*', a wide variety of angle combinations were considered. Regarding the angles considered, they could be measured from a separate surface of the wedge member 50'. For example, with reference to FIG. 1B and the wedge member 50' illustrated therein, the planar surface 50*c*' of wedge member side 50*c* could be the reference surface, from which various slope angle combinations for the surfaces 16*c*' and 50*dd*' could be measured and then tested. As should be appreciated, because the wedge members 50' are moved into the recess 16*b*' of the punch tip hub 16*a*', the punch tip surface 16*c*' is generally a lesser angle from such reference surface 50*c*' then the wedge member surface 50*dd*'. Consequently, the angles measured and tested for the punch tip surface 16*c*' were smaller than corresponding angles for the wedge member surface 50*dd*'.

In certain embodiments, advantageous working angles, both for holding power and maneuverability, for the punch tip hub surface 16*c*' were found to range from about 25° to about 55°, while corresponding advantageous working angles for the wedge member surface 50*dd*' were found to range from about 28° to about 60°. Additionally, in certain embodiments, the difference in slope angle between the surfaces 50*dd*' and 16*c*' that was found advantageous, both for sufficient holding power and machining purposes, was found to range from about 2° to about 20°. In preferred embodiments, the difference in slope between the surfaces 50*dd*' and 16*c*' was found to be most advantageous when in the range from about 5° to about 10°, and most preferable, when about 8°. Referring back to working angles for the punch tip surface 16*c*', in preferred embodiments, the working angles found to be most advantageous were in the range from about 37° to about 50°, and corresponding working angles for the wedge member surface 50*dd*' were found to be most advantageous in the range from about 43° to about 56°. In most preferable embodiments, the working angle for the punch tip surface 16*c*' was found most advantageous when about 40°, with corresponding working angle for the wedge member surface 50*dd*' being found most advantageous when about 48°.

Embodiments focused upon above have involved coupling the punch tips 16, 16', and 16", and specifically their punch tip hub surfaces 16*c*, 16*c*', and 16*c*", with corresponding surfaces of wedge members for alternately securing or releasing the punch tips 16, 16', and 16" to corresponding punch bodies of punch assemblies. However, it should be appreciated that a variety of movable bodies (i.e., other than wedge members) can be used in punch body designs for contacting punch tip hubs in securing punch tips to punch bodies. For example, in certain embodiments, the movable bodies can involve balls or keys; however, given the adaptability of the hub design embodied above, the punch tips 16, 16', and 16" have greater chance of applicability in such cases.

Again, reference is made below specifically to punch tip 16', yet such description equally applies to punch tips 16 and 16" with their similar hub features. In certain embodiments, the punch tip 16' involves only a single contact surface 16*c*' of the hub 16*a*' for securing and releasing the punch tip 16'. As further described, in certain embodiments, the hub contact surface 16*c*' is configured to be of a slope angle that affords sound coupling without necessitating the corresponding contact surface 50*dd*' of wedge members 50' to be of the same slope angle. Thus, sound coupling between the hub 16*a*' and movable bodies (such as the wedge members 50') of a punch body can be achieved via minimized contacting surfaces there between, while also permitting slope variance between the contacting surfaces. Accordingly, such simplicity and flexibility avails the embodied punch tip 16' to be applicable with a wide variety of punch assembly designs with limited modification to their designs and corresponding decreased impact on manufacturing cost.

In punch body embodiments incorporating the ancillary components described herein, e.g., punch body 14, certain of the components serve as triggers (e.g., the cam 34, the carrier body 36, and the wedge members 50) for securing and releasing the punch tip 16 with regard to the punch body 14. Use of the cam 34 also enhances the ease (via rotation of the cam 34) by which an operator can easily and selectively manipulate other of the ancillary components to secure or release the punch tip 16 with regard to the punch body 14.

It is well known that punch tips for punch assemblies come in a wide variety of sizes, types, and configurations. FIGS. 2A and 2B show perspective views of the punch tip 16', and as described above, is similar to the punch tip 16 but for having a different tip size or footprint (i.e., with the tip 16' and its working end 16*d'* correspondingly being both narrower and elongated). As further alluded to above, FIG. 2C shows another punch tip 16", similar to punch tip 16, yet having certain distinctions according to certain embodiments of the invention. For example, one distinguishing feature involves the upper surface 16*e"* of the hub 16*a"* being defined with a threaded portion 16*f"*. As should be appreciated, the threaded portion 16*f"* serves as an alternate means of coupling for the hub 16" in the case of punch bodies not employing wedge members (such as wedge members 50). As alluded to above, in certain embodiments, the punch tip 16" is configured to be secured with punch bodies employing wedge members for locking/releasing the punch tip hub 16*a*. However, the threaded portion 16*f"* enables the punch tip 16" to be alternately secured with punch bodies not employing such wedge members. In such case, the punch body can have a male threaded portion which, when threaded into female threaded portion 16*f"* of the hub 16*a"*, enables the punch tip 16" to be secured with such punch body. As shown, the threaded portion 16*f"* comprises a female threading defined within the hub 16*a"*; however, it should be appreciated that the hub 16*a"* may alternately include a male threaded portion protruding from its hub 16*a"* that can be coupled with a corresponding female threaded portion defined with the punch body.

Figure 3D:
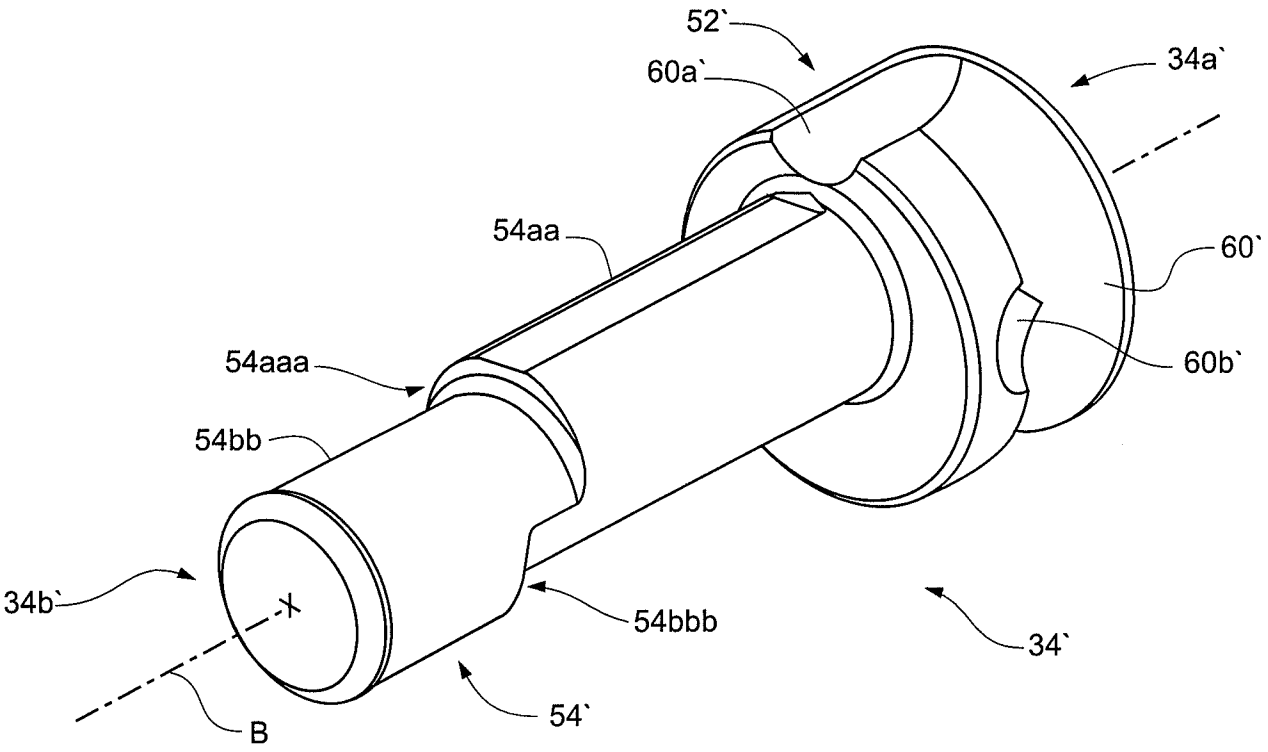
FIGS. 3D and 3E are differing perspective views of cam used with the punch body of FIGS. 3A and 3B, according to certain embodiments of the invention.
Figure 3E:
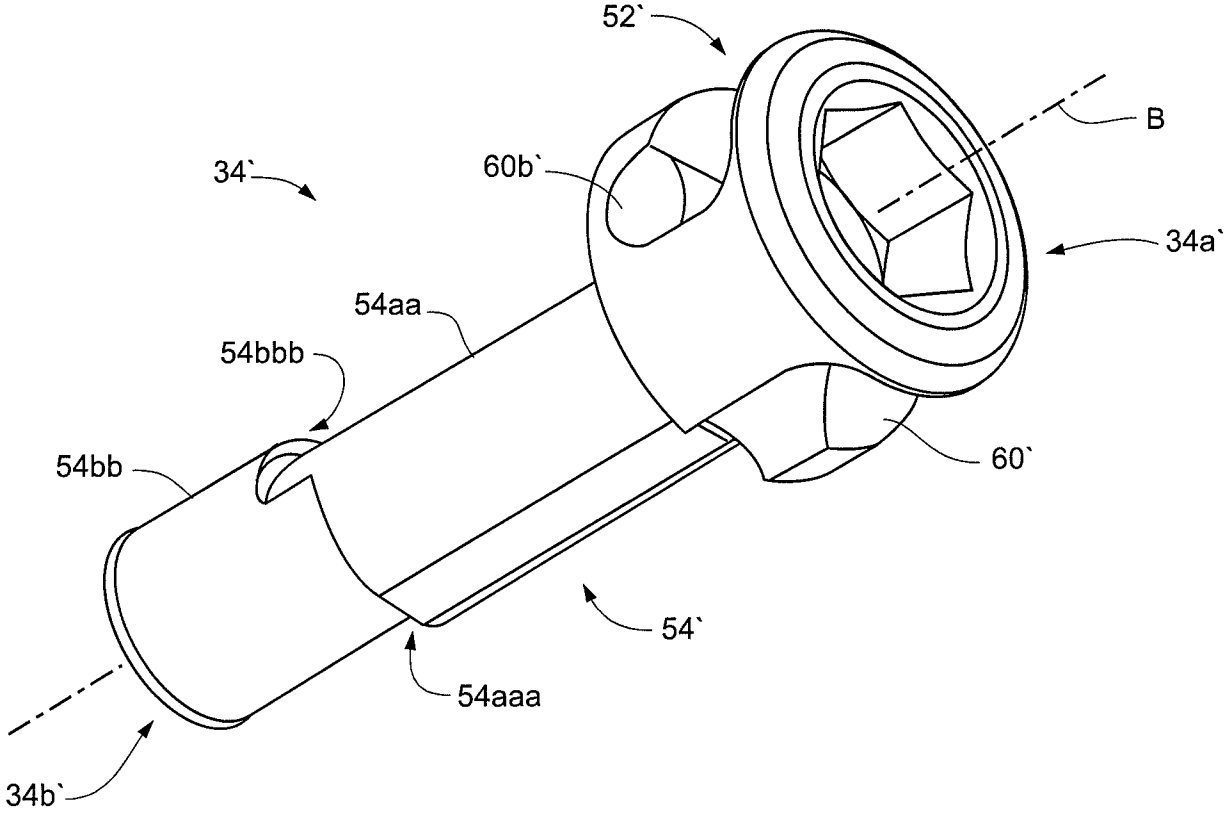

Referring back to the punch tip 16' of FIGS. 2A and 2B, the punch body 14' (shown in FIG. 3A) to which it corresponds has a narrowed central cavity 38'. FIG. 3B illustrates the punch tip 16' being secured with such punch body 14' in side cross-sectional view, according to certain embodiments of the invention. Also shown are ancillary components similar to those described above with regard to the punch body 14 and punch tip 16, involving cam 34' (embodied in FIGS. 3D and 3E), carrier body 36' (embodied in FIGS. 3F and 3G), springs 42', 44', and 46', pusher-retainer 48', and wedge members 50'. To that end, such components have similar uses and functioning in securing and releasing the punch tip 16' to the punch body 14'. This is perhaps best viewed from FIG. 3C, showing an enlarged partial view of the ancillary components and their use in securing the punch tip 16' to the punch body 14'. As described above, despite the elongated and narrowed configurations of the punch tip 16' and punch body 14', there is little corresponding constraint on the designs of the punch tip hub 16*a'* and the wedge members 50'.

Similar to that already described with regard to the punch body 14, the punch tip 16, and the ancillary components used therewith, the cam 34' is configured for rotation once positioned within the punch body aperture 30' and the carrier body bore 40'. In certain embodiments, the cam's allowable range of rotation is dictated by the longitudinal extent of the channel 60', as a ball 56' (similar in structure and function to the ball 56 described above) retained within the channel 60' prevents the cam's further rotation. In further certain embodiments, the channel 60' is formed with one or more pockets 60*b'* each serving as a rotatable locking position for the ball 56', and the cam 34' within the carrier body bore 40'. For example, in certain embodiments, the locking positions include a first position enabling the punch tip 16' to be secured to the punch body 14' (whereby protruding portion 54*aaa* is oriented toward the front end 36*a'* of the carrier body 36') and a second position enabling the punch tip 16' to be released from (or inserted within) the punch body 14' (whereby protruding portion 54*aaa* is oriented toward the rear end 36*b'* of the carrier body 36'). With reference to FIG. 3C, and as further described below, even though the punch body 14' and punch tip 16 (as well as hub 16*a* thereof) are elongated, there is little corresponding effect in configuring the contact hub and wedge surfaces as already detailed above with respect to hub and wedge member surfaces 16*c* and 50*d'* of punch tip 16 and wedge members 50.

Figure 3F:
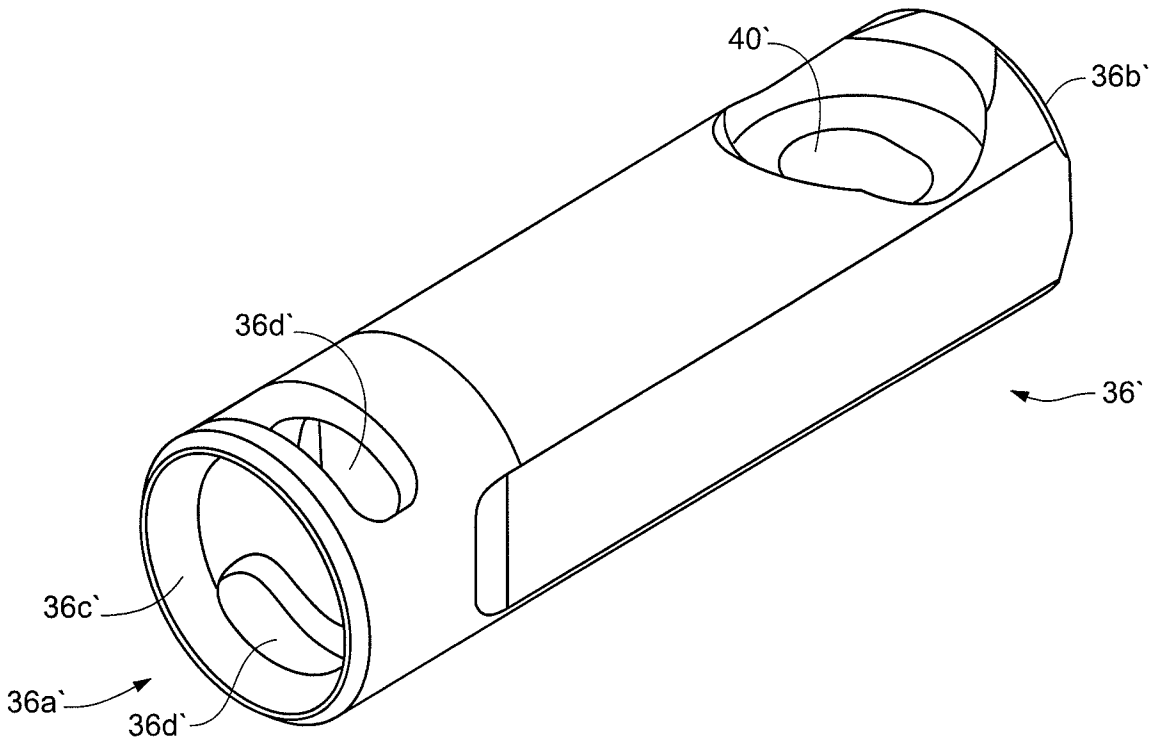
FIGS. 3F and 3G are differing perspective views of carrier body used with the punch body of FIGS. 3A and 3B, according to certain embodiments of the invention.
Figure 3G:
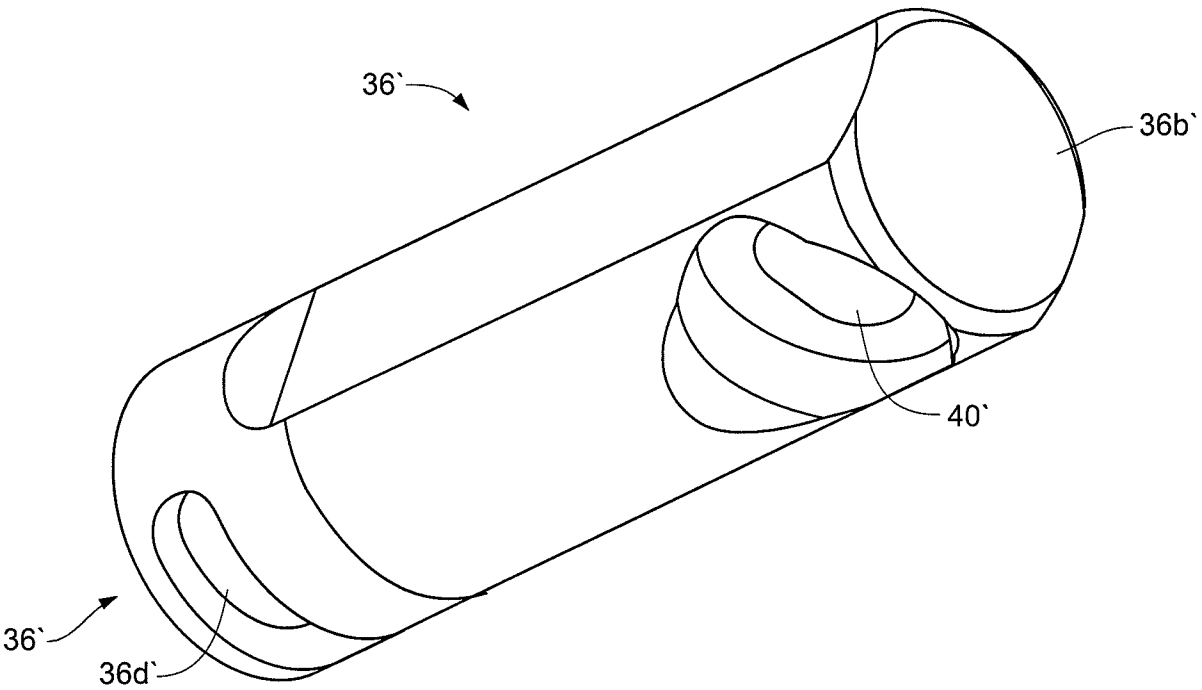

Similar to that described above for the carrier body 36 used with the punch body 14 and punch tip 16, opposing movements of the carrier body 36' (alternately triggered by the cam's rotation) serve as further triggers for alternatively securing or releasing the punch tip 16' with respect to the punch body 14'. As described above, this further triggering involves the wedge members 50'. In certain embodiments, and with reference to FIGS. 3B and 3C, a plurality of the wedge members 50' is utilized with the carrier body 36', with slots 36*d'* therein to correspondingly accommodate the members 50'. In certain embodiments, there are at least two wedge members 50', with each adapted to slide within one of the corresponding slots 36*d'* of the carrier body 36'. In certain embodiments, as shown in FIGS. 3F and 3G, the slots 36*d'* are at the front end 36*a'* of the carrier body 36', and defined generally equidistant around the outer surface thereof. FIGS. 3C, 3H, 3I, and 3J are cross-sectional views of the punch body 14', showing differing rotated positions of the cam 36' and the corresponding effects on the carrier body 36' and the wedge members 50', according to certain embodiments of the invention. As further detailed below, with movement of the carrier body 36' (via rotation of the cam 34'), the wedge members 50' are moved in corresponding fashion with respect to the carrier body slots 36*d'* and grooves 14*b'* of the punch body 14' (lying external to the slots 36*d'*). As should be appreciated, the securing and release processes with respect to the punch body 14' and its ancillary components are similar to the corresponding processes already-described above with respect to the punch body 14 and its ancillary components.

Figure 3H:
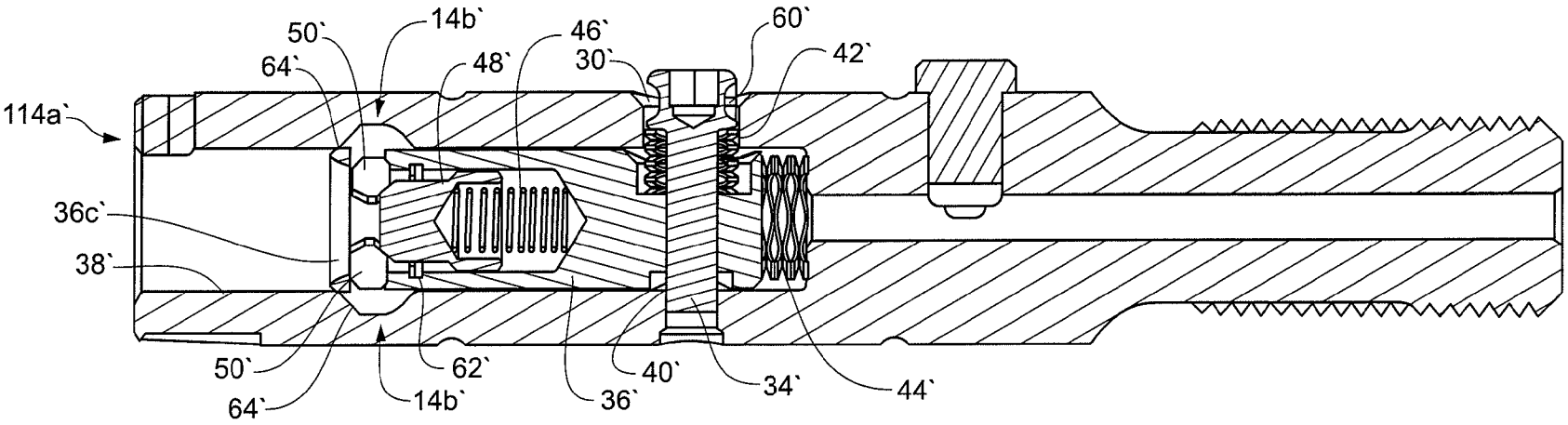
FIG. 3H is a side cross-sectional view of the punch body and the ancillary components as shown in FIG. 3B with the cam of FIGS. 3D and 3E being inserted in the punch body, according to certain embodiments of the invention.
Figure 3I:
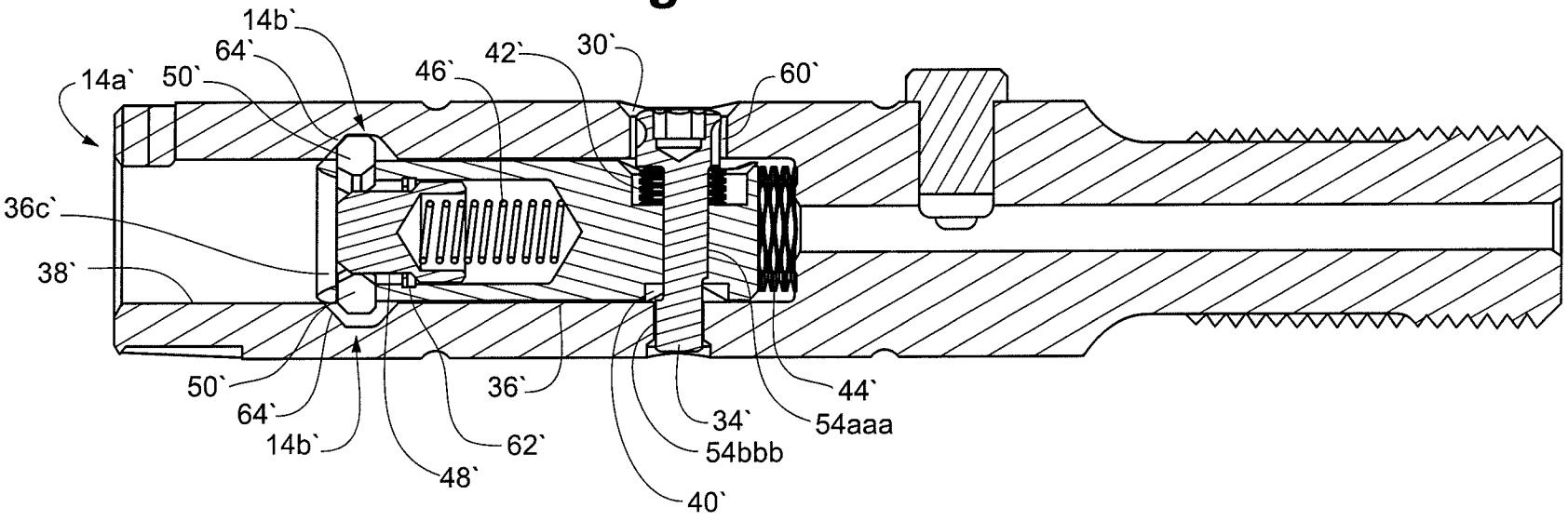
FIG. 3I is a side cross-sectional view of the punch body and the ancillary components as shown in FIG. 3B with the cam of FIGS. 3D and 3E inserted in, and rotated relative to, the punch body, according to certain embodiments of the invention.

For example, starting with FIG. 3H, the punch body 14' is shown without the punch tip 16', with the cam 34' being partially inserted in the punch body aperture 30' and carrier body bore 40'. As described above, in certain embodiments, the punch body 14' is configured to be operatively coupled with the cam 34' via a ball-channel linkage. No such linkage is yet applicable as shown because the head portion 52' of the cam 34' is not yet fully within the punch body aperture 30'. Also, neither of the protruding portions 56*aaa*, 56*bbb* of cam segments 56*aa*, 56*bb* are visible. To that end, in certain embodiments, the carrier body bore 40' is defined so as to only allow insertion of the cam 34' therein if its protruding portions 56*aaa*, 56*bb* are oriented generally perpendicular with respect to the punch body front end 14*a'*. Consequently, there is no force from the cam 34' being directed toward the carrier body 36', and little corresponding force from the carrier body 36' on the wedge members 50'. As such, the wedge members 50', while accommodated by the carrier body slots 36*d'*, are free to slide into the central cavity 36*c'* of the carrier body 36' (as shown).

Regarding FIG. 3I, again, the punch body 14' is shown without the punch tip 16'; however, the cam 34' is shown as being fully inserted in the punch body aperture 30' and carrier body bore 40'. As such, in embodiments employing the above-described ball-channel linkage of the punch body 14' and cam 34', the ball 56' (not visible as it is positioned rearward of the cam head portion 52') is not only located in the channel 60', but also in one of the pockets 60*b'* for locking the cam 34' in position. As shown, the spring 42' is resiliently biasing the head portion 52' of the cam 34' so as to keep the ball in such pocket 60*b'* and the cam 34' at such rotated position. In particular, the illustrated position is for releasing/inserting the punch tip 16' with respect to the punch body 14'. At such position, the protruding portion 54*aaa* of segment 54*aa* is oriented toward the rear end 36*b'* of the carrier body 36', which in turn forces the body 36' inward of (i.e., deeper within) the punch body central cavity 38'. Such inward pulling of the carrier body 36' in turn allows the wedge members 50' to be pulled inward via their accommodation by the carrier body slots 36*d*'. As such, the wedge members 50' are pulled adjacent to the grooves 14*b*' of the punch body 14'. Such inward pull of the wedge members 50' along with outward force of the pusher-retainer 48' (via its spring 46') results in the pusher-retainer 48' contacting and forcing the members 50' further out through the carrier body slots 36*d*' and into the grooves 14*b*'.

Figure 3J:
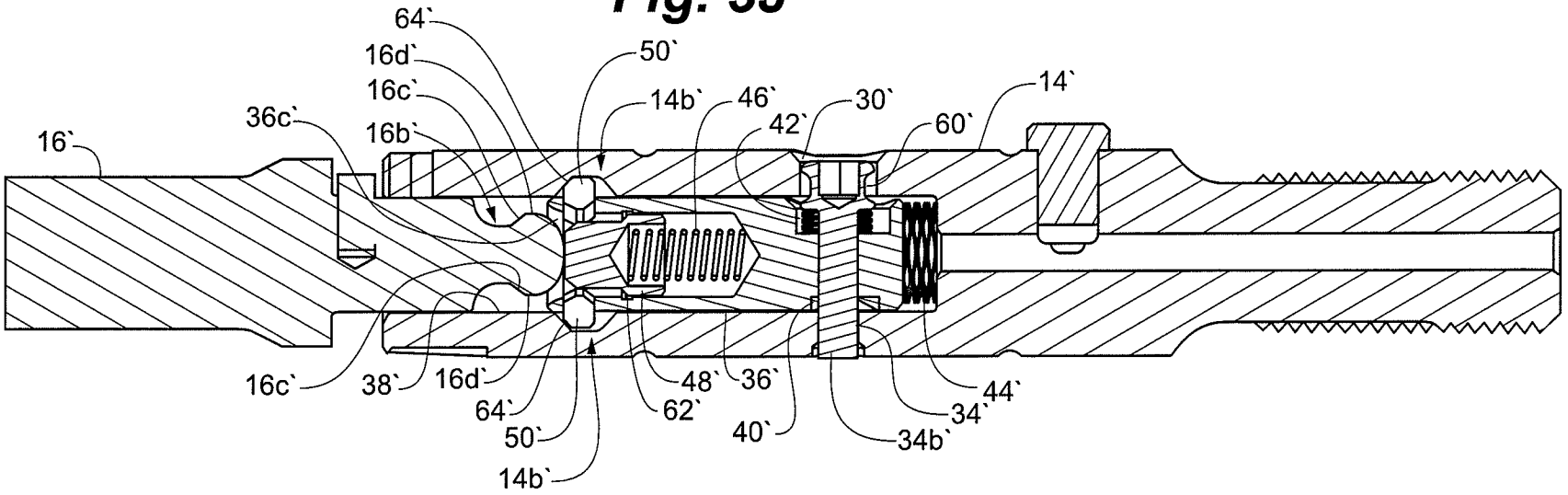
FIG. 3J is a side cross-sectional view of the punch body, the punch tip, and the ancillary components as shown in FIG. 3B with the cam of FIGS. 3D and 3E inserted in, and further rotated relative to, the punch body, according to certain embodiments of the invention.

Looking to FIG. 3J, the punch tip 16' is shown as being partially inserted in the central cavity 38' of the punch body 14'. Similar to what is shown in FIG. 3H, the cam 34' is fully inserted in the punch body aperture 30' and carrier body bore 40'; however, its leading end 34*b*' is shown extending outside the punch body aperture 30'. Thus, in embodiments employing the above-described ball-channel linkage of the punch body 14' and cam 34', the ball 56' (again not visible as it is positioned rearward of the cam head portion 52') is located in the channel 60' and not in one of the pockets 60*b*' for locking the cam 34' in position. As shown, the cam 34' is rotated such that neither of its protruding portions 54*aaa*, 54*bbb* are visible. In particular, the portions 54*aaa*, 54*bbb* are generally perpendicular with respect to the punch body front end 14*a*', yet oriented 180 degrees from their orientations described with respect to FIG. 3H. Consequently, in reference back to FIG. 3J, the inward force applied to the carrier body 36' is removed, resulting in the carrier body being urged outward (i.e., toward the front end 14*a*' of the punch body 14') via action of the spring 44'. Such outward urging of the carrier body 36' in turn forces the wedge members 50' to be pulled outward via their accommodation by the carrier body slots 36*d*'. In particular, the wedge members 50' contact with the frontal side surfaces 64' of the grooves 14*b*' of the punch body 14'. Such outward pull of the wedge members 50' (via the carrier body 36') in combination with the slope of the frontal side surfaces 64' of the grooves 14*b*' results in the wedge members 50' sliding along such surfaces 64', back through the carrier body slots 36*d*' and into the central cavity 36*c*' of the carrier body 36'.

Finally, with reference to FIG. 3C (and FIG. 3B), the punch body 14' is shown with the punch tip 16' secured thereto. Employing the above-described ball-channel linkage of the punch body 14' and cam 34', and similar to that described with FIG. 3I, the ball 56' is located in another of the pockets 60*b*' for locking the cam 34' in position, with the spring 42' biasing the head portion 52' of the cam 34' so as to keep the ball 56' in such pocket 60*b*' and the cam 34' is such rotated position. In particular, the illustrated position is for securing the punch tip 16' with respect to the punch body 14'. At such position, the protruding portion 54*aaa* of segment 54*aa* is oriented toward the front end 36*a*' of the carrier body 36', which in turn forces the body 36' outward of (i.e., shallower within) the punch body central cavity 38'.

Continuing from that described above for FIG. 3J, such outward pulling of the carrier body 36' in turn forces the wedge members 50' to be pulled further outward via their accommodation by the carrier body slots 36*d*'. Such further outward pull of the wedge members 50' (via the carrier body 36') in combination with the slope of the frontal side surfaces 64' of the grooves 14*b*' results in the wedge members 50' continuing to slide along such surfaces 64'. In particular, such sliding action results in the wedge members 50' further passing through the carrier body slots 36*d*' so as to underlay coupling hub 16*a*' of the punch tip 16' for securing the tip 16' to the punch body 14'. With further reference to FIG. 3B, as the hub 16*a*' of the punch tip 16' is inserted into the punch body central cavity 38' and in turn the carrier body central cavity 36*c*', further inward motion is prevented upon the front surface 16*e*' of the hub 16*a*' contacting a lip 62' protruding from the central cavity 36*c*' of the carrier body 36'. As described, the lip 62' can involve an insert ring 62' or a plurality of protrusions extending inward with respect to the central cavity 36*c*'. In turn, the cam 34' is rotated as described above, with the wedge members 50' locking the hub 16*a*' from its rear.

As described above, the contacting surfaces for the punch tip hub 14*a*' and the wedge members 50' can be configured similarly to those detailed above with respect to contacting surfaces 16*c* and 50*d*' of punch tip hub 16*a* and wedge members 50. To that end, reference can be made to FIGS. 1I and 1J and the corresponding description above with regard to the sides and contact surface of the wedge members 50'. For corresponding illustration regarding the punch body 14' and punch tip 16' for the above-referenced description, reference can be made to FIG. 3C. Thus, even in cases of punch assemblies having a similar style to the punch assembly 10, but accommodating different-sized punch bodies (such as the punch body 14'), the punch tip design embodied herein (with regard to characteristics of the punch tip 16) remains applicable.

Figure 4A:
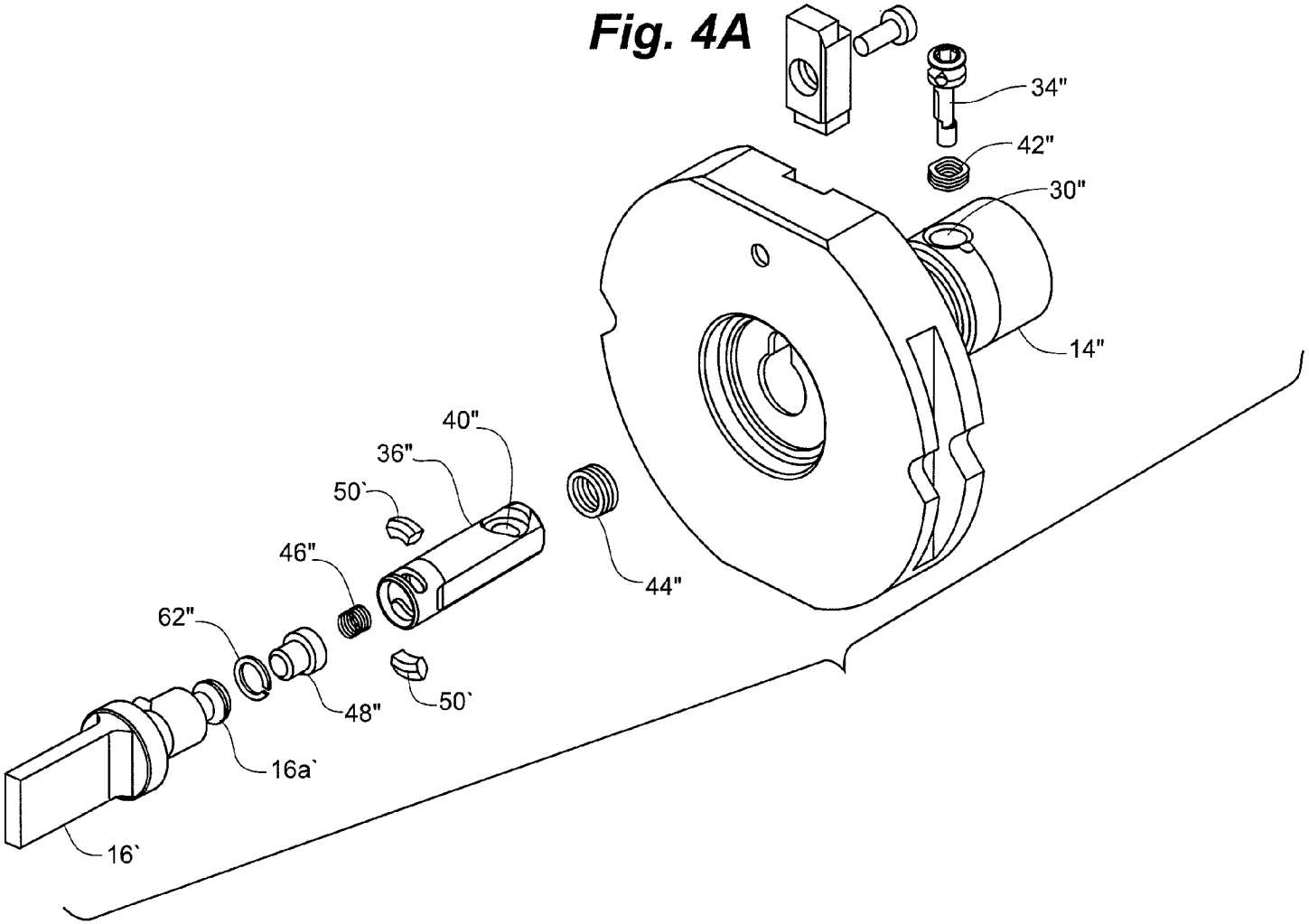
FIG. 4A is a side cross-sectional view of a punch body for a Trumpf or non-turret style punch assembly and the punch tip of FIGS. 2A and 2B secured thereto via ancillary components, according to certain embodiments of the invention.
Figure 4B:
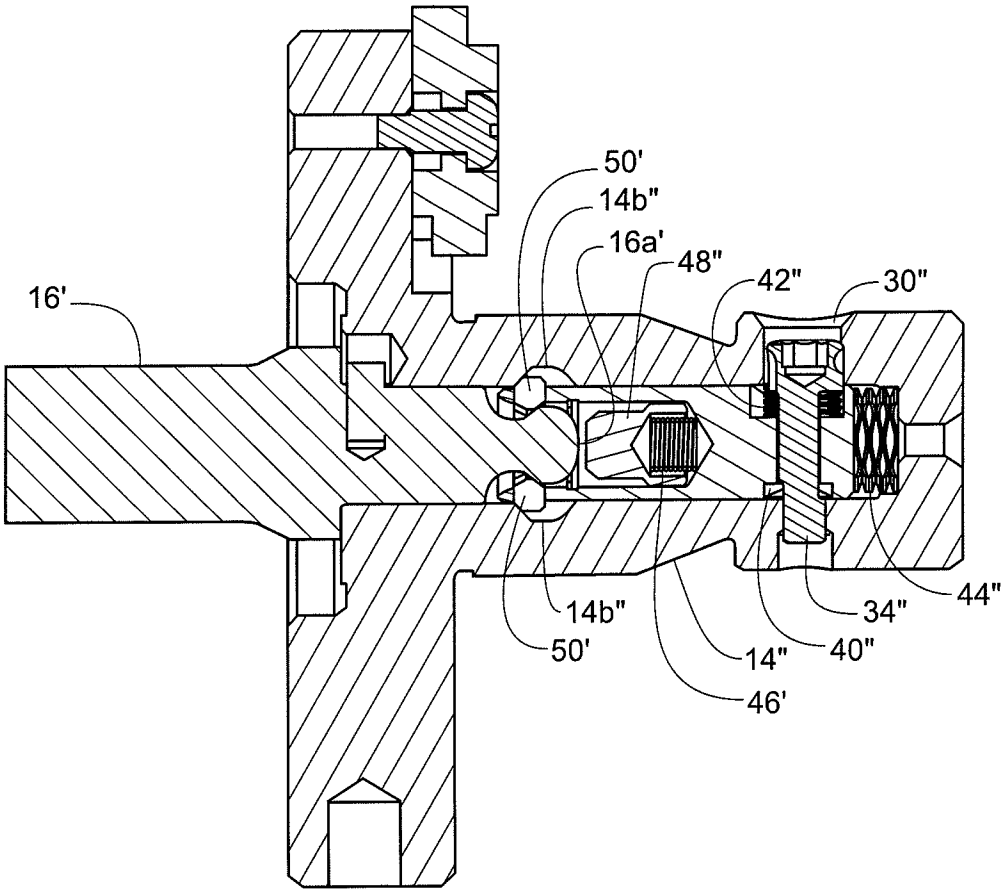
FIG. 4B is a perspective view of the punch body, the punch tip, and the ancillary components of FIG. 4A, shown in exploded assembly view, according to certain embodiments of the invention.

Testing of the punch tip design was further expanded to other punch body styles, yet adapted to use the same punch tips 16 or 16' as described above. FIGS. 4A and 4B illustrate one such punch body example, i.e., for a Trumpf or non-turret style punch assembly, according to certain embodiments of the invention. Looking to the exploded assembly view of FIG. 4A, the punch body 14" is configured for use with the punch tip 16' of FIGS. 2A and 2B. In certain embodiments, as shown in FIGS. 4A and 4B, ancillary components (e.g., cam 34", carrier body 36", springs 42", 44", and 46", pusher-retainer 48", and wedge members 50") similar to the ones detailed above with regard to FIGS. 3A-3J are used with the punch body 14". Based on this, the corresponding punch tip 16' (as shown in FIGS. 4A and 4B) is alternately secured and released with respect to such punch body 14" following the same procedures described above with respect to FIGS. 3C, 3H, 3I, and 3J, and using the same characteristics for the contacting surfaces of the punch tip hub 16*a*' and the wedge surfaces 50*d*'. Thus, even in cases of punch assemblies utilizing different punch body styles than the punch bodies 14 or 14' embodied herein, so long as the assemblies are configured similarly to one of the punch bodies 14 or 14' (so as to utilize "like" ancillary components thereof), the punch tip design embodied herein (with regard to characteristics of the punch tips 16 and 16') remains applicable.

Figure 5A:
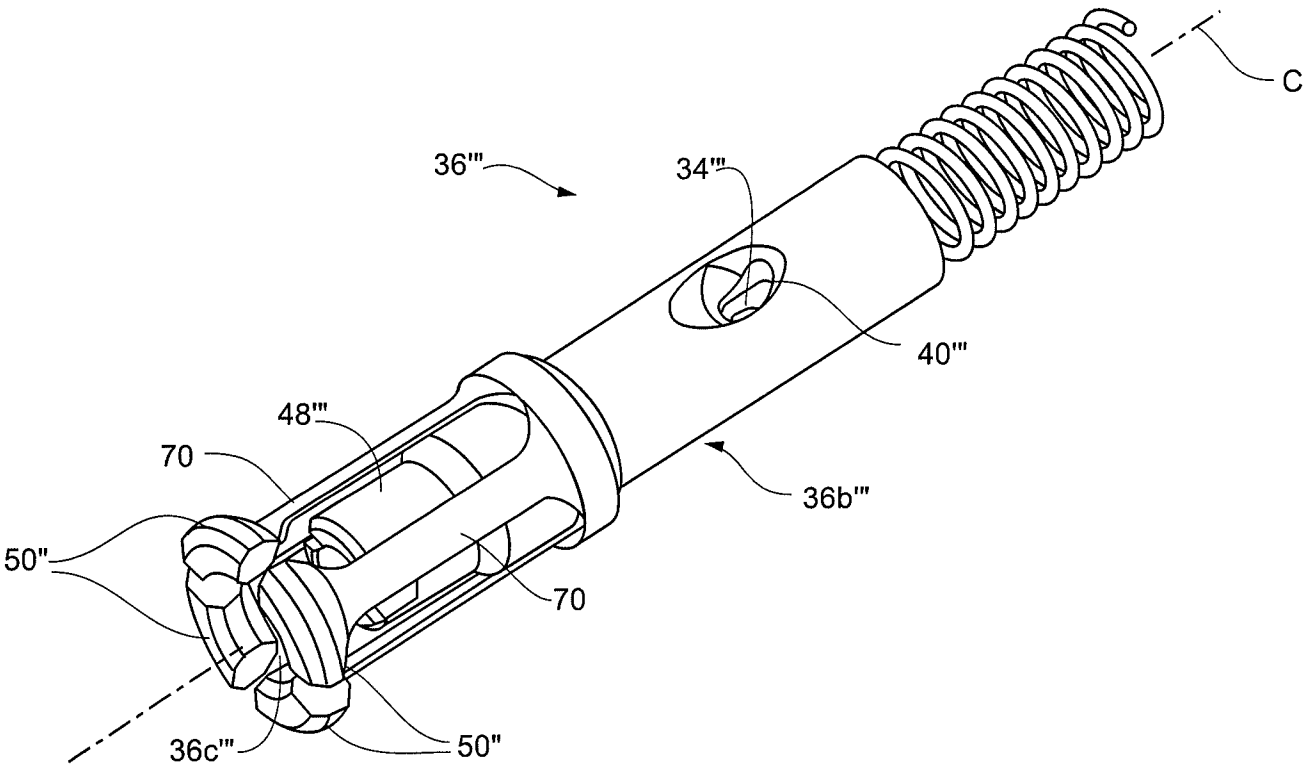
FIG. 5A is a carrier body configured for a punch body of another punch assembly illustrating setup thereof when in a tip-securing position, according to certain embodiments of the invention.
Figure 5B:
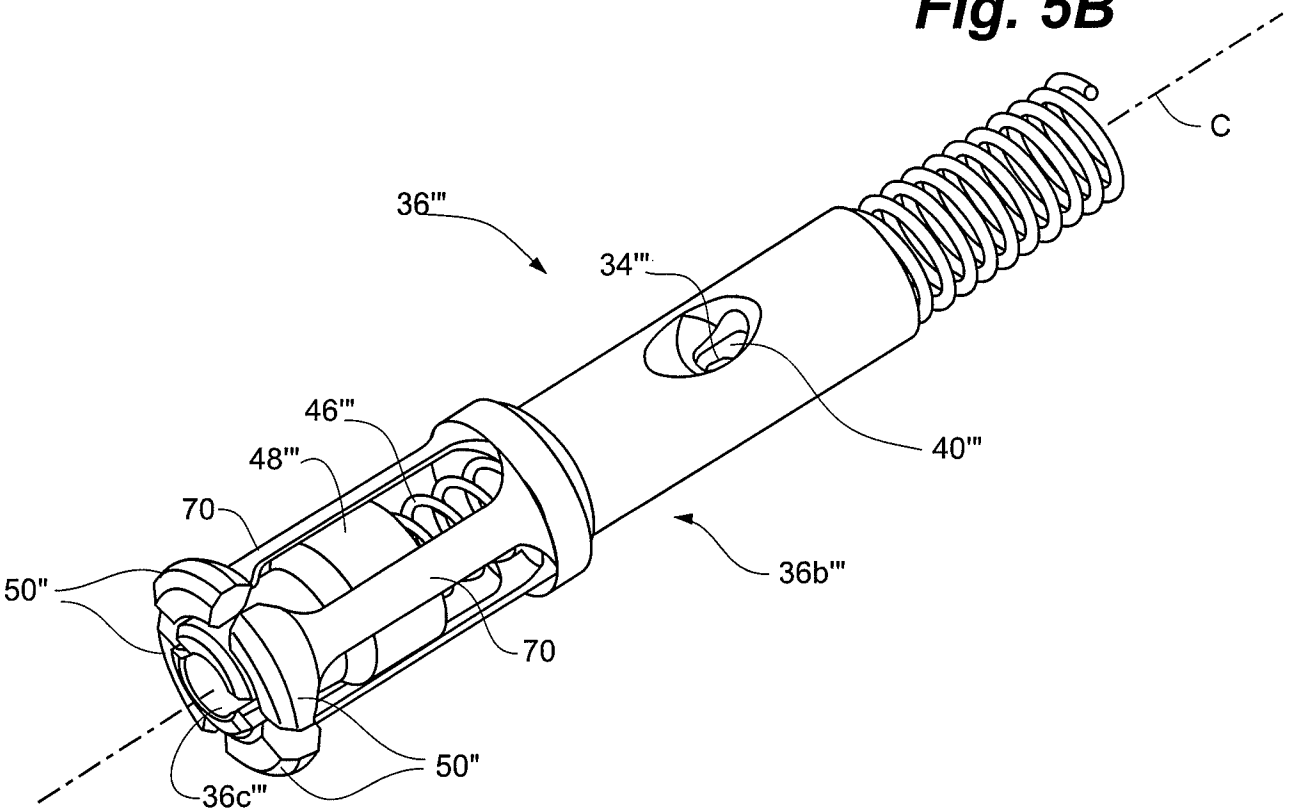
FIG. 5B is the carrier body of FIG. 5A illustrating a further setup thereof when in a tip-releasing position, according to certain embodiments of the invention.

Testing of the punch tip design was additionally expanded to other punch body configurations, yet adapted to use the same punch tips 16 or 16' as described above. FIGS. 5A and 5B show a carrier body for one such punch body example, according to certain embodiments of the invention. Looking to FIG. 5A, the carrier body 36'" is shown with set-up for securing a punch tip according to certain embodiments of the invention, while FIG. 5B shows the carrier body 36'" with set-up for releasing the punch tip according to certain embodiments of the invention. As illustrated, in certain embodiments, ancillary components used with the carrier body 36'" include different variations of cam 34'", spring 46'" (shown in FIG. 5B), pusher-retainer 48", and wedge members 50". Distinct from the carrier bodies 36 and 36' already described above, the carrier body 36'" functions with wedge members 50" that are rigidly coupled to the body 36'". As shown, in certain embodiments, such rigid attachment involves an arm 70 extending between the carrier body 36''' and each of the wedge members 50''. While the arms 70 provide a rigid positioning of the wedge members 50'' with respect to the carrier body 36''', the arms 70 are also configured to project outward (as shown in FIG. 5B), particularly when the pusher-retainer 48''' is released so as to contact the wedge members 50''.

In certain embodiments, as shown in FIG. 5A, the pusher-retainer 48''' is locked in an inward position with respect to the central cavity 36*c'''* of the carrier body 36'''. In certain embodiments, movement of the pusher-retainer 48''' is triggered via rotation of the cam 34'''. Starting with FIG. 5B, the cam 34''', when rotated in the bore 40''' to a first position, triggers a release of the pusher-retainer 48'''. In turn, the pusher-retainer 48''' is urged outward (i.e., away from the rear end 36*b'''*) of the carrier body 36''' via action of the spring 44''' positioned behind the pusher-retainer 48'''. Upon such outward movement, the pusher-retainer 48''' contacts the wedge members 50'', causing them to project outward, e.g., generally in a perpendicular direction in relation to the longitudinal axis C of the carrier body 36'''. Such outward projection of the wedge members 50'' enables the hub portion of punch tip (e.g., hub 16*a'* of punch tip 16' of FIGS. 2A and 2B) to subsequently be inserted in the carrier body central cavity 36*c'''* along axis C with contact being made with the pusher-retainer 48''' in an inward direction with respect to the cavity 36*c'''*. Following the punch hub's insertion in the cavity 36*c'''* (and the inward positioning of the pusher-retainer 48''' within such cavity 36*c'''*), the wedge members 50'' project inward toward the central cavity 36*c'''* in response (via the arms 70 springing back to their initial straightened orientation), thereby locking the punch tip hub 16*a'* in place. In turn, the cam 34''' is rotated in the bore 40''' to a second position, triggering a locking of the pusher-retainer 48''' against the resilient bias of the spring 44'''.

Figure 5C:
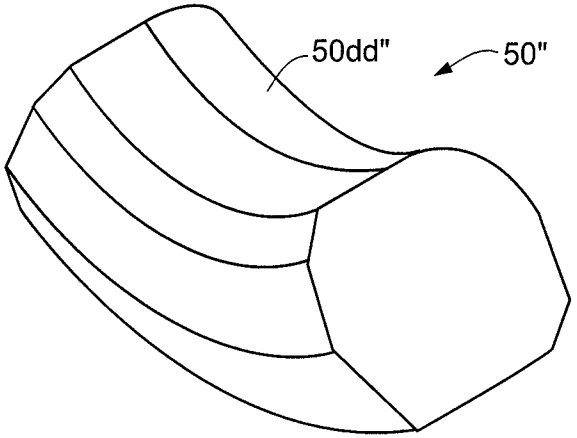
FIGS. 5C and 5D are perspective and side views of an exemplary wedge member as used with the carrier body of FIGS. 5A and 5B, according to certain embodiments of the invention.
Figure 5D:
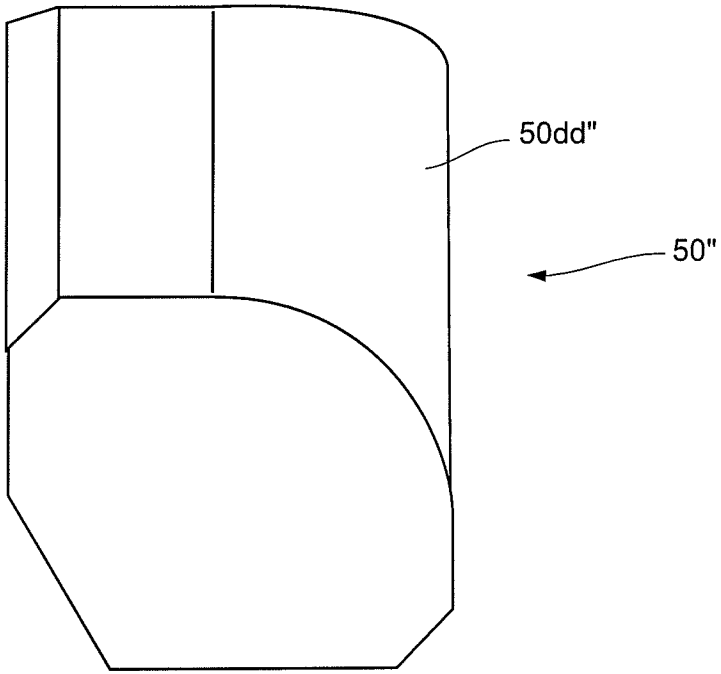

In certain embodiments, as shown in FIGS. 5A and 5B, the wedge members 50'' involve a differently shaped contact surface 50*dd''* with respect to corresponding surface 16*c'* of the punch tip hub 16*a'*. FIGS. 5C and 5D show perspective and side views of one of the wedge members 50'', according to certain embodiments of the invention. As described above, the pusher-retainer 48''' is configured to contact the wedge members 50'' when released so as to urge the wedge members 50'' in an outward direction with respect to the central cavity 36*c'''*. In light of this, the outward movement of the pusher-retainer 48''' may be adversely affected by (i.e., may catch on) the corresponding surfaces 50*dd''* if defined with edges. As such, in certain embodiments, the surface 50*dd''* of the wedge members 50'' is curved so that the pusher-retainer 48''' upon its contact with the wedge members 50'' can freely slide along such wedge member surfaces 50*dd''*. Such curved surface 50*dd''* also functions in sufficiently retaining the hub surface 16*c'* for securing the punch tip 16' with the punch body 14'''. As described above, the punch tip hub 16*a'* is configured to promote secure coupling even with slope angle difference (e.g., in the range from about 2° to about 15°) between the contacting surfaces of the punch tip hub 16*a'* and the wedge member 50''. As such, the curved shape of the wedge member surfaces 50*dd''* does not present an issue. Thus, even in cases of punch assemblies utilizing differing punch body configurations, so as to function with correspondingly different carrier bodies (such as the carrier body 36''') than the carrier bodies 36 or 36' embodied herein, the punch tip design embodied herein (with regard to characteristics of the punch tips 16 and 16') remains applicable.

Testing of the punch tip design was also expanded to punch bodies utilizing certain modifications and/or variations with regard to the ancillary components already described herein. For example, ancillary components have been exemplified herein to be initially triggered with the use of an additional tool (such as an allen or torx wrench), so as to alternately secure or release the punch tips with regard to the punch bodies. However, other punch assemblies, via the use of differing sets of ancillary components, may not require use of such additional tools.

Figure 6A:
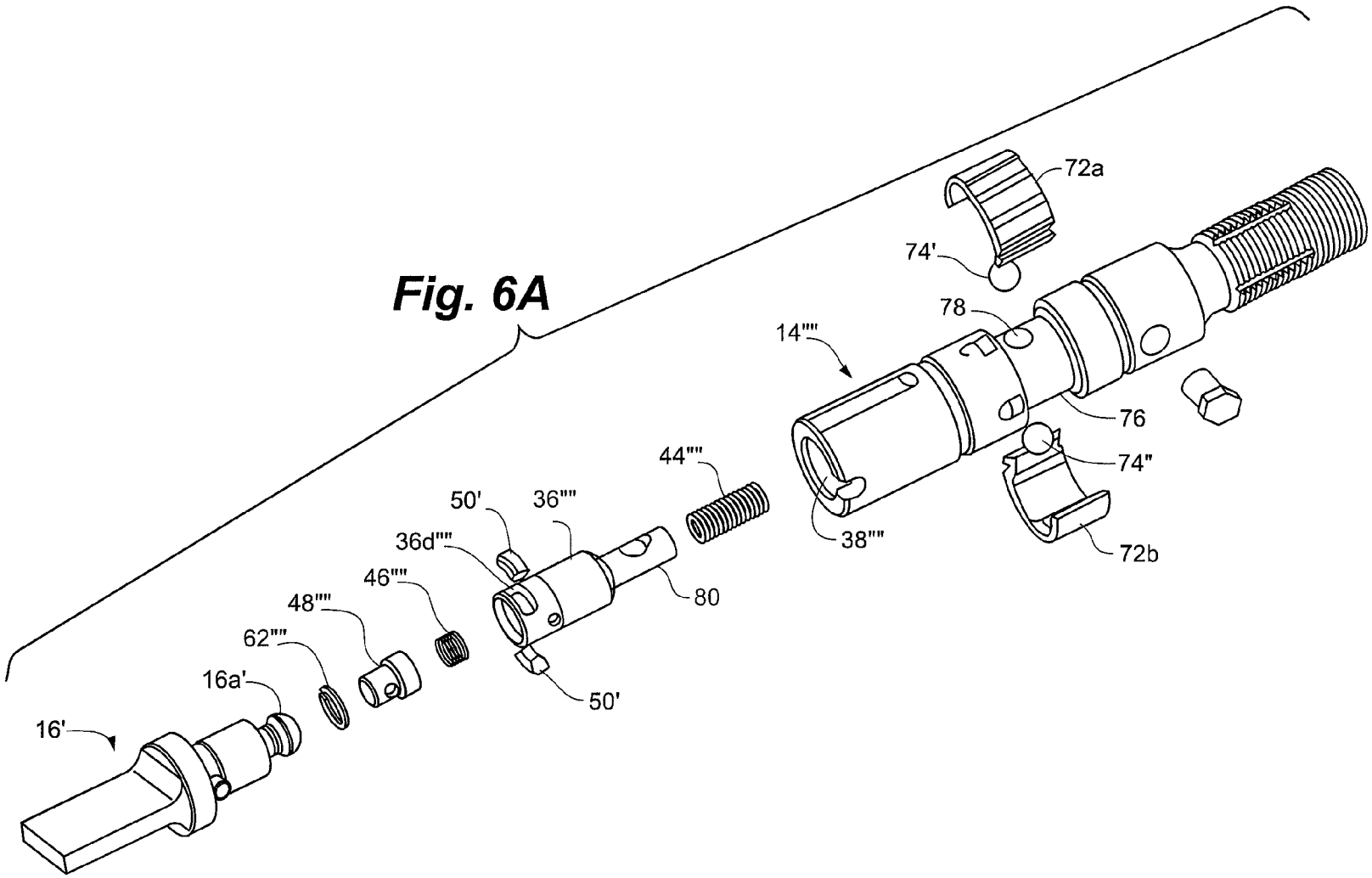
FIG. 6A is a perspective view of a punch body, a punch tip, and ancillary components of a further punch assembly, shown in exploded assembly view, according to certain embodiments of the invention.

FIG. 6A is a perspective view of a punch body 14'''', the punch tip 16' of FIGS. 2A and 2B, and the ancillary components of a further punch assembly, shown in exploded assembly view, according to certain embodiments of the invention. As shown, such punch body 14'''' includes a cam 72 for initially triggering other of the ancillary components for alternately securing or releasing the punch tip 16' with regard to the punch body 14''''. For example, the other ancillary components for the punch body 14'''' include a plurality of balls 74, a carrier body 36'''', a plurality of springs 44'''' and 46'''', a pusher-retainer 48'''', and a plurality of wedge members 50' (similar to those described with reference to FIGS. 3A-3J).

Figure 6B:
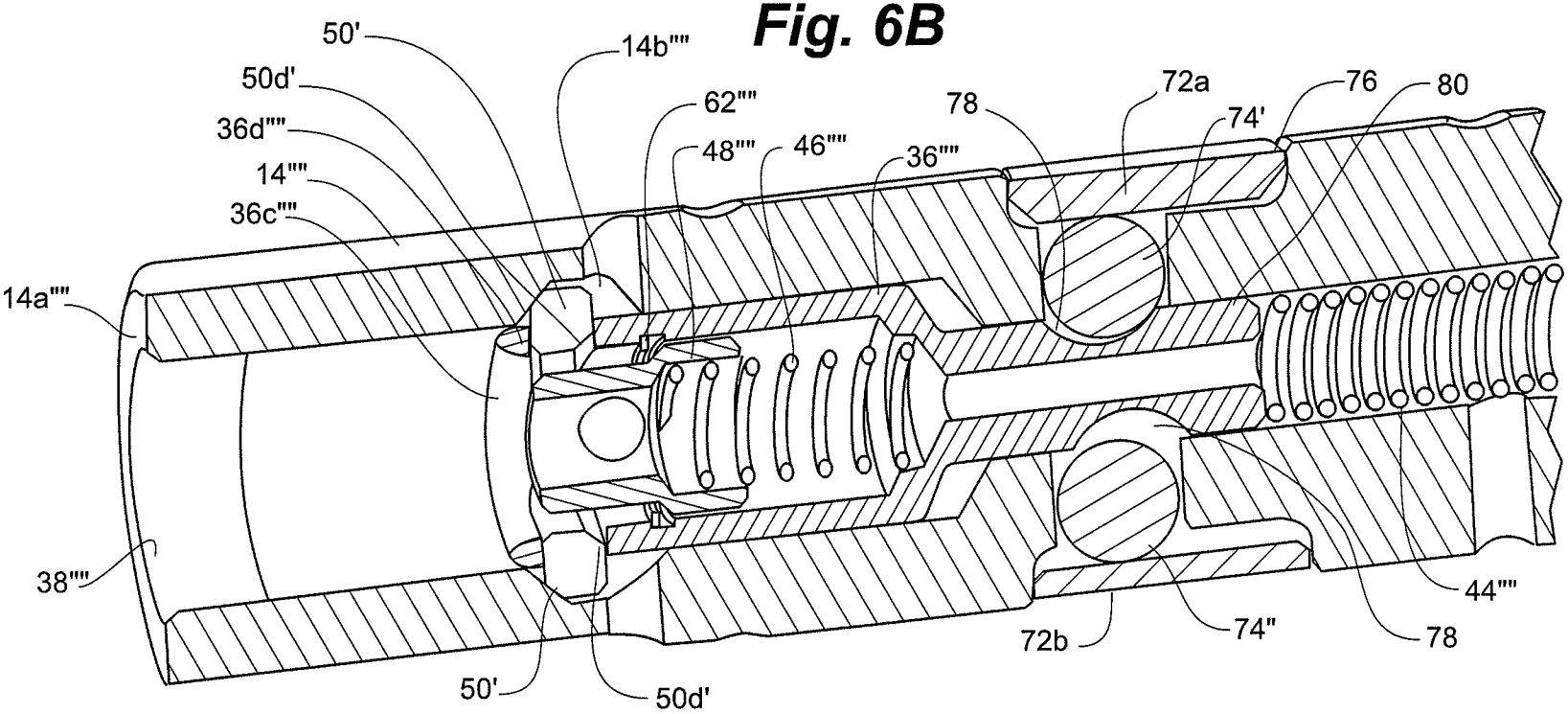
FIG. 6B is a side cross-sectional partial view of an assembly of the punch body and the ancillary components of FIG. 6A, with the ancillary components in one position relative to the punch body, according to certain embodiments of the invention.
Figure 6C:
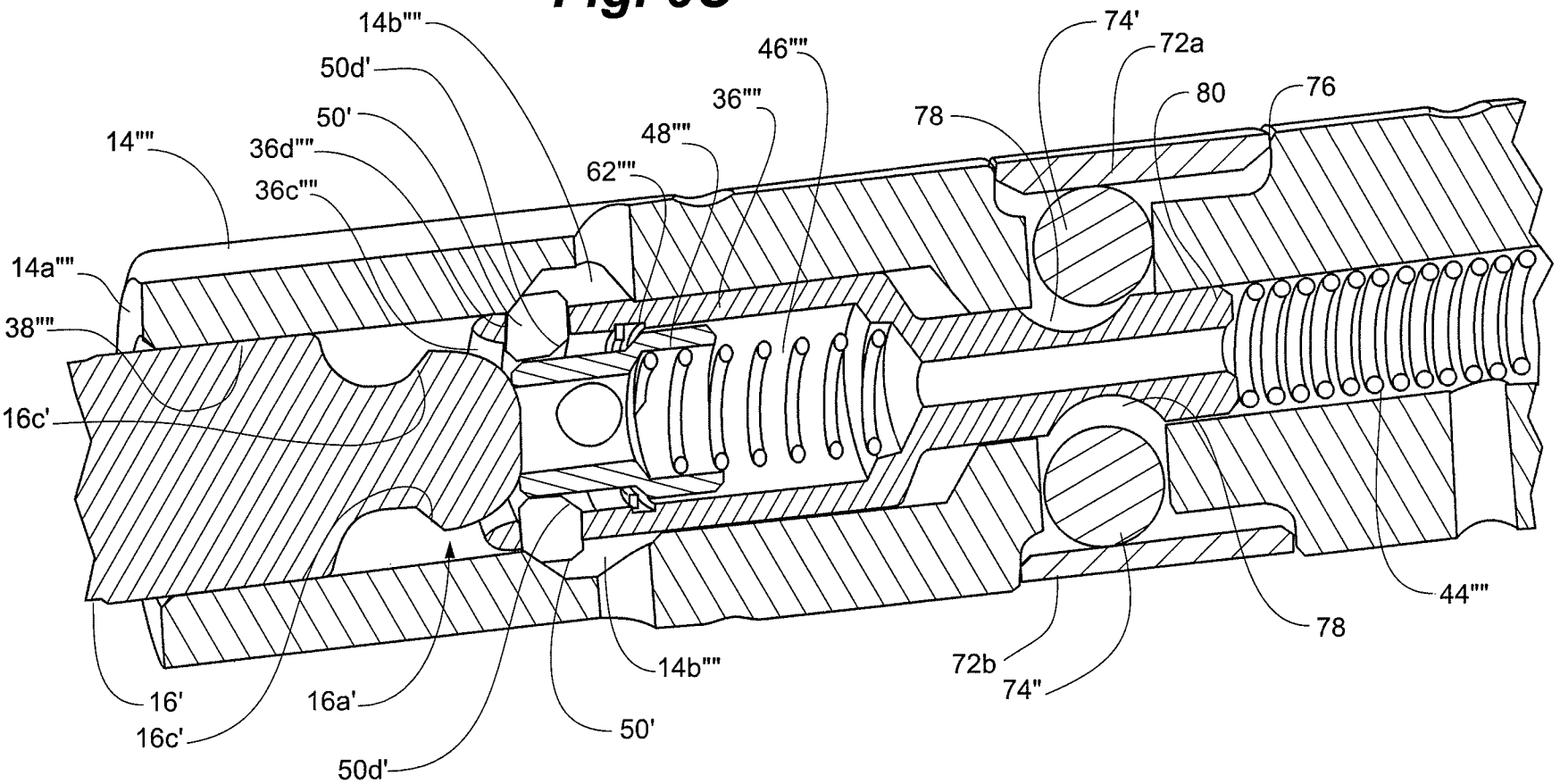
FIG. 6C is a side cross-sectional partial view of the punch body, the punch tip, and the ancillary components of FIG. 6A, with the ancillary components in another position relative to the punch body, according to certain embodiments of the invention.
Figure 6D:
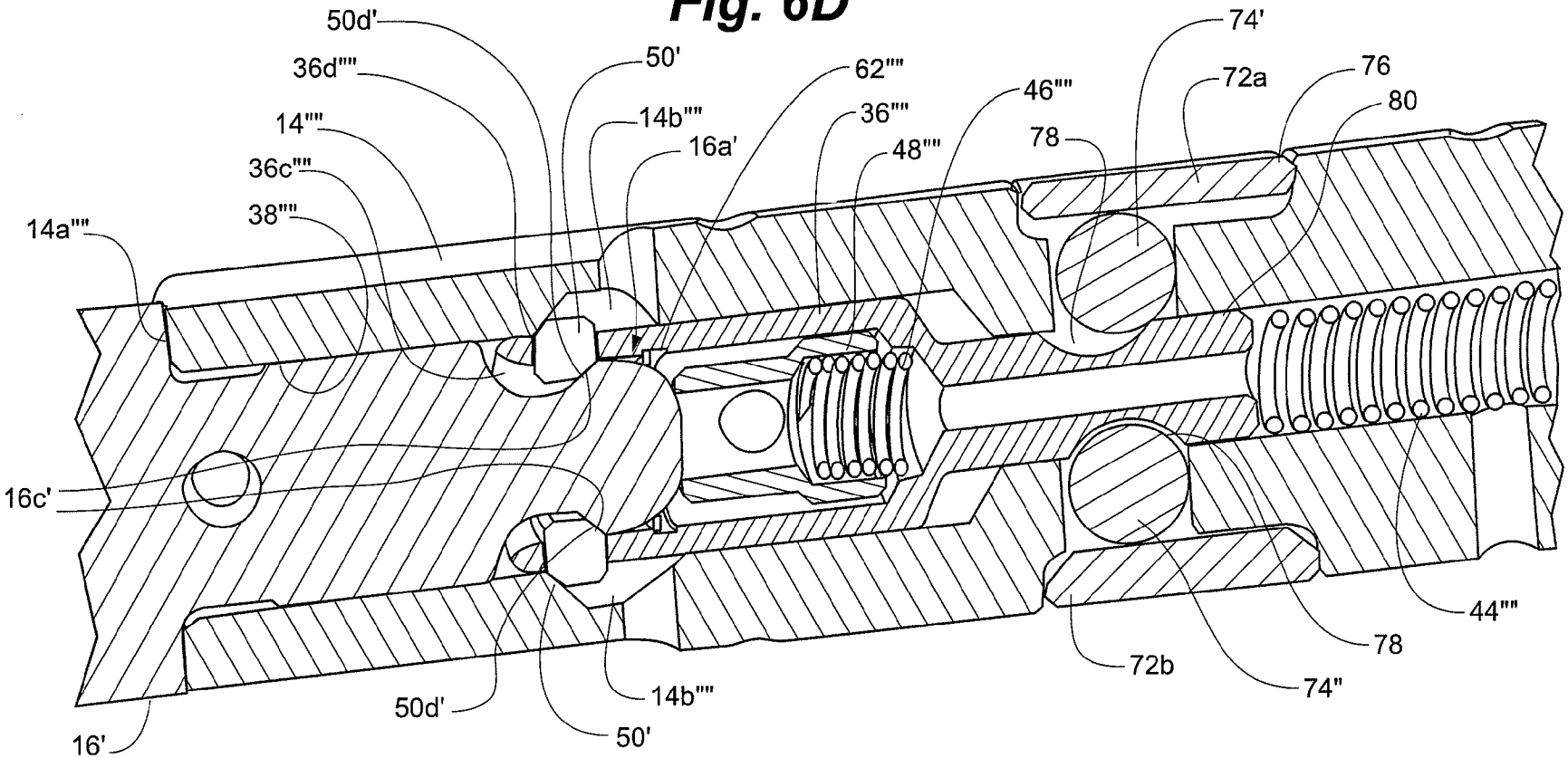
FIG. 6D is a side cross-sectional partial view of the punch body, the punch tip, and the ancillary components of FIG. 6A, with the ancillary components in a further position relative to the punch body, according to certain embodiments of the invention.

As shown, in certain embodiments, the cam 72 includes two curved partial portions 72*a* and 72*b*, which are configured to couple together to form a ring having varied segments of thickness about its circumference. The cam 72 is configured to sit within a corresponding channel 76 defined about the punch body's circumference. Similar to the cams 34 and 34' described above, the cam 72, in certain embodiments, is rotatable to differing locking positions, which correspond to positions for alternately securing or releasing the punch tip 16' with regard to the punch body 14''''. However, unlike the cams 34 and 34', the cam 72 is rotatable by hand (and without use of any additional tools). FIGS. 6B-6D show side cross-sectional partial views of the punch body 14'''' and the ancillary components, and how the components are situated in alternately securing or releasing the punch tip 16'. The cam 72 is configured to alternately seat first and second balls 74' and 74'' in depressions 78 located on opposing surfaces of a stem 80 of the carrier body 36'''. As further detailed below, corresponding movement of the carrier body 36'''' is dependent on which of the first ball 74' or the second ball 74'' (or whether any of the balls 74', 74'') is seated. To that end, but for use of the cam 72 as the initial triggering means, the steps by which the punch tip 16' is alternatively secured or released with regard to the punch body 14'''' (as further detailed below) involve variations of the steps already described herein with reference to FIGS. 3B, 3H, 3I, and 3J.

Regarding FIG. 6B, the punch body 14'''' is shown without the punch tip 16'. The cam 72 is coupled to the punch body 14'''', contacting each of the balls 74 with a differing thickness of the cam 72. As shown, a greater thickness of the cam 72 contacts the first ball 74' while a lesser thickness of the cam 72 contacts the second ball 74''. As shown, in certain embodiments, the depressions 78 in the carrier body stem 80 are defined at differing lengths from a first end 80*a* of the stem 80. In certain embodiments, the depression 78 corresponding to the first ball 74' is defined at a further distance from such stem end 80*a* then the depression 78 corresponding to the second ball 74''. Thus, when the first ball 74' is seated, the carrier body 36'''' is urged inward (i.e., away from the punch body front end 14*a''''*), while when the second ball 74'' is seated, the carrier body 36'''' is urged outward (i.e., toward the punch body front end 14*a''''*). The position of the carrier body 36'''' shown in FIG. 6B is for releasing (or inserting) the punch tip 16' with respect to the punch body 14''''. At such position, the first ball 74' is locked within its corresponding depression 78, which in turn forces the body 36'''' inward of (i.e., deeper within) the punch body central cavity 38''''. Such inward urging of the carrier body 36"" in turn forces the wedge members 50' to be pulled inward via their accommodation by slots 36*d*"" of the carrier body 36"". In particular, the wedge members 50' are pulled adjacent to grooves 14*b*"" of the punch body 14"". Such inward pull of the wedge members 50' along with outward force of the pusher-retainer 48"" (via its spring 46"") results in the pusher-retainer 48"" contacting and forcing the members 50' further out through the carrier body slots 36*d*"" and into the grooves 14*b*"". However, as further shown, the outward movement of the pusher-retainer 48"" is limited via contact with a lip (e.g., insert ring 62"") extending inward with respect to the central cavity 36*c*"" of the carrier body 36"".

Looking to FIG. 6C, the cam 72 is rotated such that lesser thicknesses of the cam 72 are positioned adjacent to each of the first and second balls 74' and 74". As such, neither of the balls 74', 74" is seated in its corresponding depression 78 of the carrier body stem 80. Continuing from FIG. 6B, the spring 44"" further urges the carrier body 36"" in an outward direction with respect to the punch body 14"" (i.e., toward the front end 14*a*"" thereof). Such outward urging of the carrier body 36"" in turn causes the wedge members 50' to similarly be pulled outward via their accommodation by the carrier body slots 36*d*"". In particular, the wedge members 50' are moved against the frontal side surfaces 64"" of the grooves 14*b*"" of the punch body 14"". The outward pull of the wedge members 50' (via the carrier body 36"") in combination with the slope of the frontal side surfaces 64"" of the grooves 14*b*"" results in the wedge members 50' sliding along such surfaces 64"", back through the carrier body slots 36*d*"" and into the central cavity 36*c*"" of the carrier body 36"". However, the wedge members 50' are prevented from sliding too far in light of contact being made with outer sides of the pusher-retainer 48"". As further shown in FIG. 6C, the punch tip 16' is shown as starting to be inserted into the central cavity 38"" of the punch body 14"", and can be further inserted until the punch tip hub 16*a*' passes by the wedge members 50' and confronts the protruding lip of the carrier body 36"".

Finally, with reference to FIG. 6D, the punch body 14"' is shown with the punch tip 16"' secured thereto. Following insertion of the punch tip hub 16*a*' within the punch body central cavity 38"", the cam 72 is rotated in position so that a greater thickness of the cam 72 contacts the second ball 74" while a lesser thickness of the cam 72 contacts the first ball 74'. At such position, the second ball 74" is locked within its corresponding depression 78. Continuing from that described above for FIG. 6C, the locking of the second ball 74" in turn locks the wedge members 50' from being pulled further inside the punch body grooves 14*b*"" due to their accommodation with the carrier body slots 36*d*"" and their contact with sloped surfaces 64"" of the punch body grooves 14*b*"".

As should be appreciated, the punch body design illustrated in FIGS. 6A-6D has little impact on the configuration of the contacting surfaces for the punch tip hub 14*a*"" and the wedge members 50'. As such, these surfaces can be configured similarly to those detailed above with respect to contacting surfaces 16*c*' and 50*d*' of punch tip hub 16*a*' and wedge members 50'. To that end, reference can again be made to FIG. 1B and the corresponding description above with regard to the configuration and contact surface of the punch tip hub 16*a*'. Further, reference can be made to FIGS. 1I and 1J and the corresponding description above with regard to the sides and contact surface 50*d*' of the wedge members 50'. Further, the workable angle ranges and preferable angles described above (as being found favorable for the contacting surfaces 16*c* and 50*d*' of the punch tip 16 and wedge members 50) can equally apply to the corresponding hub and wedge member surfaces 16*c*' and 50*d*' with regard to the punch tip 16' and wedge members 50', despite the narrowed and elongated shapes of the punch body 14' and punch tip 16'. Thus, even in cases of punch assemblies having distinct mechanisms for triggering, the punch tip design embodied herein (with regard to characteristics of the punch tip 16) remains applicable.

Figure 7A:
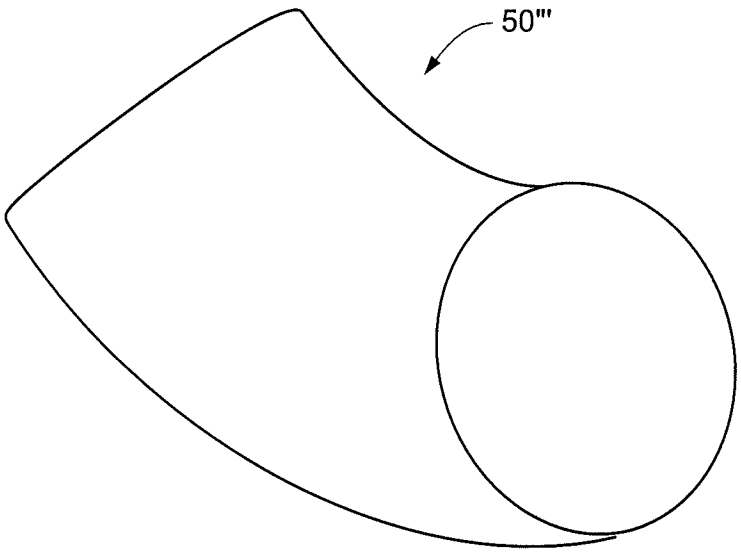
FIGS. 7A and 7B are perspective and side views of a further exemplary wedge member, according to certain embodiments of the invention.
Figure 7B:
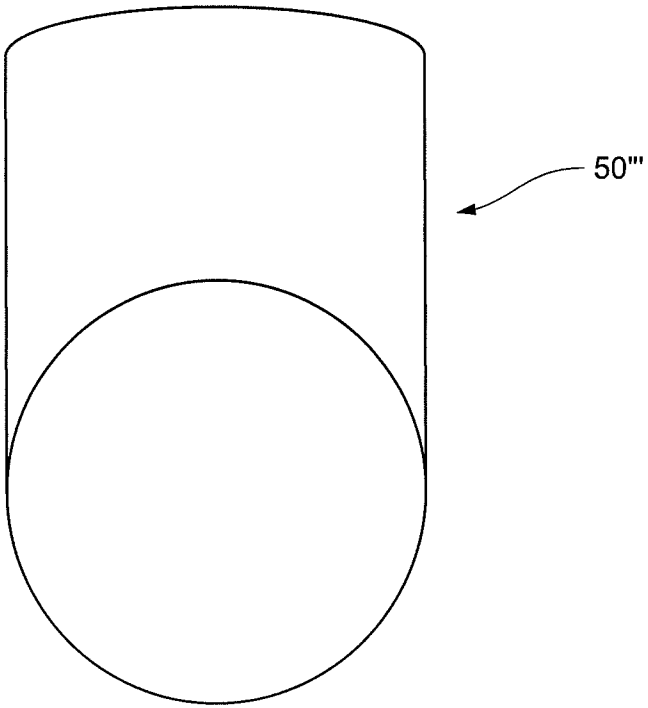

FIGS. 7A and 7B are perspective and side views of a further exemplary wedge member 50"', according to certain embodiments of the invention. As described above with reference to FIGS. 5A-5D, the surface of wedge members contacting the punch tip hub in punch assemblies can be curved. In certain embodiments, the wedge members used with punch bodies for securing/releasing the punch tip design embodied herein, can have entirely round outer side surfaces, such as exemplified with the wedge member 50"'.

Figure 8:
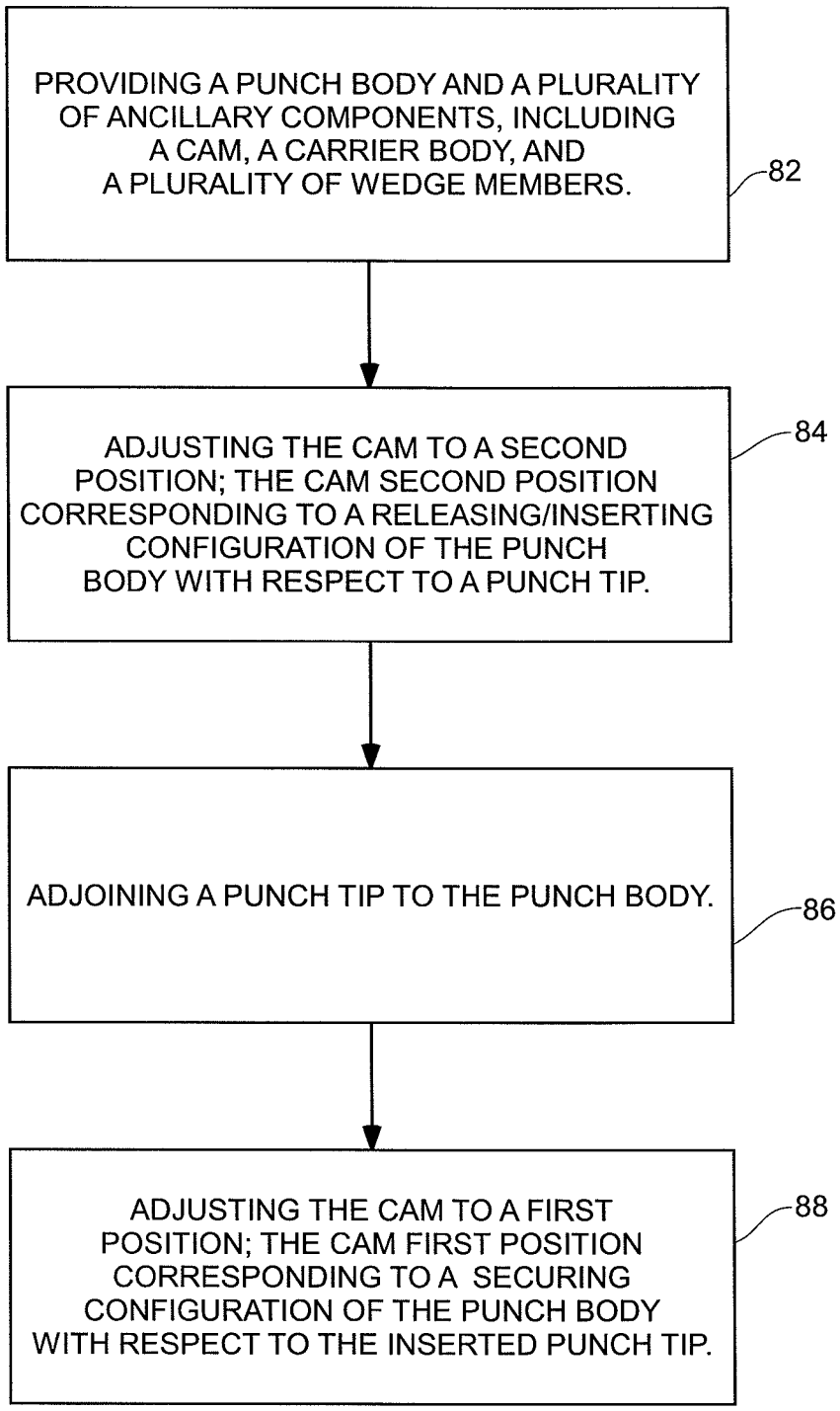
FIG. 8 is a flowchart of steps for securing a punch tip to a punch body for a punch assembly, according to certain embodiments of the invention.

FIG. 8 is a flowchart of steps for securing a punch tip to a punch body for a punch assembly, according to certain embodiments of the invention. It should be appreciated that the flowchart can relate to the punch bodies and punch tips illustrated in any of FIGS. 1B, 3B, 4B, and 6B herein. However, the flowchart steps are exemplarily described with reference to the punch body 14, punch tip 16, and ancillary components shown in FIG. 1B.

Step 82 involves initially providing a punch body 14 and a plurality of ancillary components used therewith. Similar to that already detailed above, the punch body 14 has a sidewall 32 that defines a central cavity 38, which extends along a longitudinal extent of the punch body 14. The plurality of ancillary components includes a cam 34, a carrier body 36, and a plurality of wedge members 50. The carrier body 36 is seated within the punch body central cavity 38, with the cam 34 coupling the punch body 14 and the carrier body 36 via aligned aperture 30 and bore 40.

Step 84 involves adjusting the cam 34 to a second position (corresponding to what is shown in FIGS. 1L and 1LL). The cam 34 in said second position corresponds to the carrier body 36 being lowered in position within the punch body central cavity 38 and each of the wedge members 50 being unlocked within the punch body central cavity 38. The unlocked position of the wedge members 50 corresponds to an unlocking configuration of the punch body 14 with respect to a punch tip 16. Step 86 involves adjoining a punch tip 16 to the punch body 14. The punch tip 16 includes a hub 16*a* on one end thereof, with the hub 16*a* being inserted within the central cavity 38 of the punch body 14.

Step 88 involves adjusting the cam to a first position (corresponding to what is shown in FIG. 1B) which corresponds with the carrier body 36 being raised in position within the punch body central cavity 38 and each of the wedge members 50 being locked within the punch body central cavity 38. The locked position of the wedge members 50 corresponds to a locking configuration of the punch body 14 with respect to the punch tip hub 16*a*.

In the foregoing detailed description, the invention has been described with reference to specific embodiments. However, it may be appreciated that various modifications and changes can be made without departing from the scope of the invention as set forth in the appended claims.

The invention claimed is:

1. A punch tool comprising:

a punch body having a sidewall that defines a central cavity, the central cavity extending along a longitudinal extent of the punch body;

a punch tip comprising a body having a first end configured to be alternately secured or released with respect to the punch body and a second end comprising a working end of the punch tip, the first end including a hub;

a carrier body seated within the punch body central cavity and selectively movable between raised and lowered positions within the cavity; and a plurality of wedge members movable between locked and unlocked positions within the punch body central cavity and respectively corresponding to the raised and lowered positions of the carrier body, said locked position of the wedge members corresponding to a locking configuration of the punch body with respect to the punch tip hub;

wherein each of the plurality of wedge members includes a surface having a shape configured to mate with a corresponding surface of the punch tip hub, the surfaces of the wedge members and the punch tip hub representing the only contacting surfaces between the wedge members and the punch tip hub in securing the punch tip to the punch body.

2. The punch tool of claim 1, wherein the punch tip hub is offset from a remainder of the punch tip body by a neck region, the hub having an upper area, a side area, and a bottom area, the bottom area of the hub and the neck region defining a recessed area of the body, the corresponding surface of the hub being at the bottom area and having an inward slope relative to the hub side area.

3. The punch tool of claim 2 wherein the inward slope of the bottom area surface of the hub is planar and enables secure coupling with the corresponding surface of the wedge members even in event of said corresponding surface varying in slope angle between about 2° and about 20° with the bottom area surface.

4. The punch tool of claim 2 wherein the inward slope angle of the bottom area surface of the hub as measured from an axis running along a longitudinal extent of the punch body is in the range of between about 37° and about 50° and the surface of the wedge members has a slope angle in the range of between about 43° and about 56°.

5. The punch tool of claim 1, further comprising a cam coupling the punch body and the carrier body, the cam selectively adjustable with respect to the punch body and the carrier body, adjustment of the cam resulting in corresponding movement of the carrier body between the raised and lowered positions.

6. The punch tool of claim 5 wherein the cam is selectively adjustable via rotation and includes one or more protruding portions, wherein orientation of the one or more protruding portions via rotation of the cam results in the corresponding movement of the carrier body.

7. The punch tool of claim 5 wherein the cam comprises a rod-like body that extends from an aperture defined in the punch body sidewall and through a bore defined in the carrier body.

8. The punch tool of claim 7 wherein the rod-like body has a longitudinal extent that is generally perpendicular to the longitudinal extent of the punch body.

9. The punch tool of claim 1 wherein the carrier body is defined with a plurality of slots each defined to accommodate one of the plurality of wedge members, and wherein movement of the carrier body within the punch body central cavity results in corresponding movement of the wedge members relative to corresponding grooves defined in an inner surface of the punch body sidewall.

10. The punch tool of claim 9 further comprising a pusher-retainer seated in a central cavity of the carrier body, wherein the pusher retainer is urged to a raised position in the central cavity when the carrier body is in the lowered position, wherein the pusher-retainer in the raised position prevents the wedge members from sliding out of the carrier body slots and into the carrier body central cavity.

11. The punch tool of claim 9 wherein the wedge members are configured to contact and slide along side surfaces of the punch body grooves, wherein combined contact with the groove side surfaces and walls defining the carrier body slots results in locking of the wedge members when the carrier body is in the raised position.

12. The punch tool of claim 9, wherein the wedge members are configured to contact and slide along side surfaces of the punch body grooves, wherein the wedge members correspondingly slide within the carrier body slots and partially protrude into a central cavity of the carrier body when the carrier body is in the raised position.

13. A method of securing a punch tip with a punch body, the method comprising:

(a) providing a punch body with a carrier body and a plurality of wedge members used therewith, the carrier body seated within the punch body central cavity;

(b) adjusting the carrier body to a lowered in position within the punch body central cavity, whereby each of the wedge members become unlocked within the punch body central cavity, said unlocked position of the wedge members corresponding to a unlocking configuration of the punch body with respect to a punch tip;

(c) adjoining a punch tip to the punch body, the punch tip including a hub on one end thereof, the punch tip hub being inserted within the central cavity of the punch body; and (d) adjusting the carrier body to a raised position within the punch body central cavity, whereby each of the wedge members become locked within the punch body central cavity, said locked position of the wedge members corresponding to a locking configuration of the punch body with respect to the punch tip hub, each of the plurality of wedge members including a surface having a shape configured to mate with a corresponding surface of the punch tip hub, the surfaces of the wedge members and the punch tip hub representing the only contacting surfaces between the wedge members and the punch tip hub in securing the punch tip to the punch body.

14. The method of claim 13 wherein the carrier body is defined with a plurality of slots each defined to accommodate one of the plurality of wedge members, and wherein the raising and lowering of the carrier body within the punch body central cavity results in the wedge members moving relative to corresponding grooves defined in an inner surface of the punch body sidewall.

15. The method of claim 14 wherein the wedge members are configured to contact and slide along side surfaces of the punch body grooves, wherein the wedge members correspondingly slide within the carrier body slots and partially protrude into a central cavity of the carrier body when the carrier body is in the raised position.

* * * * *